US007534534B2

(12) United States Patent
Nakata et al.

(10) Patent No.: US 7,534,534 B2
(45) Date of Patent: May 19, 2009

(54) ELECTROPHOTOGRAPHIC PHOTOSENSITIVE MEMBER, METHOD FOR MANUFACTURING ELECTROPHOTOGRAPHIC PHOTOSENSITIVE MEMBER, PROCESS CARTRIDGE AND ELECTROPHOTOGRAPHIC APPARATUS

(75) Inventors: Koichi Nakata, Toride (JP); Akira Shimada, Sunto-gun (JP); Tatsuya Ikezue, Toride (JP); Takahiro Mitsui, Kashiwa (JP); Hiroki Uematsu, Abiko (JP); Shuji Ishii, Toride (JP); Shoji Amamiya, Kashiwa (JP); Akio Maruyama, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 447 days.

(21) Appl. No.: 11/154,681

(22) Filed: Jun. 17, 2005

(65) Prior Publication Data

US 2005/0255393 A1 Nov. 17, 2005

Related U.S. Application Data

(63) Continuation of application No. PCT/JP2005/006418, filed on Mar. 25, 2005.

(30) Foreign Application Priority Data

Mar. 26, 2004 (JP) ..... 2004-092099
Apr. 27, 2004 (JP) ..... 2004-131660
Oct. 22, 2004 (JP) ..... 2004-308308

(51) Int. Cl.
*G03G 15/00* (2006.01)

(52) U.S. Cl. ..... 430/56; 430/127; 399/159

(58) Field of Classification Search ..... 430/56, 430/127; 399/159
See application file for complete search history.

(56) References Cited

U.S. PATENT DOCUMENTS 5,114,814 A 5/1992 Sakoh et al. ..... 430/46
5,148,639 A 9/1992 Sakai et al. ..... 51/328

(Continued)

FOREIGN PATENT DOCUMENTS

EP 1 172701 1/2000

(Continued)

*Primary Examiner*—Mark A. Chapman
(74) *Attorney, Agent, or Firm*—Fitzpatrick, Cella, Harper & Scinto

(57) ABSTRACT

An electrophotographic photosensitive member hard to cause the problem of chatter and wear-out of the cleaning blade and the problem of a rubbing memory, and both a process cartridge and an electrophotographic apparatus having the photosensitive member are provided. The peripheral surface of the photosensitive member has a plurality of dimple-shaped concaves, a 10-point average roughness Rzjis (A) as measured by sweeping along the circumference of the peripheral surface of the photosensitive member is 0.3 to 2.5 μm, a 10-point average roughness Rzjis (B) as measured by sweeping along the generating line of the peripheral surface of the photosensitive member is 0.3 to 2.5 μm, a mean spacing of profile irregularities, RSm (C), as measured by sweeping along the circumference of the peripheral surface of the photosensitive member is 5 to 120 μm, a mean spacing of profile irregularities, RSm (D), as measured by sweeping along the generating line of the photosensitive member is 5 to 120 μm, and the value of a ratio (D/C) of the mean spacing of profile irregularities RSm (D) to the mean spacing of profile irregularities RSm (C) is 0.5 to 1.5.

14 Claims, 5 Drawing Sheets

U.S. PATENT DOCUMENTS

| | | | | |
|---|---|---|---|---|
| 5,242,773 | A | 9/1993 | Iino et al. | 430/58 |
| 5,242,776 | A | 9/1993 | Doi et al. | 430/67 |
| 5,411,827 | A | 5/1995 | Tamura et al. | 430/58 |
| 2002/0045116 | A1 | 4/2002 | Morikawa et al. | 430/66 |
| 2006/0008717 | A1 | 1/2006 | Uematsu et al. | 430/56 |
| 2006/0019185 | A1 | 1/2006 | Amamiya et al. | 430/66 |

FOREIGN PATENT DOCUMENTS

| | | |
|---|---|---|
| JP | 52-26226 | 2/1977 |
| JP | 53-92133 | 8/1978 |
| JP | 57-94772 | 6/1982 |
| JP | 1-99060 | 4/1989 |
| JP | 2-127652 | 5/1990 |
| JP | 2-139566 | 5/1990 |
| JP | 2-150850 | 6/1990 |
| JP | 04-175767 | 6/1992 |
| JP | 5-216249 | 8/1993 |
| JP | 7-72640 | 3/1995 |
| JP | 2000-66424 | 3/2000 |
| JP | 2000-66425 | 3/2000 |
| JP | 2000-122434 | 4/2000 |
| JP | 2002-082465 | 3/2002 |

ELECTROPHOTOGRAPHIC PHOTOSENSITIVE MEMBER, METHOD FOR MANUFACTURING ELECTROPHOTOGRAPHIC PHOTOSENSITIVE MEMBER, PROCESS CARTRIDGE AND ELECTROPHOTOGRAPHIC APPARATUS

This application is a continuation of International Application No. PCT/JP2005/006418 filed on Mar. 25, 2005, which claims the benefit of Japanese Patent Application No. 2004-092099 filed on Mar. 26, 2004, No. 2004-131660 filed on Apr. 27, 2004 and No. 2004-308308 filed on Oct. 22, 2004.

BACKGROUND OF THE INVENTION

1. Field of the Invention

The present invention relates to an electrophotographic photosensitive member, a method for manufacturing an electrophotographic photosensitive member, and a process cartridge and an electrophotographic apparatus having an electrophotographic photosensitive member.

2. Related Background Art

For electrophotographic photosensitive members, electrophotographic photosensitive members made by providing on a cylindrical support a photosensitive layer (organic photosensitive layer) using an organic material as a photoconductive material (charge generation material and charge transport material), so called organic electrophotographic photosensitive members have come into wide use because of their advantages of low costs, high productivity and the like. For organic electrophotographic photosensitive members, electrophotographic photosensitive members having a photosensitive layer made by stacking a charge generation layer containing a charge generation material such as a photoconductive dye or photoconductive pigment and a charge transport layer containing a charge transport material such as a photoconductive polymer or photoconductive low molecule compound, so called a multi-layer photosensitive layer, are mainstream because of their advantages of high sensitivity, high durability and the like.

For electrophotographic photosensitive members, cylindrical electrophotographic photosensitive members made by providing a photosensitive layer on a cylindrical support are generally used.

Since electric external forces and/or mechanical external forces from charging (primary charging), exposure (image exposure), development by a toner, transfer onto a transfer material such as paper, and cleaning of a transfer residual toner are applied directly to the peripheral surface (surface) of the electrophotographic photosensitive member, the electrophotographic photosensitive member is required to have durability to these external forces. Specifically, the electrophotographic photosensitive member is required to have durability to occurrence of scars and wear resulting from the external forces, i.e. scratch resistance and wear resistance.

For the technique for improving the scratch resistance and wear resistance of the peripheral surface of the organic electrophotographic photosensitive member, for example, an electrophotographic photosensitive member in which a cured layer using a curable resin as a binding resin is used as a surface layer (a layer located at the outermost surface of the electrophotographic photosensitive member, in other words, a layer at a greatest distance from the support) is disclosed in Japanese Patent Application Laid-Open No H02-127652.

An electrophotographic photosensitive member in which a cured charge transport layer formed by curing polymerization of a monomer having a carbon-carbon double bond and a charge transporting monomer having a carbon-carbon double bond by heat or light energy is used as a surface layer is disclosed in Japanese Patent Application Laid-Open No. H05-216249 and Japanese Patent Application Laid-Open No. H07-072640.

An electrophotographic photosensitive member in which a cured charge transport layer formed by curing polymerization of positive hole transporting compound having a chain polymerizable functional group in its molecule by electron beam energy is used as a surface layer is disclosed Japanese Patent Application Laid-Open No. 2000-066424 and Japanese Patent Application Laid-Open No. 2000-066425.

In this way, as a technique for improving the scratch resistance and wear resistance of the peripheral surface of the organic electrophotographic photosensitive member, a technique in which a cured layer is used as a surface layer of the electrophotographic photosensitive member, whereby the mechanical strength of the surface layer is enhanced has been established in recent years.

The electrophotographic photosensitive member is used in an electrophotographic image formation process consisting of a charging step, an exposure step, a development step, a transfer step and a cleaning step as described above.

In the electrophotographic image formation process, the cleaning step of cleaning the peripheral surface of the electrophotographic photosensitive member by removing a toner remaining on the electrophotographic photosensitive member after the transfer step, so called a transfer residual toner is a step important for obtaining a clear image.

For the cleaning method, a method in which a cleaning blade is abutted against the electrophotographic photosensitive member to eliminate a gap between the cleaning blade and the electrophotographic photosensitive member, and leakage or slipping-through of the toner is thus prevented, whereby the transfer residual toner is scraped off is mainstream because of advantages of costs and ease of design.

Particularly, if a full color image is formed, the amount of toner used is much larger than the amount of toner used when a monochrome image is formed because toners of multiple colors such as magenta, cyan, yellow and black are superimposed on one after another to reproduce a desired color, and therefore a cleaning method using a cleaning blade is most suitable.

However, the cleaning method using a cleaning blade has a disadvantage that the cleaning blade tends to chatter and wear out because of strong friction between the cleaning blade and the electrophotographic photosensitive member. The chatter of the cleaning blade is a phenomenon in which the cleaning blade vibrates due to an increase in friction resistance between the cleaning blade and the peripheral surface of the electrophotographic photosensitive member, and the wear-out of the cleaning blade is a phenomenon in which the cleaning blade is inverted in a direction along which the electrophotographic photosensitive member travels.

These problems of the cleaning blade become more significant as the mechanical strength of the surface layer of the electrophotographic photosensitive member increases, i.e. the peripheral surface of the electrophotographic photosensitive member becomes hard to be worn.

The surface layer of the organic electrophotographic photosensitive member is often formed by a dip coating method in general, but the surface of the surface layer, i.e. the peripheral surface of the electrophotographic photosensitive member formed by the dip coating method is very flat, an area of contact between the cleaning blade and the peripheral surface of the electrophotographic photosensitive member therefore increases, and friction resistance between the cleaning blade and the peripheral surface of the electrophotographic photosensitive member increases, thus making the above problems more significant.

As one method for overcoming the chatter and wear-out of the cleaning blade, a method in which the peripheral surface of the electrophotographic photosensitive member is appropriately roughened is known.

For the technique for roughening the peripheral surface of the electrophotographic photosensitive member, for example, a technique in which the surface roughness (roughness of peripheral surface) of the electrophotographic photosensitive member is limited within a specified range for facilitating separation of a transfer material from the peripheral surface of the electrophotographic photosensitive member is disclosed in Japanese Patent Application Laid-Open No. S53-092133. A method in which the peripheral surface of the electrophotographic photosensitive member is roughened into an orange peel surface by controlling drying conditions in formation of the surface layer is disclosed in Japanese Patent Application Laid-Open No. S53-092133.

A technique in which particles are incorporated in the surface layer to roughen the peripheral surface of the electrophotographic photosensitive member is disclosed in Japanese Patent Application Laid-Open No. S52-026226.

A technique in which the peripheral surface of the electrophotographic photosensitive member is roughened by polishing the surface of the surface layer using a metal wire blush is disclosed in Japanese Patent Application Laid-Open No. S57-094772.

A technique in which the peripheral surface of the organic electrophotographic photosensitive member is roughened for solving the invert (wear-out) of the cleaning blade and chipping of an edge portion which raise a problem when the electrophotographic photosensitive member is used with an electrophotographic apparatus of specific process speed or greater, by using specific cleaning means and toners is disclosed in Japanese Patent Application Laid-Open No. H01-099060.

A technique in which the peripheral surface of the electrophotographic photosensitive member is roughened by polishing the surface of the surface layer using a film-shaped polishing material is disclosed in Japanese Patent Application Laid-Open No. H02-139566.

A technique in which the peripheral surface of the electrophotographic photosensitive member is roughened by a blast process is disclosed in Japanese Patent Application Laid-Open No. H02-150850. However, the shape of the peripheral surface of the electrophotographic photosensitive member roughened in this way is unknown.

However, the above prior art techniques could not sufficiently solve the problems of chatter and wear-out of the cleaning blade described above.

If friction of the peripheral surface of the electrophotographic photosensitive member is strong, a problem of a rubbing memory tends to occur when pre-rotation is performed without charging and exposure, but the above prior art techniques could not sufficiently solve the problem.

SUMMARY OF THE INVENTION

The object of the present invention is to provide an electrophotographic photosensitive member hard to cause the problem of chatter and wear-out of the cleaning blade and the problem of a rubbing memory described above, a method for manufacturing the electrophotographic photosensitive member, and a process cartridge and an electrophotographic apparatus having the electrophotographic photosensitive member.

As a result of conducting vigorous studies, the present inventors found that the above problems could be effectively alleviated if the peripheral surface of the electrophotographic photosensitive member is made to have dimple-shaped concaves and have a specific surface roughness.

Specifically, the present invention provides a cylindrical electrophotographic photosensitive member comprising a cylindrical support and an organic photosensitive layer provided on the cylindrical support, wherein the peripheral surface of the electrophotographic photosensitive member has a plurality of dimple-shaped concaves, a 10-point average roughness Rzjis (A) as measured by sweeping along the circumference of the peripheral surface of the electrophotographic photosensitive member is 0.3 to 2.5 μm, a 10-point average roughness Rzjis (B) as measured by sweeping along the generating line of the peripheral surface of the electrophotographic photosensitive member is 0.3 to 2.5 μm, a mean spacing of profile irregularities, RSm (C), as measured by sweeping along the circumference of the peripheral surface of the electrophotographic photosensitive member is 5 to 120 μm, a mean spacing of profile irregularities, RSm (D), as measured by sweeping along the generating line of the electrophotographic photosensitive member is 5 to 120 μm, and the value of a ratio (D/C) of the mean spacing of profile irregularities RSm (D) to the mean spacing of profile irregularities RSm (C) is 0.5 to 1.5.

The present invention provides a method for manufacturing the electrophotographic photosensitive member described above, comprising: a surface layer forming step of forming a surface layer of the electrophotographic photosensitive member; and a concave forming step of forming dimple-shaped concaves on the surface of the surface layer by subjecting the surface of the surface layer to a dry blast process or wet honing process.

The present invention provides a process cartridge which integrally supports the above electrophotographic photosensitive member or an electrophotographic photosensitive member manufactured by the above manufacturing method and at least one selected from the group consisting of charging means, development means and cleaning means, and is detachably attachable to an electrophotographic apparatus main body.

The present invention provides an electrophotographic apparatus comprising the above electrophotographic photosensitive member or an electrophotographic photosensitive member manufactured by the above manufacturing method, charging means, exposure means, development means, transfer means and cleaning means.

According to the present invention, an electrophotographic photosensitive member hard to cause the problem of chatter and wear-out of the cleaning blade and the problem of a rubbing memory described above, and a process cartridge and an electrophotographic apparatus having the electrophotographic photosensitive member can be provided.

DESCRIPTION OF THE PREFERRED EMBODIMENTS

Figure 1:
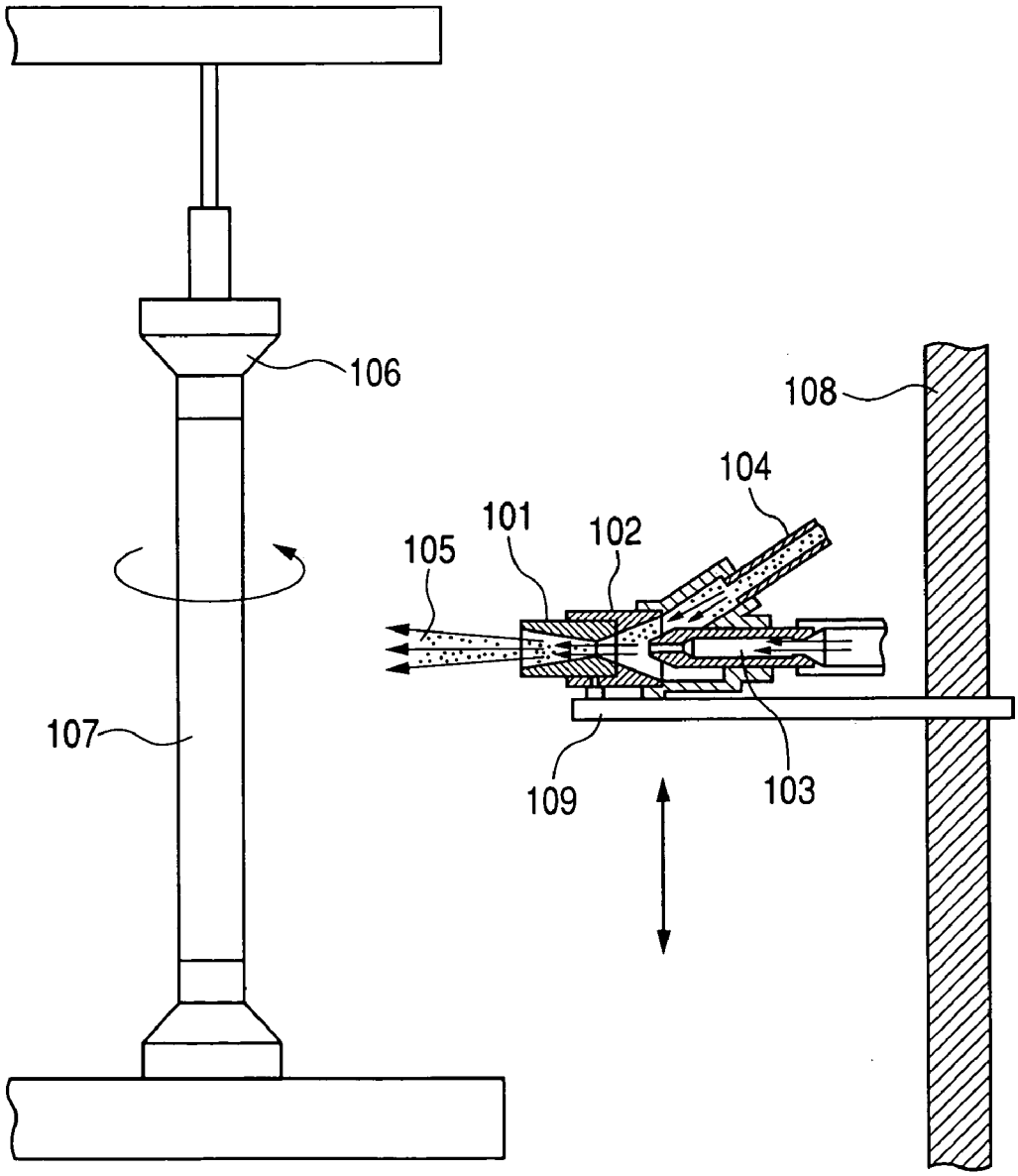
FIG. 1 shows an example of a dry blast process apparatus.

An electrophotographic photosensitive member of the present invention is an electrophotographic photosensitive member (organic electrophotographic photosensitive member) having a plurality of dimple-shaped concaves in the peripheral surface.

The total area of the dimple-shaped concaves is preferably larger than the total area of portions other than dimple-shaped concaves (portions remaining a reference surface before the surface is roughened).

It is preferable that the dimple-shaped concaves each exist in isolation and particularly, it is preferable that the dimple-shaped concaves do not range in a striped form along the circumference or generating line (rotation axis) of the electrophotographic photosensitive member. If they range in a striped form, low-resistance substances such as charge products are accumulated in the striped portion, and striped image defects are easily generated when the electrophotographic photosensitive member is used under a high temperature and high humidity circumstance for a long time period. The striped image defect becomes especially noticeable as the elastic deformation rate of the peripheral surface of the electrophotographic photosensitive member increases, specifically as the elastic deformation rate of the peripheral surface of the electrophotographic material increases to 40% or greater, to 45% or greater, and to 50% or greater.

If the peripheral surface of the electrophotographic photosensitive member is too flat and smooth, the resistance of slide friction with a cleaning blade may increase so that the cleaning blade chatters and is worn out, a rubbing memory occurs, or charge products accumulated on the peripheral surface of the electrophotographic photosensitive member are spread and remain on the peripheral surface, whereby deletion of electrostatic latent images occurs and output images become unclear.

As a method for solving the problem, it is effective to make the peripheral surface of the electrophotographic photosensitive member have a plurality of dimple-shaped concaves. Even if charge products are deposited on the peripheral surface of the electrophotographic photosensitive member, there are not many routes for deletion of electrostatic latent images, and thus deletion of electrostatic latent images is hard to occur because concaves do not extend in a specific direction (because concaves do not have a striped shape but have a dimple shape).

Among the dimple-shaped concaves, the number of dimple-shaped concaves of which the maximum diameter is in the range of 1 to 50 μm and the depth is in the range of 0.1 to 2.5 μm is preferably 5 to 50, more preferably 5 to 40 per 10,000 $\mu m^2$ (100 μm×100 μm) of peripheral surface of the electrophotographic photosensitive member.

Among the dimple-shaped concaves, the total area of dimple-shaped concaves of which the maximum diameter is in the range of 1 to 50 μm and the depth is in the range of 0.1 to 2.5 μm is preferably 3 to 60% (area ratio of dimple-shaped concaves), more preferably 3 to 50% based on the area of the entire peripheral surface of the electrophotographic photosensitive member.

If the number of dimple-shaped concaves is either too large or too small, and the area ratio is either too large or too small, the effect of the present invention is hard to be obtained.

Among the dimple-shaped concaves, the average aspect ratio of dimple-shaped concaves of which the maximum diameter is in the range of 1 to 50 μm and the depth is in the range of 0.1 to 2.5 μm is preferably 0.50 to 0.95.

If the average aspect ratio of dimple-shaped concaves is too small, image deletion may occur when the electrophotographic photosensitive member is used under a high temperature and high humidity circumstance.

In the present invention, the measurement of dimple-shaped concaves on the peripheral surface of the electrophotographic photosensitive member was made in the following way using a surface shape measurement system: Surface Explorer SX-520DR manufactured by Ryoka System Inc.

First, an electrophotographic photosensitive member to be measured was placed on a work piece table, and horizontally registered by tilt adjustment, and three-dimensional shape data concerning the peripheral surface of the electrophotographic photosensitive member was captured in a wave mode. At this time, the magnifying power of an objective lens was ×50, and an observation was made in a visual field of 100 μm×100 μm (10,000 $\mu m^2$).

Then, contour data concerning the peripheral surface of the electrophotographic photosensitive member was displayed using a particle analysis program in data analysis software.

For pore analysis parameters for determining the dimple shape and the area of concaves, the upper limit of the maximum diameter was 50 μm, the lower limit of the maximum diameter was 1 μm, the lower limit of the depth was 0.1 μm, and the lower limit of the volume was 1 $\mu m^3$ or greater. The number of concaves which could be determined to have dimple shapes on an analysis screen was counted, and this number was determined to be the number of dimple-shaped concaves. An observation was made in a visual field of 100 μm×100 μm (10,000 $\mu m^2$).

The total area of dimple-shaped concaves was calculated from the sum of the areas of dimple-shaped concaves which could be determined using the above particle analysis program under visual field and analysis conditions same as those described above, and the area ratio of dimple-shaped concaves was calculated from "(total area of dimple-shaped concaves/gross area)×100[%]". The gross area was made 10,000 $\mu m^2$ (100 μm×100 μm).

The average value of the aspect ratios of dimple-shaped concaves which could be identified under visual field and analysis conditions same as those described above was calculated, and this average value was determined to be an average aspect ratio of dimple-shaped concaves.

In the present invention, there is no limitation on the method for making the peripheral surface of the electrophotographic photosensitive member have a plurality of dimple-shaped concaves, but the method includes, for example, a method in which a surface layer of the electrophotographic photosensitive member is formed, and then the surface of the surface layer is subjected to a dry blast process or wet honing process, whereby dimple-shaped concaves are formed in the surface of the surface layer. Particularly, the dry blast process is preferable because it allows the surface to be roughened without causing a solvent such as water to contact the electrophotographic photosensitive member sensitive to temperature conditions.

Methods of the dry blast process include, for example, a method in which particles (polishing particles) are injected using compressed air and the particles are collided against the surface of the surface layer, and a method in which particles (polishing particles) are injected using a motor as a power and the particles are collided against the surface of the surface layer, but the method using compressed air is preferable in that the surface can be roughened under precise control and equipment is simplified.

Materials of particles (polishing particles) for use in the dry blast process include, for example, ceramics such as aluminum oxide, zirconia, silicon carbide and glass, metals such as stainless steel, iron and zinc and resins such as polyamide resins, polycarbonate resins, epoxy resins and polyester resins. Among them, ceramics are preferable in terms of surface roughening efficiency and costs, and particularly, aluminum oxide, zirconia and glass are more preferable.

An example of a dry blast process apparatus is shown in FIG. 1.

In FIG. 1, particles (polishing particles) stored in a container (not shown) are guided to an injection nozzle 101 through a path 104, injected from the injection nozzle 101 using compressed air introduced through the path 103, and collided against a cylindrical work piece (electrophotographic photosensitive member before the surface is roughened) 107 supported on a work piece support member 106 and rotating on its own axis. Reference numeral 105 denotes ejected particles (polishing particles).

At this time, the distance between the injection nozzle 101 and the work piece 107 is adjusted by nozzle fixing jigs 102, 109 and an arm and determined. An injection nozzle support member 108 supporting the injection nozzle 101 travels along the rotation axis of the work piece 107, whereby the injection nozzle 101 performs a process of roughening the peripheral surface of the work piece 107 while traveling along the rotation axis of the work piece 107.

At this time, the shortest distance between the injection nozzle 101 and the peripheral surface of the work piece 107 should be adjusted to be an appropriate distance. If the distance is too short or too long, process efficiency may drop or it may be impossible to roughen the surface in a desired manner. The pressure of compressed air for use in injection of particles (polishing particles) should be adjusted to be an appropriate pressure.

If the surface of the surface layer of the electrophotographic photosensitive member is subjected to the dry blast process, whereby the peripheral surface of the electrophotographic photosensitive member are made to have a plurality of dimple-shaped concaves, the value of universal hardness (HU) of the surface of the surface layer of the electrophotographic photosensitive member before being subjected to the dry blast process is preferably in the range of 150 to 220 $N/mm^2$, more preferably 160 to 200 $N/mm^2$. The elastic deformation rate of the surface of the surface layer of the electrophotographic photosensitive member before being subjected to the dry blast process is preferably 40% or greater, more preferably 45% or greater, further more preferably 50% or greater, while it is preferably 65% or less.

If the surface of a cylindrical support (hereinafter also referred to simply as "support") or the surface of a layer between the support and the surface layer is subjected to a surface roughening process such as a dry blast process, the electrophotographic photosensitive member of the present invention having a plurality of dimple-shaped concaves in the peripheral surface cannot be obtained. That is, if the peripheral surface of the electrophotographic photosensitive member is made to have a plurality of dimple-shaped concaves by a surface roughening process such as a dry blast process, the surface of the surface layer is preferably subjected to the surface roughness process described above.

As described above, the electrophotographic photosensitive member of the present invention has a plurality of dimple-shaped concaves formed in its peripheral surface, whereby Rzjis (A) and Rzjis (B) of the peripheral surface are each in the range of 0.3 to 2.5 μm as specified above, RSm (C) and RSm (D) are each in the range of 5 to 120 μm as specified above, and the value (D/C) of the ratio of RSm (D) to RSm (C) is in the range of 0.5 to 1.5 as specified above, but Rzjis (A) and Rzjis (B) are each preferably in the range of 0.4 to 2.0 μm, RSm (C) and RSm (D) are each preferably in the range of 10 to 100 μm, and the value (D/C) of the ratio of RSm (D) to RSm (C) is preferably in the range of 0.8 to 1.2.

If Rzjis (A) and Rzjis (B) are too small, the effect of the present invention becomes poor, and if they are too large, coarseness due to roughness of the peripheral surface of the electrophotographic photosensitive member appears in the output image, or escape of the toner from the cleaning blade becomes so great that cleaning characteristics are compromised.

If RSm (C) and RSm (D) are too small, the effect of the present invention becomes poor, and if they are too large, escape of the toner from the cleaning blade becomes so great that cleaning characteristics are compromised.

The value (D/C) of the ratio of RSm (D) to RSm (C) being in the range specified above means that dimple-shaped concaves do not range in a striped form along the circumference or generating line of the electrophotographic photosensitive member.

In the present invention, the height of the raised portion of the peripheral surface of the electrophotographic photosensitive member is preferably smaller than the depth of the concave. If the height of the raised portion is too large, cleaning failure occurs, or local friction resistance to the cleaning blade increases, and the edge portion of the cleaning blade may be impaired especially if it is repeatedly used over a long time period. Specifically, a maximum peak height Rp (F) of the peripheral surface of the electrophotographic photosensitive member is preferably 0.6 μm or less, more preferably 0.4 μm or less. Provided that a maximum valley depth of the peripheral surface of the electrophotographic photosensitive member is Rv (E), the value (E/F) of the ratio of Rv (E) to Rp (F) is preferably 1.2 or greater, more preferably 1.5 or greater.

In the present invention, measurements of Rzjis (A) and Rzjis (B), RSm (C) and RSm (D), and Rv (E) and Rp (F) were all made using a surface roughness measuring device: Surf Coder SE3500 Model manufactured by Kosaka Institute Co., Ltd., on the basis of JIS-B0601-2001.

The present invention acts most effectively when it is applied to an electrophotographic photosensitive member of which the peripheral surface is hard to be worn. This is because as described above, the electrophotographic photosensitive member of which the peripheral surface is hard to be worn is highly durable, while the problem of chatter and wear-out of the cleaning blade and the problem of the rubbing memory are significant. Specifically, the value of universal hardness (HU) of the peripheral surface of the electrophotographic photosensitive member is preferably 150 $N/mm^2$ or greater, more preferably 160 $N/mm^2$ or greater.

The electrophotographic photosensitive member in which the peripheral surface is hard to be worn and scratches are hard to occur suffers less change in shape of the peripheral surface described above from initial use to the end of repeated use, and can therefore maintain initial cleaning characteristics even if it is repeatedly used over a long time period.

The value of universal hardness (HU) of the peripheral surface of the electrophotographic photosensitive member is preferably 220 N/mm$^2$ or less, more preferably 200 N/mm$^2$ or less in that the peripheral surface of the electrophotographic photosensitive member is hard to be worn and scratches are hard to occur. The elastic deformation rate of the peripheral surface of the electrophotographic photosensitive member is preferably 40% or greater, more preferably 45% or greater, further more preferably 50% or greater, while the elastic deformation rate of the peripheral surface of the electrophotographic photosensitive member is preferably 65% or less.

If the value of universal hardness (HU) is too large, and if the elastic deformation rate is too small, the surface of the electrophotographic photosensitive member is lacking in elastic force, and therefore when a paper powder or toner sandwiched between the peripheral surface of the electrophotographic photosensitive member and the cleaning blade scrapes the peripheral surface of the electrophotographic photosensitive member, the surface of the electrophotographic photosensitive member tends to be scratched and accordingly tends to be worn. If the value of universal hardness (HU) is too large, the elastic deformation amount decreases even if the elastic deformation rate is high, and as a result a high pressure is applied to local areas of the surface of the electrophotographic photosensitive member, and therefore the surface of the electrophotographic photosensitive member tends to be deeply scratched.

If the elastic deformation rate is too small even though the value of universal hardness (HU) is in the range described above, the plastic deformation amount relatively increases, and therefore the surface of the electrophotographic photosensitive member tends to be finely scratched and tends to be worn. This is especially noticeable if not only the elastic deformation rate but also the value of universal hardness (HU) is too small.

In the present invention, the value of universal hardness (HU) and the elastic deformation rate of the peripheral surface of the electrophotographic photosensitive member are values measured by using a microhardness measuring apparatus: Fischer Scope H100V (manufactured by Fischer Co., Ltd.) under the circumstance of 25° C./50% RH. The Fischer Scope H100V allows a continuous hardness to be determined by abutting an indenter against a measurement object (peripheral surface of electrophotographic photosensitive member), continuously imposing loads on the indenter and directly reading a depth of indentation under a load.

In the present invention, a Vickers rectangular pyramid diamond indenter having an opposite face angle of 136° was used as an indenter, the indenter was pressed against the peripheral surface of the electrophotographic photosensitive member, the last of loads continuously imposed on the indenter (last load) was 6 mN, and time over which the last load of 6 mN was imposed on the indenter (holding time) was 0.1 second. The number of measurement points was 273.

Figure 2:
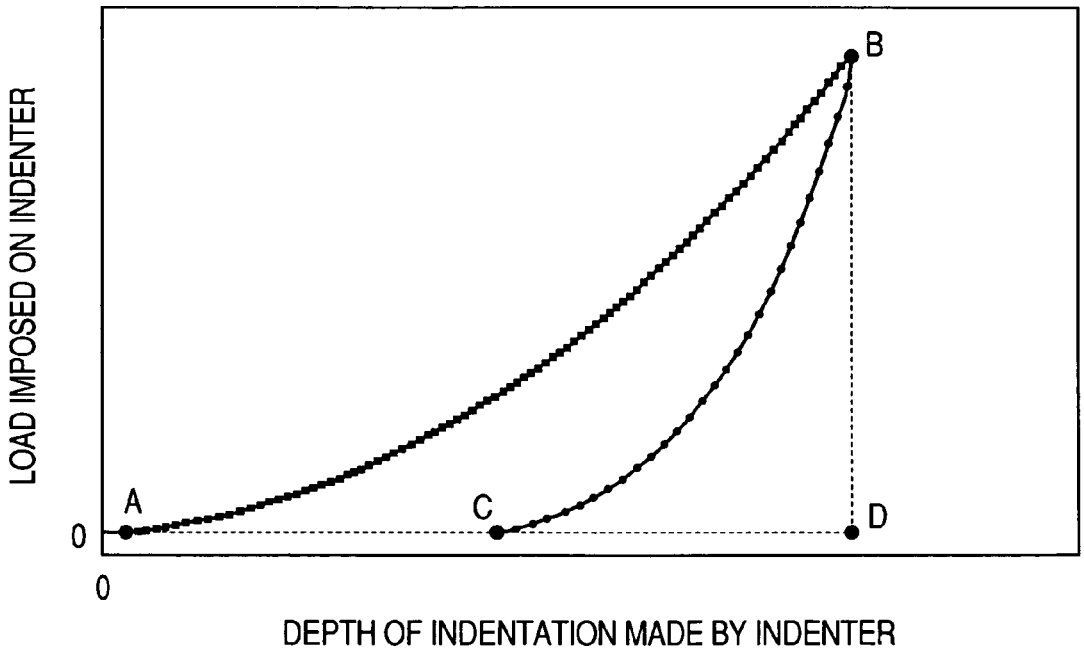
FIG. 2 shows the outline of an output chart of Fischer Scope H100V (manufactured by Fischer Co., Ltd.)
Figure 3:
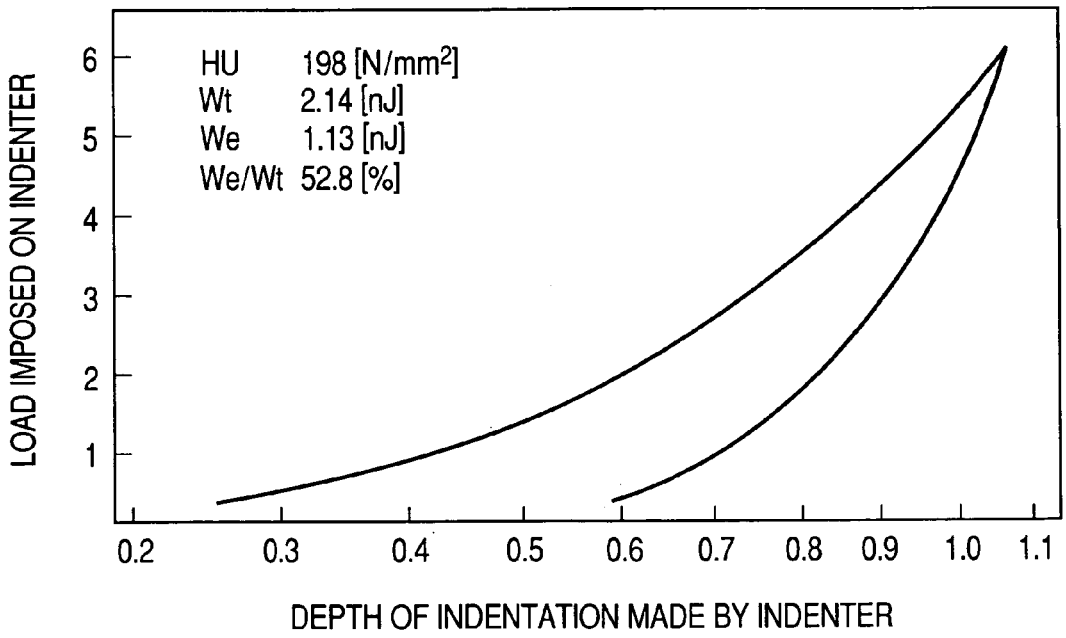
FIG. 3 shows one example of the output chart of Fischer Scope H100V (manufactured by Fischer Co., Ltd.)

The outline of an output chart of Fischer Scope H100V (manufactured by Fischer Co., Ltd.) is shown in FIG. 2. One example of the output chart of Fischer Scope H100V (manufactured by Fischer Co., Ltd.) when the electrophotographic photosensitive member of the present invention is a measurement object is shown in FIG. 3. In FIGS. 2 and 3, the axis of ordinates represents loads F (mN) imposed on the indenter, and the axis of abscissas represents indentation depths h (μm) of the indenter. FIG. 2 shows results where the load imposed on the indenter is increased in stages to the maximum load (A→B), and then the load is decreased in stages (B→C). FIG. 3 shows results where the load imposed on the indenter is increased in stages to the last load of 6 mN, and then the load is decreased in stages.

The value of universal hardness (HU) can be determined from the following equation using the indentation depth of the indenter when the last load of 6 mN is imposed on the indenter. In the following equation, HU represents a universal hardness (HU), $F_f$ represents a last load, $S_f$ represents the surface area of a portion of the indenter pushed down when the last load is imposed, and $h_f$ represents a pushdown depth of the indenter when the last load is imposed.

$$HU = \frac{F_f[\mathrm{N}]}{S_f[\mathrm{mm}^2]} = \frac{6\times10^{-3}}{26.43\times(h_f\times10^{-3})^2}$$

The elastic deformation rate can be determined from a change in energy resulting from an increase/decrease in work load (energy) imposed by the indenter on the measurement object (peripheral surface of electrophotographic photosensitive member), i.e. load of the indenter on the measurement object (peripheral surface of electrophotographic photosensitive member). Specifically, a value (We/Wt) obtained by dividing an elastic deformation work load We by a total work load Wt is the elastic deformation rate. The total work load Wt equals the area of a region surrounded by the line A-B-D-A in FIG. 2, and the elastic deformation work load We equals the area of a region surrounded by the line C-B-D-C.

For improving the scratch resistance and the wear resistance of the peripheral surface of the electrophotographic photosensitive member, it is preferable that a cured layer is used as the surface layer of the electrophotographic photosensitive member and, for example, the surface layer of the electrophotographic photosensitive member is formed by using a (monomer of) curable resin, or formed by using a positive hole transporting compound having a polymerizable functional group (chain polymerizable functional group, sequential polymerizable functional group, etc.) (polymerizable functional group chemically bound to part of molecule of positive hole transporting compound). If a curable resin having no charge transportability is used, a charge transport material may be mixed therein.

Particularly, for obtaining an electrophotographic photosensitive member of which the value of universal hardness (HU) and the elastic deformation rate of the peripheral surface are in the range described above, it is effective to form the surface layer of the electrophotographic photosensitive member by cure-polymerization (polymerization with crosslink) of a positive hole transporting compound having a chain polymerizable functional group, especially by cure-polymerization of a positive hole transporting compound having two or more chain polymerizable functional groups in the same molecule. If a positive hole transporting compound having a sequential polymerizable functional group is used, the compound is preferably a positive hole transporting compound having three or more sequential polymerizable functional groups in the same molecule.

A method of forming the surface layer of the electrophotographic photosensitive member using a positive hole transporting compound having chain polymerizable functional groups will be described more specifically below. The surface layer of the electrophotographic photosensitive member is formed in the same manner when a positive hole transporting compound having sequential polymerizable functional groups is used.

The surface layer of the electrophotographic photosensitive member can be formed by coating a coating solution for a surface layer, containing a positive hole transporting compound having chain polymerizable functional groups and a solvent, and curing polymerizing the positive hole transporting compound having chain polymerizable functional groups, thereby curing the coated coating solution for a surface layer.

When the coating solution for a surface layer is coated, a coating method such as, for example, a dip coating method, spray coating method, curtain coating method or spin coating method can be used. Among these coasting processes, the dip coating method and the spray coating method are preferable in terms of efficiency and productivity.

Methods of curing polymerization of the positive hole transporting compound having chain polymerizable functional groups include methods using heat, light such as visible light and ultraviolet light, and radiation rays such as electron beams and γ rays. A polymerization initiator may be incorporated in the coating solution for a surface layer as required.

For the method of curing polymerization of the positive hole transporting compound having chain polymerizable functional groups, methods using radiation rays such as electron beams and γ rays are preferable, and especially preferable are methods using electron beams. This is because polymerization by radiation rays does not particularly require a polymerization initiator. By curing polymerization of the positive hole transporting compound having chain polymerizable functional groups without using a polymerization initiator, a three-dimensional matrix surface layer with very high purity can be formed, thus making it possible to obtain an electrophotographic photosensitive member showing good electrophotographic characteristics. Polymerization by electron beams among radiation rays causes vary little damage to the electrophotographic photosensitive member by irradiation, and can achieve good electrophotographic photosensitive characteristics.

For curing polymerization of the positive hole transporting compound having chain polymerizable functional groups by irradiation with electron beams to obtain an electrophotographic photosensitive member of the present invention of which the value of the universal hardness (HU) and the elastic deformation rate are in the range described above, it is important to consider conditions for irradiation with electron means.

When an electron beam is applied, a scanning type, electro curtain type, broad beam type, pulse type or laminar type accelerator can be used. The accelerating voltage is preferably 250 kV or less, more preferably 150 kV or less. The radiation dose is preferably in the range of 1 to 1000 kGy (0.1 to 100 Mrad), more preferably 5 to 200 kGy (0.5 to 20 Mrad). If the accelerating voltage and the radiation dose are too high, electrical characteristics of the electrophotographic photosensitive member may be degraded. If the radiation dose is too low, the positive hole transporting compound having chain polymerizable functional groups is cure-polymerized insufficiently, and accordingly the coating solution for a surface layer may be insufficiently cured.

For promoting curing of the coating solution for a surface layer, it is preferable that an irradiation subject (object irradiated with electron beams) is heated when the positive hole transporting compound having chain polymerizable functional groups are cure-polymerized by electron beams. Heating may be carried out at any stage, i.e. before, during or after irradiation with the electron beam, but it is preferable that the irradiation subject is kept at a fixed temperature while radicals of the positive hole transporting compound having chain polymerizable functional groups exist. It is preferable that heating is carried out so that the temperature of the irradiation subject is room temperature to 250° C. (more preferably 50 to 150° C.). If the heating temperature is too high, the material of the electrophotographic photosensitive member may be degraded. If the heating temperature is too low, the effect obtained by heating becomes poor. The heating time is preferably approximately several seconds to several tens of minutes, specifically 2 seconds to 30 minutes.

The atmosphere in which the electron beam is applied and the irradiation subject is heated may be in air, an inert gas such as nitrogen or helium, or vacuum, but is preferably in the inert gas or vacuum in that inactivation of radials by oxygen can be inhibited.

The thickness of the surface layer of the electrophotographic photosensitive member is preferably 30 μm or less, more preferably 20 μm or less, further more preferably 10 μm, still further more preferably 7 μm in terms of electrophotographic characteristics. The thickness is preferably 0.5 μm or greater, more preferably 1 μm or greater in terms of durability of the electrophotographic photosensitive member.

Chain polymerization refers to a polymerization reaction form of chain polymerization when reactions for production of polymers are classified broadly into chain polymerization and sequential polymerization, and specifically refers to unsaturated polymerization, ring opening polymerization or isomerization polymerization of which the reaction progresses by way of an intermediate such as radicals or ions in its reaction form.

The chain polymerizable functional group means a functional group allowing the reaction form described above. Examples of unsaturated polymerizable functional groups and ring opening polymerizable functional groups having a wide range of applications will be shown below.

Unsaturated polymerization is a reaction in which unsaturated groups, e.g. C═C, C≡C, C═O, C═N and C≡N are polymerized by radicals and ions and among them, C═C is main. Specific examples of unsaturated polymerizable functional groups will be described below.

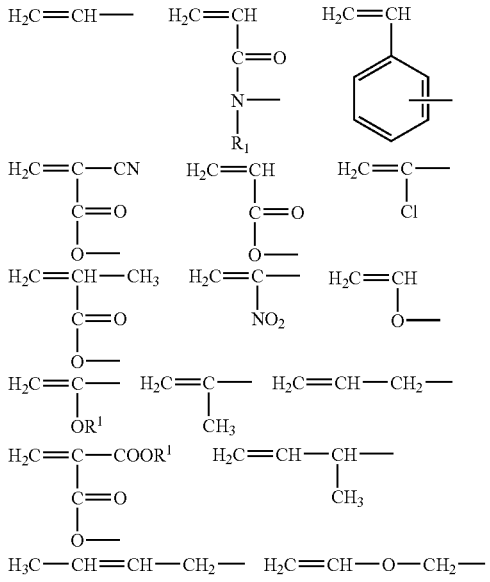

In the above formula, $R^1$ represents a hydrogen atom, substituted or unsubstituted alkyl group, substituted or unsubstituted aryl group, substituted or unsubstituted aralkyl group, or the like. Alkyl groups include a methyl group, an ethyl group and a propyl group. Aryl groups include a phenyl group, a naphthyl group and an anthryl group. Aralkyl groups include a benzyl group and a phenethyl group.

Ring opening polymerization is a reaction in which an unstable a ring structure, such as a carbon ring, oxo ring or nitrogen heterocyclic ring, having a strain opens its ring and simultaneously repeats polymerization to produce a chain polymer, and mostly ions act as an active species. Specific examples of ring opening polymerizable functional groups will be shown below.

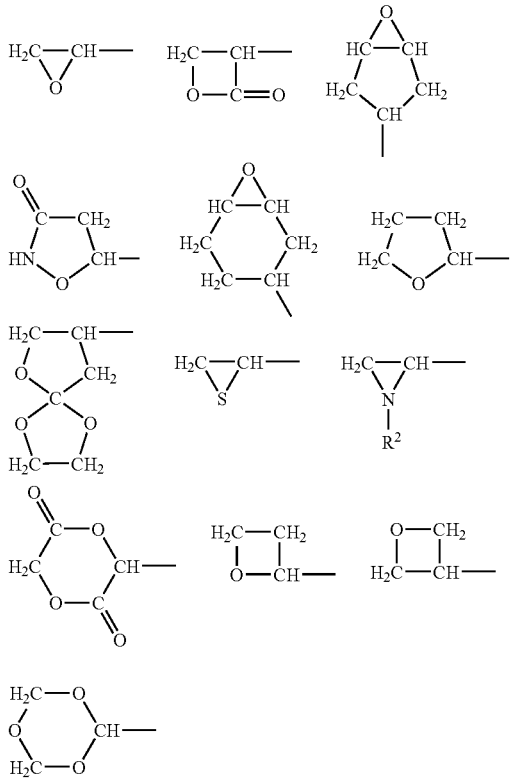

In the above formula, $R^2$ represents a hydrogen atom, substituted or unsubstituted alkyl group, substituted or unsubstituted aryl group, substituted or unsubstituted aralkyl group, or the like. Alkyl groups include a methyl group, an ethyl group and a propyl group. Aryl groups include a phenyl group, a naphthyl group and an anthryl group. Aralkyl groups include a benzyl group and a phenethyl group.

Among the chain polymerizable functional groups illustrated above, chain polymerizable functional groups having structures expressed by the formulae (1) to (3) shown below are preferable.

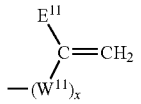

(1)

In the formula (1), $E^{11}$ represents a hydrogen atom, halogen atom, substituted or unsubstituted alkyl group, substituted or unsubstituted aryl group, substituted or unsubstituted aralkyl group, substituted or unsubstituted alkoxy group, cyano group, nitro group, —$COOR^{11}$ or —$CONR^{12}R^{13}$. $W^{11}$ represents a substituted or unsubstituted alkylene group, substituted or unsubstituted arylene group, —COO—, —O—, —OO—, —S— or $CONR^{14}$—. $R^{11}$ to $R^{14}$ each independently represent a hydrogen atom, halogen atom, substituted or unsubstituted alkyl group, substituted or unsubstituted aryl group, or substituted or unsubstituted aralkyl group. The subscript X represents 0 or 1. Halogen atoms include a fluorine atom, a chlorine atom and a bromine atom. Alkyl groups include a methyl group, an ethyl group, a propyl group and a butyl group. Aryl groups include a phenyl group, a naphthyl group, an anthryl group, a pyrenyl group, a thiophenyl group and a furyl group. Aralkyl groups include a benzyl group, a phenethyl group, a naphthylmethyl group, a furfuryl group and a thienyl group. Alkoxy groups include a methoxy group, an ethoxy group and a propoxy group. Alkylene groups include a methylene group, an ethylene group and a butylenes group. Arylene groups include a phenylene group, a naphthylene group and an anthracenylene group.

Substituent groups which may be possessed by the above groups include halogen atoms such as a fluorine atom, a chlorine atom, a bromine atom and an iodine atom, alkyl groups such as a methyl group, an ethyl group, a propyl group and a butyl group, aryl groups such as a phenyl group, a naphthyl group, an anthryl group and a pyrenyl group, aralkyl groups such as a benzyl group, a phenethyl group, a naphthylmethyl group, a furfuryl group and a thienyl group, alkoxy groups such as a methoxy group, an ethoxy group and a propoxy group, aryloxy groups such as a phenoxy group and a naphthoxy group, a nitro group, a cyano group and a hydroxyl group.

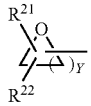

(2)

In the formula (2), $R^{21}$ and $R^{22}$ each independently represent a hydrogen atom, substituted or unsubstituted alkyl group, substituted or unsubstituted aryl group, or substituted or unsubstituted aralkyl group. The subscript Y represents an integer of 1 to 10. Alkyl groups include a methyl group, an ethyl group, a propyl group and a butyl group. Aryl groups include a phenyl group and a naphthyl group. Aralkyl groups include a benzyl group and phenethyl group.

Substituent groups which may be possessed by the above groups include halogen atoms such as a fluorine atom, a chlorine atom, a bromine atom and an iodine atom, alkyl groups such as a methyl group, an ethyl group, a propyl group and a butyl group, aryl groups such as a phenyl group, a naphthyl group, an anthryl group and a pyrenyl group, aralkyl groups such as a benzyl group, a phenethyl group, a naphthylmethyl group, a furfuryl group and a thienyl group, alkoxy groups such as a methoxy group, an ethoxy group and a propoxy group, and aryloxy groups such as a phenoxy group and a naphthoxy group.

(3)

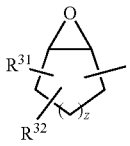

In the above formula (3), $R^{31}$ and $R^{32}$ each independently represent a hydrogen atom, substituted or unsubstituted alkyl group, substituted or unsubstituted aryl group, or substituted or unsubstituted aralkyl group. The subscript Z represents an integer of 0 to 10. Alkyl groups include a methyl group, an ethyl group, a propyl group and a butyl group. Aryl groups include a phenyl group and a naphthyl group. Aralkyl groups include a benzyl group and phenethyl group.

Substituent groups which may be possessed by the above groups include halogen atoms such as a fluorine atom, a chlorine atom, a bromine atom and an iodine atom, alkyl groups such as a methyl group, an ethyl group, a propyl group and a butyl group, aryl groups such as a phenyl group, a naphthyl group, an anthryl group and a pyrenyl group, aralkyl groups such as a benzyl group, a phenethyl group, a naphthylmethyl group, a furfuryl group and a thienyl group, alkoxy groups such as a methoxy group, an ethoxy group and a propoxy group, and aryloxy groups such as a phenoxy group and a naphthoxy group.

Among chain polymerizable functional groups having the structures expressed by the above formulae (1) to (3), chain polymerizable functional groups having structures expressed by the following formulae (P-1) to (P-11) are more preferable.

(P-1)

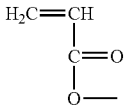

(P-2)

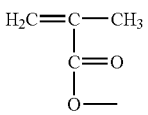

(P-3)

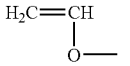

(P-4)

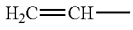

(P-5)

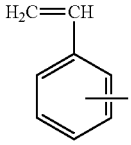

(P-6)

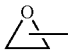

(P-7)

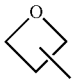

(P-8)

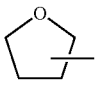

-continued (P-9)

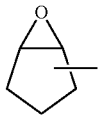

(P-10)

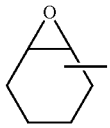

(P-11)

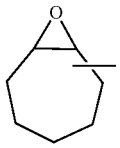

Among chain polymerizable functional groups having the structures expressed by the above formulae (P-1) to (P-11), the chain polymerizable functional group having the structure expressed by the above formula (P-1), i.e. an acryloyloxy group, and the chain polymerizable functional group having the structure expressed by the above formula (P-2), i.e. a methacryloyloxy group are further preferable.

In the present invention, among positive hole transporting compounds having the above chain polymerizable functional groups, positive hole transporting compounds having two or more chain polymerizable functional groups (in the same molecule) are preferable. Examples of positive hole transporting compounds having two or more chain polymerizable functional groups will be shown below.

$$(P^{41})_a\text{-}A^{41}\text{-}[R^{41}\text{—}(P^{42})_d]_b \quad (4)$$

In the above formula (4), $P^{41}$ and $P^{42}$ each independently represent a chain polymerizable functional group. $R^{41}$ represents a bivalent group. $A^{41}$ represents a positive hole transporting group. Subscripts a, b and d each independently represent an integer of 0 or greater. However, a+b×d is 2 or greater. If a is 2 or greater, the $P^{41}$'s in number of a may be same or different, and if b is 2 or greater, the $[R^{41}\text{—}(P^{42})_d]$'S in number of b may be same or different, and if d is 2 or greater, the $P^{42}$'s in number of d may be same or different.

Compounds with all $(P^{41})_a$ and $[R^{41}\text{—}(P^{42})_d]_b$ in the above formula (4) substituted by hydrogen atoms include, for example, oxazole derivatives, oxadiazole derivatives, imidazole derivatives, triarylamine derivatives (triphenylamine, etc.), 9-(p-diethylaminostyryl)anthracene, 1,1-bis-(4-dibenzylaminophenyl)propane, styrylanthracene, styrylpyrazoline, phenylhydrazones, thiazole derivatives, triazole derivatives, phenazine derivatives, acridine derivatives, benzofuran derivatives, benzimidazole derivatives, thiophene derivatives and N-phenylcarbazole derivatives. Among these compounds (compounds with all $(P^{41})_a$ and $[R^{41}\text{—}(P^{42})_d]_b$ in the above formula (4) substituted by hydrogen atoms), those having structures expressed by the following formula (5) are preferable.

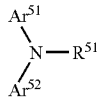

(5)

In the above formula (5), $R^{51}$ represents a substituted or unsubstituted alkyl group, substituted or unsubstituted aryl group, or substituted or unsubstituted aralkyl group. $Ar^{51}$ and $Ar^{52}$ each independently represent a substituted or unsubstituted aryl group. $R^{51}$, $Ar^{51}$ and $Ar^{52}$ may be directly bound to N (nitrogen atom), or may be bound to N (nitrogen atom) via an alkylene group (methyl group, ethyl group, propylene group, etc.), a hetero atom (oxygen atom, sulfur atom, etc.) or —CH═CH—. Alkyl groups are preferably those having 1 to 10 carbon atoms, and include a methyl group, an ethyl group, a propyl group and a butyl group. Aryl groups include a phenyl group, a naphthyl group, an anthryl group, a phenanthryl group, a pyrenyl group, thiophenyl group, a furyl group, a pyridyl group, a quinolyl group, a benzoquinolyl group, a carbazolyl group, a phenothiazinyl group, a benzofuryl group, a benzothiophenyl group, dibenzofuryl group and a dibenzothiophenyl group. Aralkyl groups include a benzyl group, a phenethyl group, a naphthylmethyl group, a furfuryl group and a thienyl group. $R^{51}$ in the above formula (5) is preferably a substituted or unsubstituted aryl group.

Substituent groups which may be possessed by the above groups include halogen atoms such as a fluorine atom, a chlorine atom, a bromine atom and an iodine atom, alkyl groups such as a methyl group, an ethyl group, a propyl group and a butyl group, aryl groups such as a phenyl group, a naphthyl group, an anthryl group and a pyrenyl group, aralkyl groups such as a benzyl group, a phenethyl group, a naphthylmethyl group, a furfuryl group and a thienyl group, alkoxy groups such as a methoxy group, an ethoxy group and a propoxy group, aryloxy groups such as a phenoxy group and a naphthoxy group, substituted amino groups such as a dimethylamino group, a diethylamino group, a dibenzylamino group, a diphenylamino group and a di(p-tolyl)amino group, arylvinyl groups such as a styryl group and a naphthylvinyl group, a nitro group, a cyano group and hydroxyl group.

Bivalent groups expressed by $R^{41}$ in the above formula (4) include substituted or unsubstituted alkylene groups, substituted or unsubstituted arylene groups, $—CR^{411}═CR^{412}—$ ($R^{411}$ and $R^{412}$ each independently represent a hydrogen atom, substituted or unsubstituted alkyl group, or substituted or unsubstituted aryl group), —CO—, —SO—, $—SO_2—$, an oxygen atom, a sulfur atom and combinations thereof. Among them, bivalent groups having structures expressed by the following formula (6) are preferable, and bivalent groups having structures expressed by the following formula (7) are more preferable.

$$—(X^{61})_{p6}—(Ar^{61})_{q6}—(X^{62})_{r6}—(Ar^{62})_{s6}—(X^{63})_{t6}— \quad (6)$$

$$—(X^{71})_{p7}—(Ar^{71})_{q7}—(X^{72})_{r7}— \quad (7)$$

In the above formula (6), $X^{61}$ to $X^{63}$ each independently represent a substituted or unsubstituted alkylene group, $—(CR^{61}═CR^{62})_{n6}—$ (wherein $R^{61}$ and $R^{62}$ each independently represent a hydrogen atom, substituted or unsubstituted alkyl group, or substituted or unsubstituted aryl group, and the subscript n6 represents an integer of 1 or greater (preferably 5 or smaller)), —CO—, —SO—, $—SO_2—$, oxygen atom or sulfur atom. $Ar^{61}$ and $Ar^{62}$ each independently represent a substituted or unsubstituted arylene group. Subscripts p6, q6, r6, s6 and t6 each independently represent an integer of 0 or greater (preferably 10 or smaller, more preferably 5 or smaller), provided that all the subscripts p6, q6, r6, s6 and t6 are not 0 at the same time. Alkylene groups are preferably those having 1 to 20 carbon atoms, especially preferably those having 1 to 10 carbon atoms, and include a methylene group, an ethylene group and a propylene group. Arylene groups include bivalent groups obtained by removing two hydrogen atoms from benzene, naphthalene, anthracene, phenanthrene, pyrene, benzothiophene, pyridine, quinoline, benzoquinoline, carbazole, phenothiazine, benzofuran, benzothiophene, dibenzofuran, dibenzothiophene and the like. Alkyl groups include a methyl group, an ethyl group and a propyl group. Aryl groups include a phenyl group, a naphthyl group and a thiophenyl group.

Substituent groups which may be possessed by the above groups include halogen atoms such as a fluorine atom, a chlorine atom, a bromine atom and an iodine atom, alkyl groups such as a methyl group, an ethyl group, a propyl group and a butyl group, aryl groups such as a phenyl group, a naphthyl group, an anthryl group and a pyrenyl group, aralkyl groups such as a benzyl group, a phenethyl group, a naphthylmethyl group, a furfuryl group and a thienyl group, alkoxy groups such as a methoxy group, an ethoxy group and a propoxy group, aryloxy groups such as a phenoxy group and a naphthoxy group, substituted amino groups such as a dimethylamino group, a diethylamino group, a dibenzylamino group, a diphenylamino group and a di(p-tolyl)amino group, arylvinyl groups such as a styryl group and a naphthylvinyl group, a nitro group, a cyano group and hydroxyl group.

In the above formula (7), $X^{71}$ and $X^{72}$ each independently represent a substituted or unsubstituted alkylene group, $—(CR^{71}═CR^{72})_{n7}—$ (wherein $R^{71}$ and $R^{72}$ each independently represent a hydrogen atom, substituted or unsubstituted alkyl group, or substituted or unsubstituted aryl group, and the subscript n7 represents an integer of 1 or greater (preferably 5 or smaller)), —CO— or oxygen atom. $Ar^{71}$ represents a substituted or unsubstituted arylene group. Subscripts p7, q7 and r7 each independently represent an integer of 0 or greater (preferably 10 or smaller, more preferably 5 or smaller), provided that all the subscripts p7, q7 and r7 are not 0 at the same time. Alkylene groups are preferably those having 1 to 20 carbon atoms, especially preferably those having 1 to 10 carbon atoms, and include a methylene group, an ethylene group and a propylene group. Arylene groups include bivalent groups obtained by removing two hydrogen atoms from benzene, naphthalene, anthracene, phenanthrene, pyrene, benzothiophene, pyridine, quinoline, benzoquinoline, carbazole, phenothiazine, benzofuran, benzothiophene, dibenzofuran, dibenzothiophene and the like. Alkyl groups include a methyl group, an ethyl group and a propyl group. Aryl groups include a phenyl group, a naphthyl group and a thiophenyl group.

Substituent groups which may be possessed by the above groups include halogen atoms such as a fluorine atom, a chlorine atom, a bromine atom and an iodine atom, alkyl groups such as a methyl group, an ethyl group, a propyl group and a butyl group, aryl groups such as a phenyl group, a naphthyl group, an anthryl group and a pyrenyl group, aralkyl groups such as a benzyl group, a phenethyl group, a naphthylmethyl group, a furfuryl group and a thienyl group, alkoxy groups such as a methoxy group, an ethoxy group and a propoxy group, aryloxy groups such as a phenoxy group and a naphthoxy group, substituted amino groups such as a dimethylamino group, a diethylamino group, a dibenzylamino group, a diphenylamino group and a di(p-tolyl)amino group, arylvinyl groups such as a styryl group and a naphthylvinyl group, a nitro group, a cyano group and hydroxyl group.

Suitable examples of positive hole transporting compounds having two or more chain polymerizable functional groups, (examples of compounds) will be listed below.

| No. | Examples of compound |
|---|---|
| 1 | 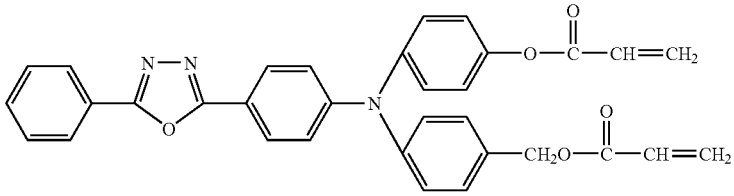 |
| 2 | 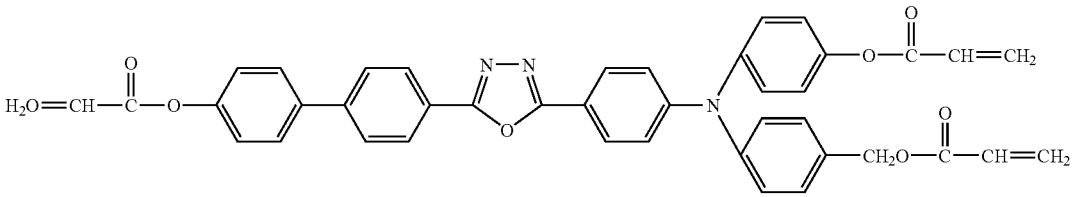 |
| 3 | 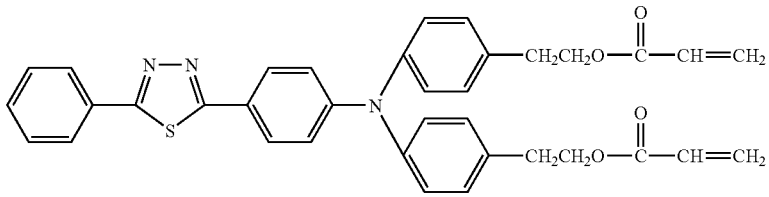 |
| 4 | 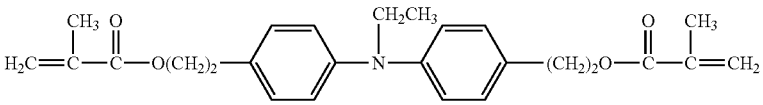 |
| 5 | 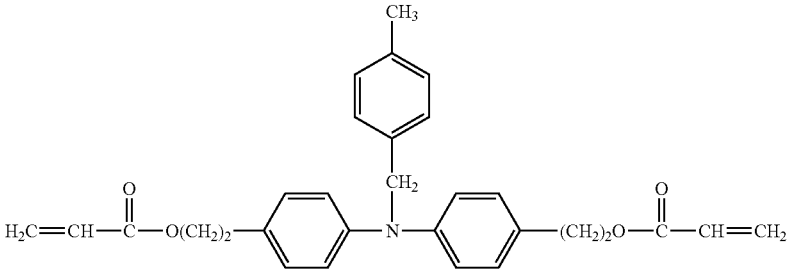 |
| 6 | 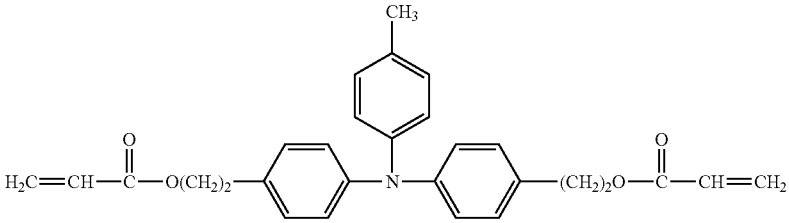 |
| 7 | 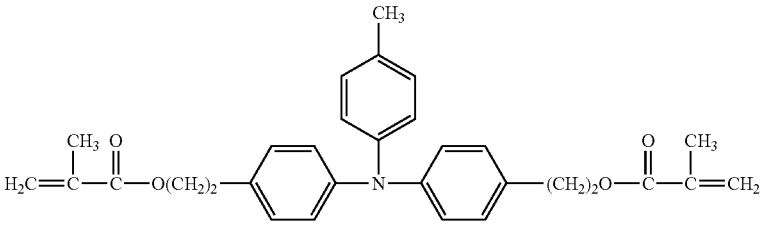 |

-continued
| No. | Examples of compound |
|---|---|
| 8 | 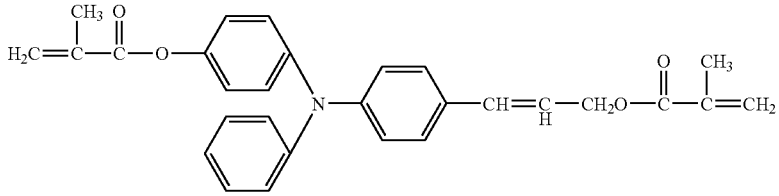 |
| 9 | 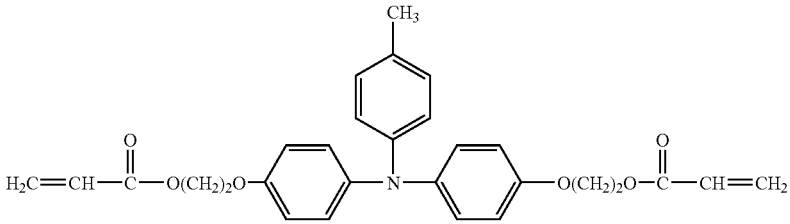 |
| 10 | 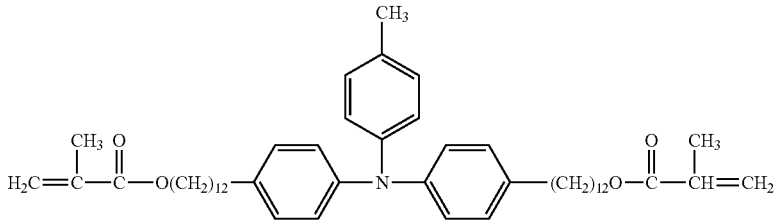 |
| 11 | 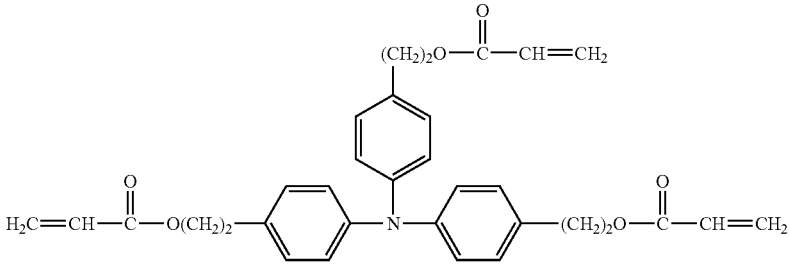 |
| 12 | 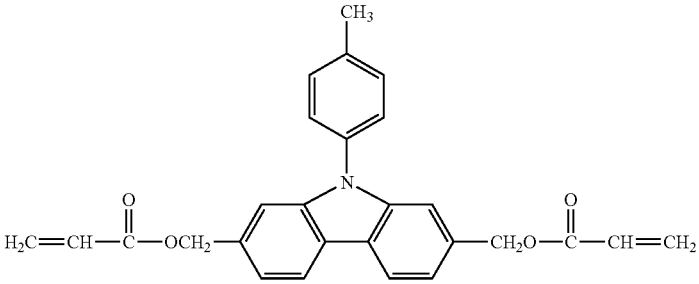 |
| 13 | 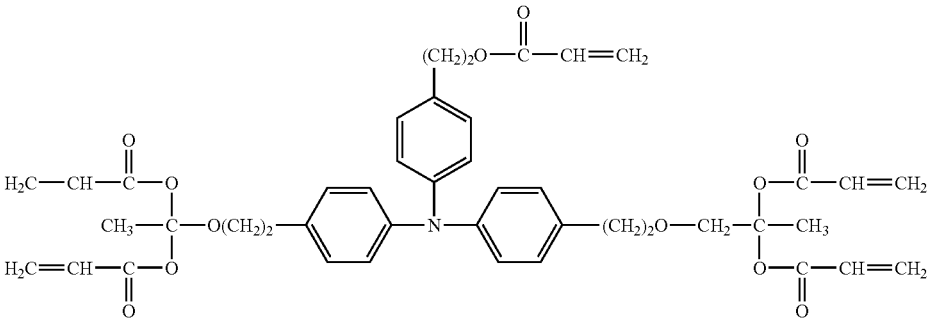 |

-continued
| No. | Examples of compound |
|---|---|
| 14 | 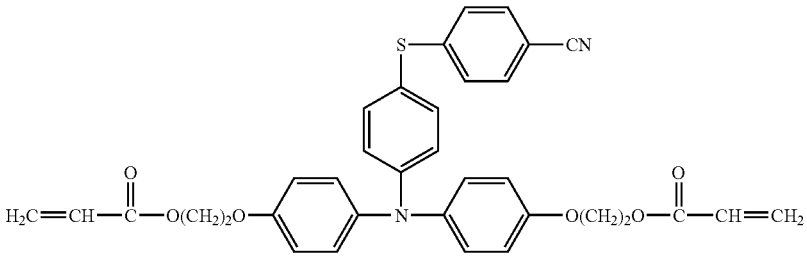 |
| 15 | 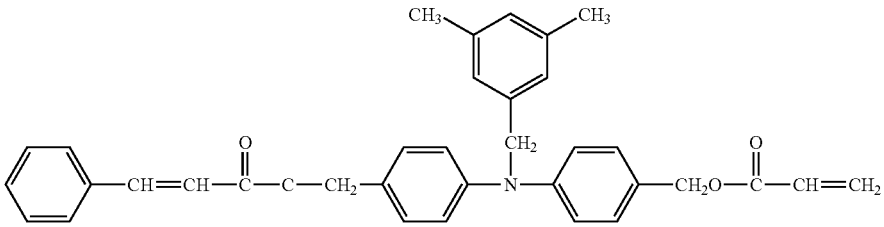 |
| 16 | 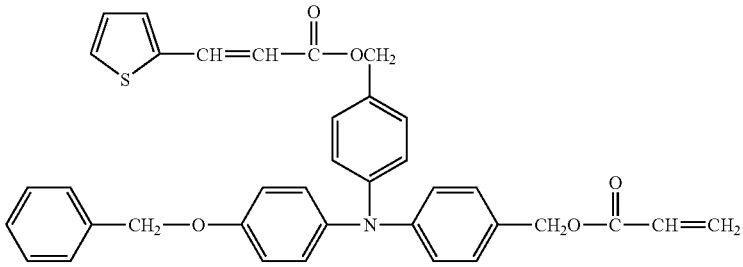 |
| 17 | 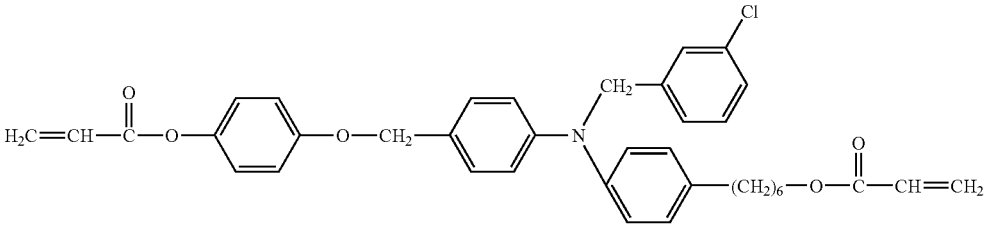 |
| 18 | 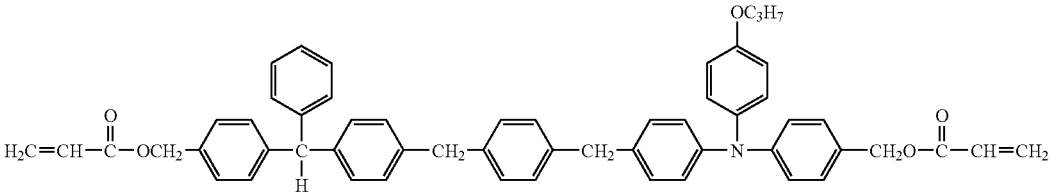 |
| 19 | 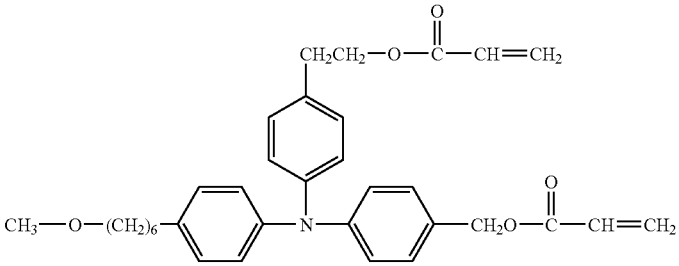 |

-continued
| No. | Examples of compound |
|---|---|
| 20 | 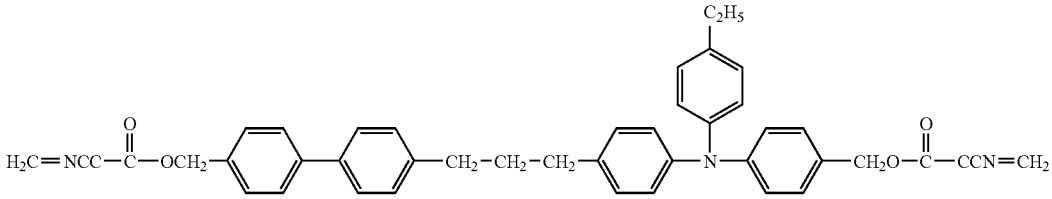 |
| 21 | 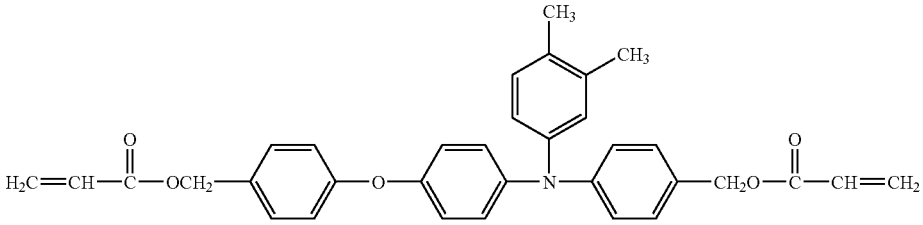 |
| 22 | 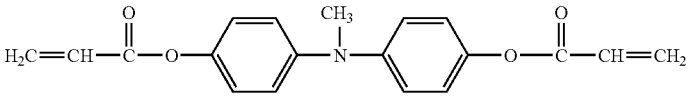 |
| 23 | 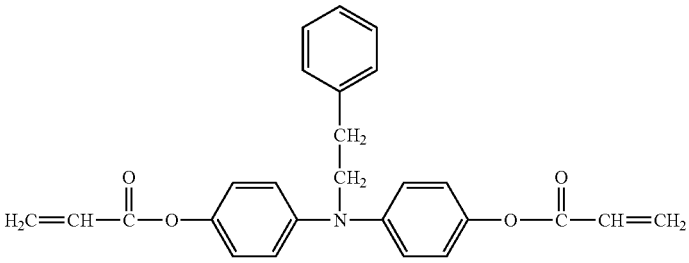 |
| 24 | 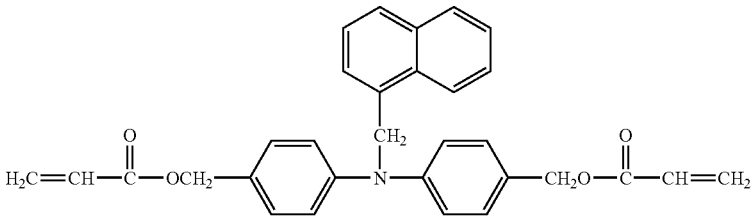 |
| 25 | 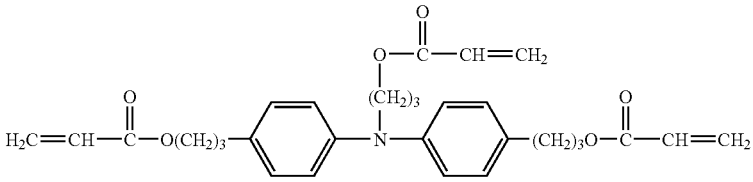 |
| 26 | 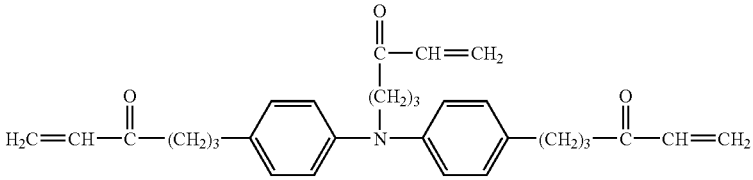 |

-continued
| No. | Examples of compound |
|---|---|
| 27 | 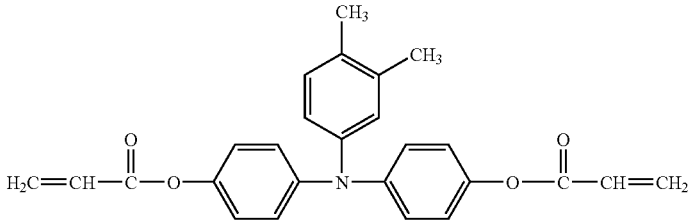 |
| 28 | 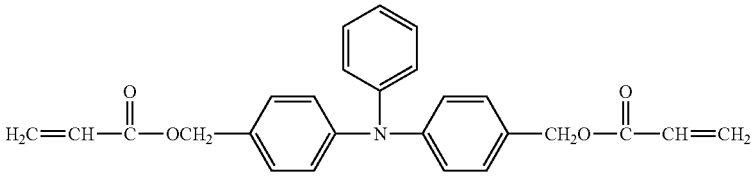 |
| 29 | 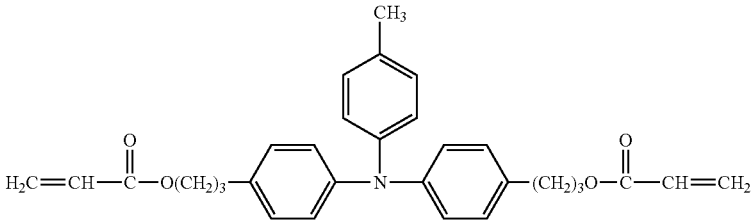 |
| 30 | 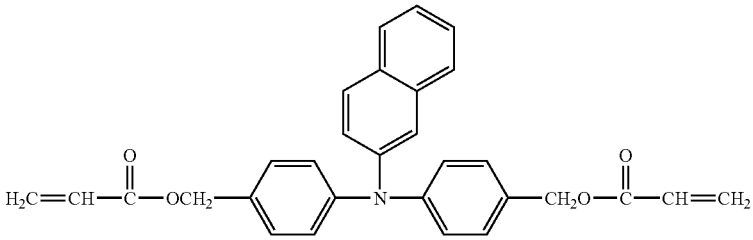 |
| 31 | 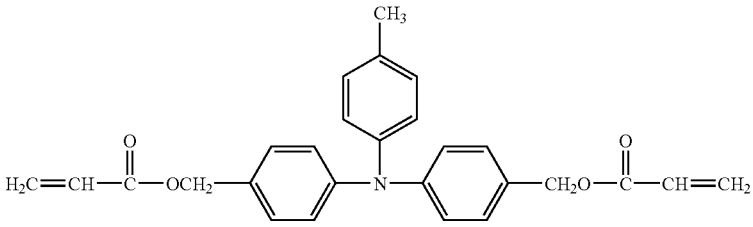 |
| 32 | 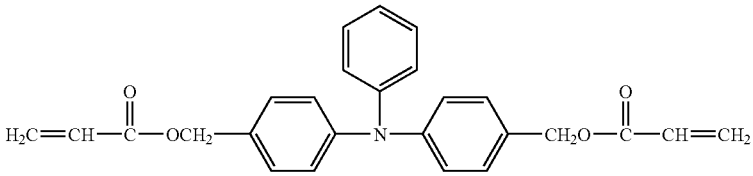 |
| 33 | 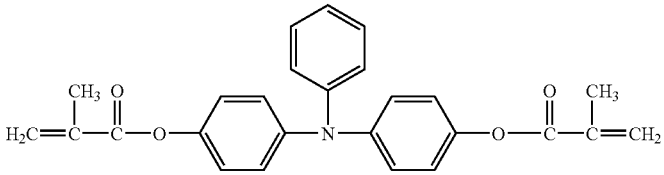 |

-continued
| No. | Examples of compound |
|---|---|
| 34 | 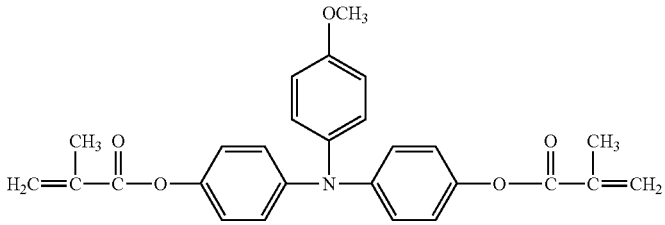 |
| 35 | 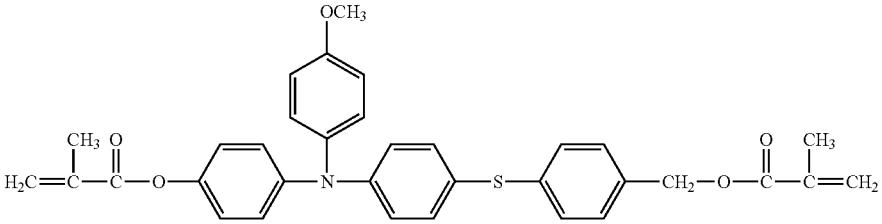 |
| 36 | 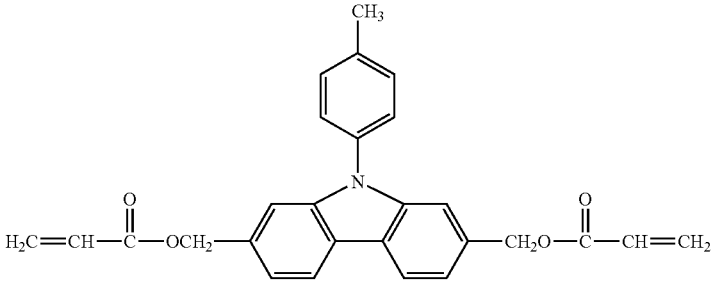 |
| 37 | 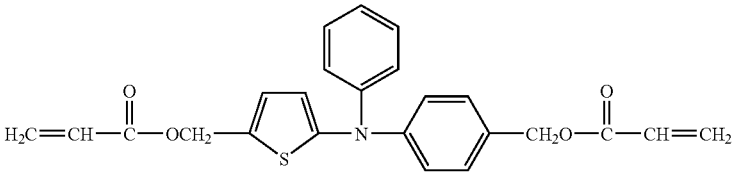 |
| 38 | 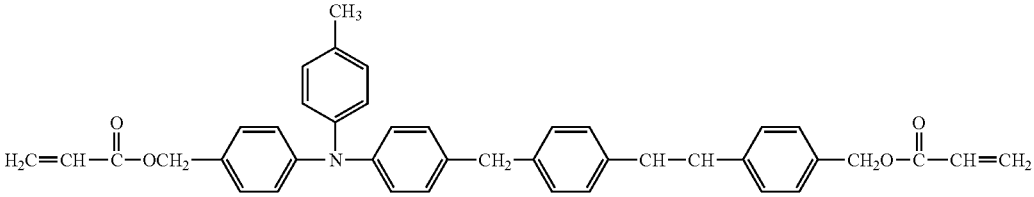 |
| 39 | 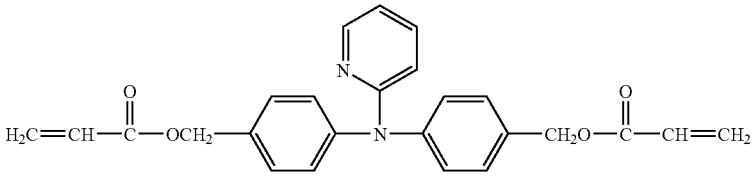 |

-continued
| No. | Examples of compound |
|---|---|
| 40 | 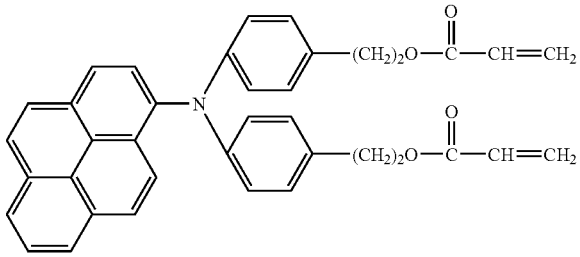 |
| 41 | 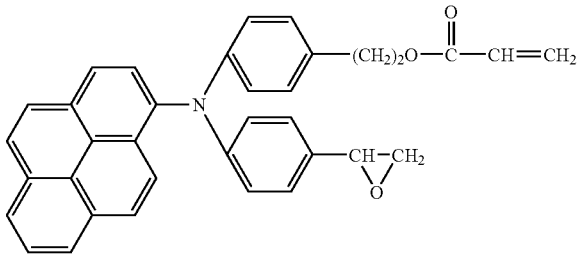 |
| 42 | 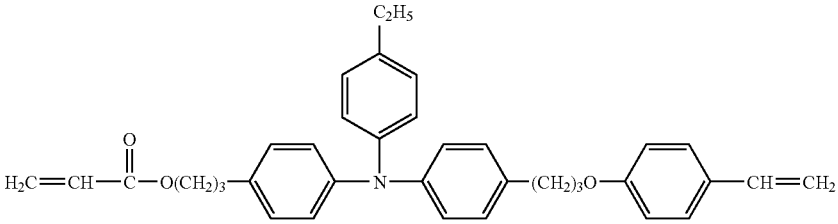 |
| 43 | 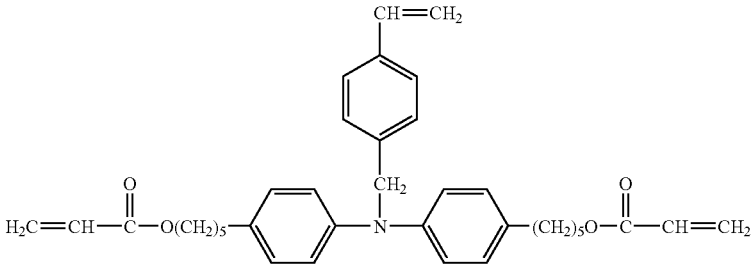 |
| 44 | 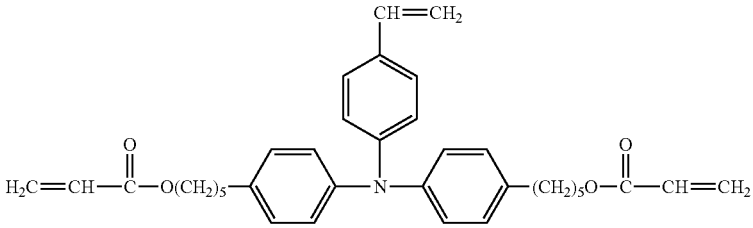 |
| 45 | 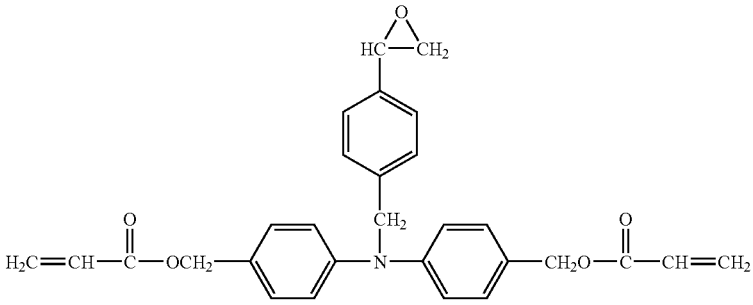 |

-continued
| No. | Examples of compound |
|---|---|
| 46 | 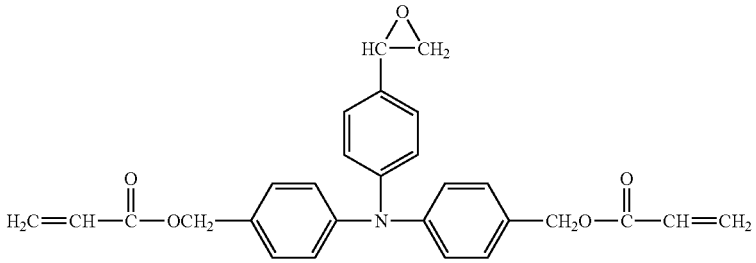 |
| 47 | 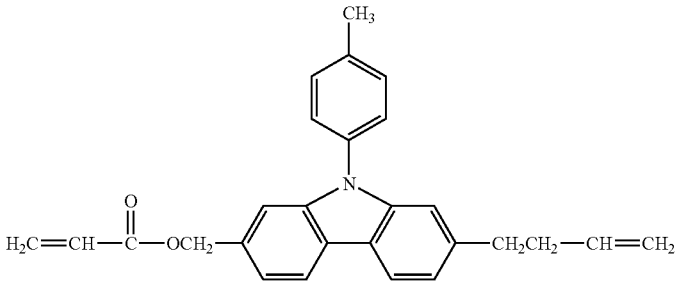 |
| 48 | 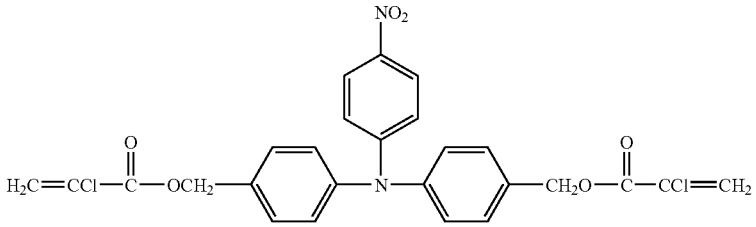 |
| 49 | 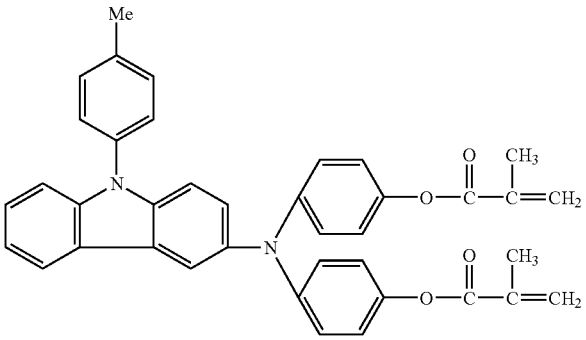 |
| 50 | 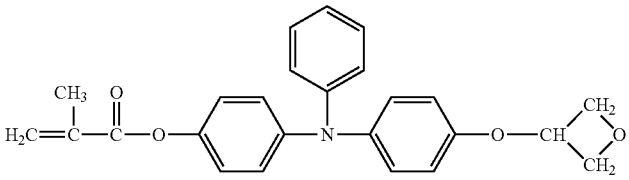 |

-continued
| No. | Examples of compound |
|---|---|
| 51 | 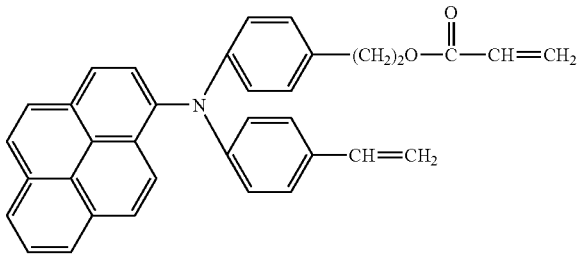 |
| 52 | 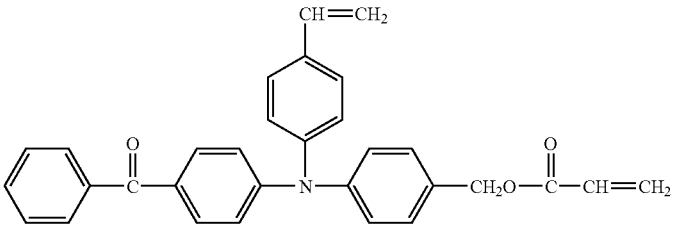 |
| 53 | 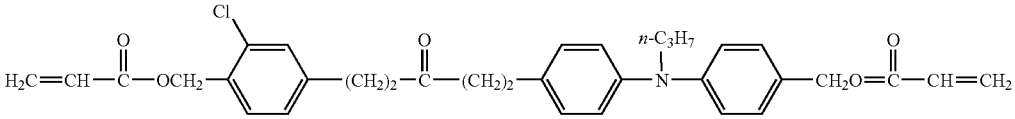 |
| 54 | 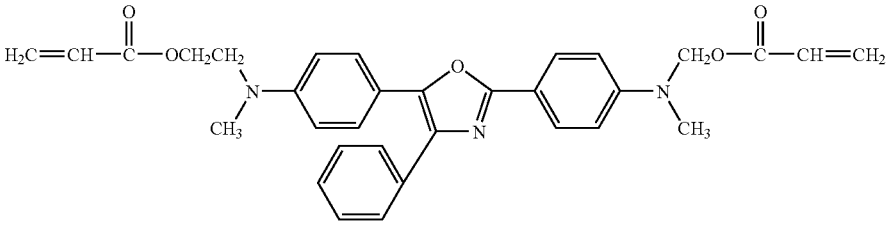 |
| 55 | 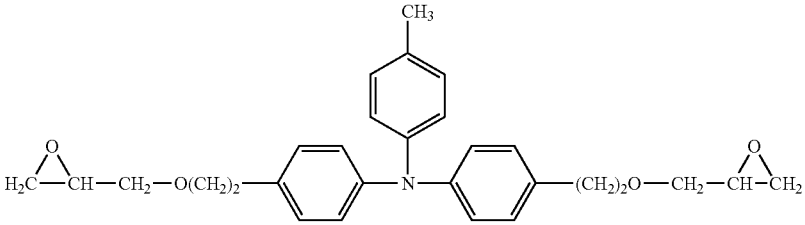 |
| 56 | 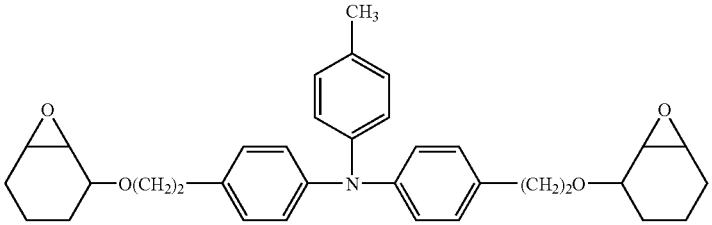 |
| 57 | 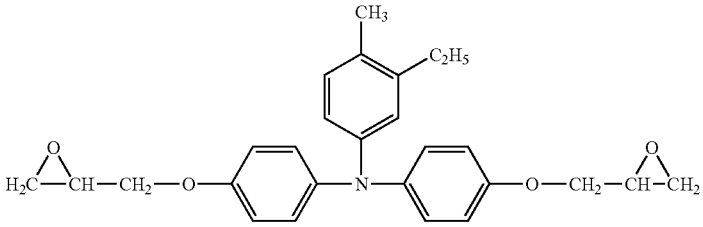 |

-continued
| No. | Examples of compound |
|---|---|
| 58 | 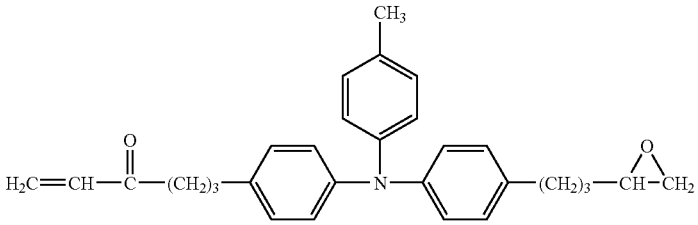 |
| 59 | 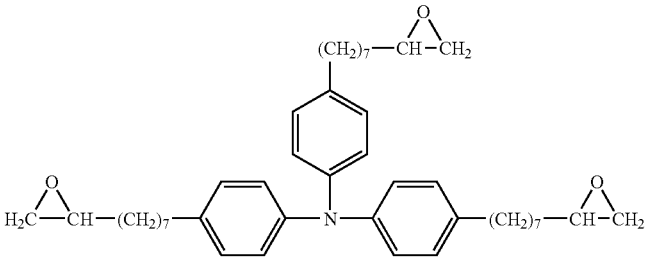 |
| 60 | 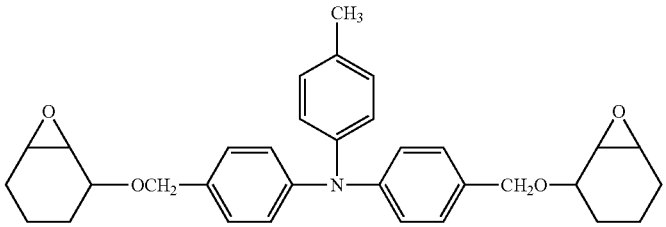 |
| 61 | 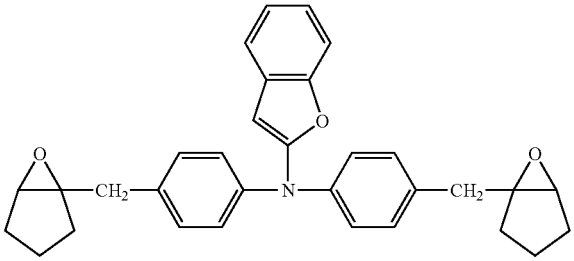 |
| 62 | 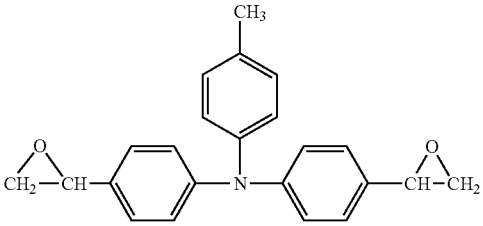 |
| 63 | 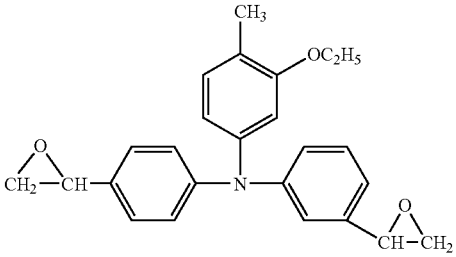 |

-continued
| No. | Examples of compound |
|---|---|
| 64 | 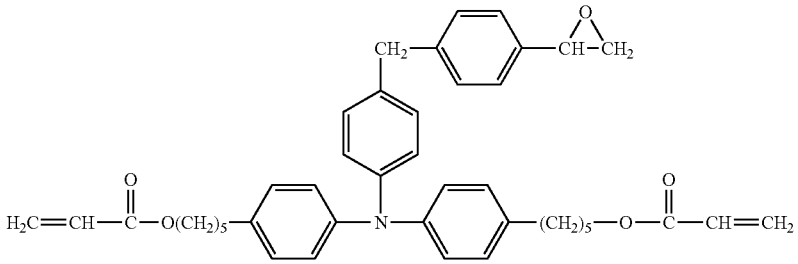 |
| 65 | 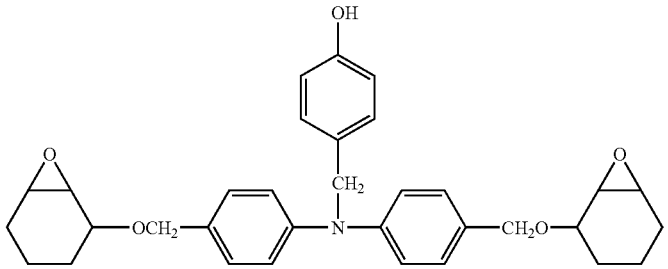 |
| 66 | 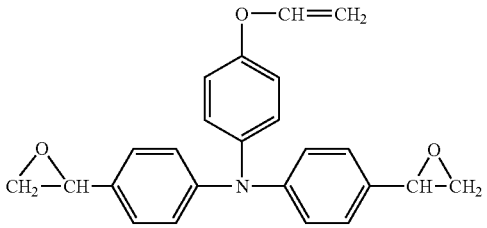 |
| 67 | 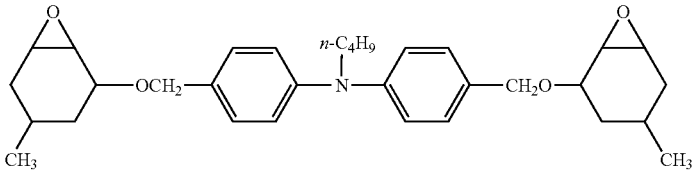 |
| 68 | 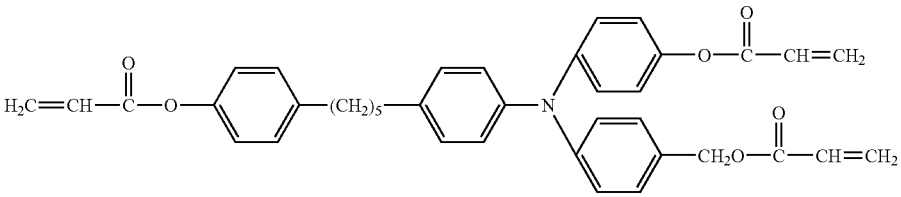 |
| 69 | 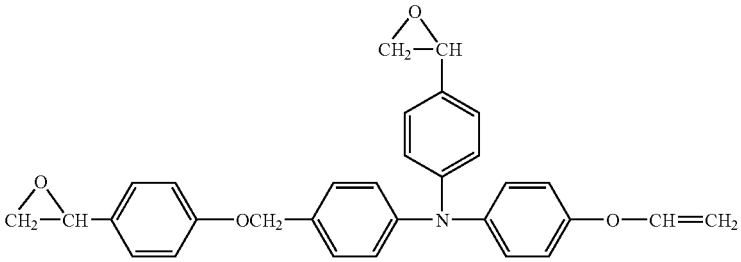 |

-continued
| No. | Examples of compound |
|---|---|
| 70 | 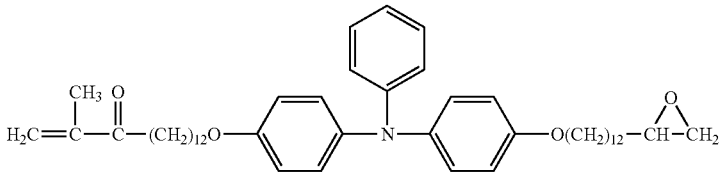 |
| 71 | 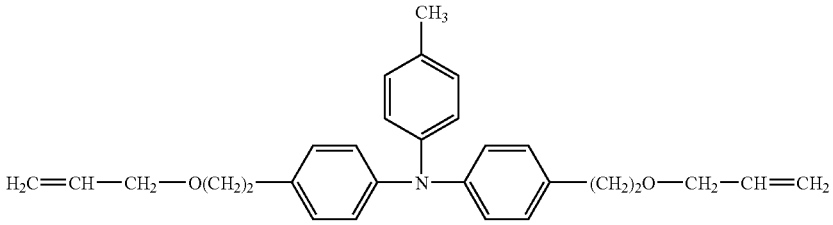 |
| 72 | 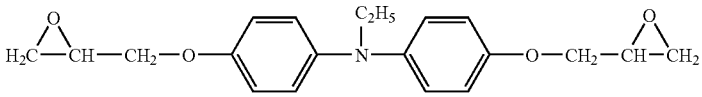 |
| 73 | 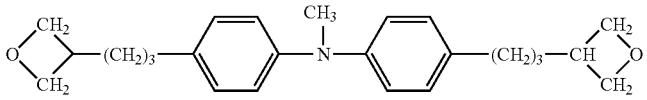 |
| 74 | 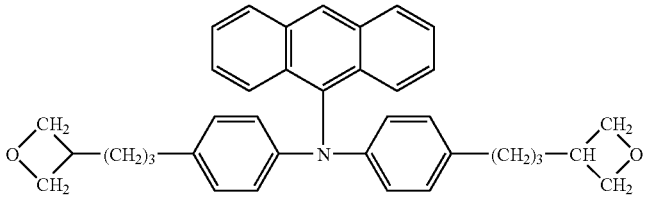 |
| 75 | 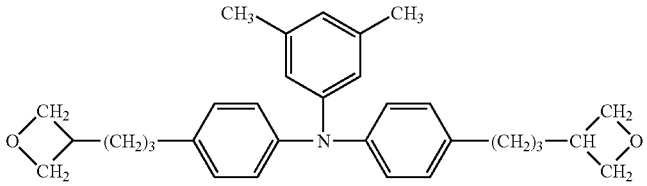 |
| 76 | 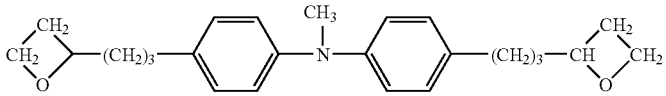 |
| 77 | 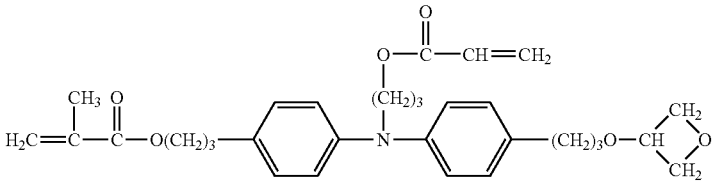 |
| 78 | 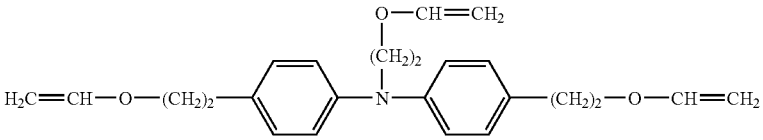 |

-continued
| No. | Examples of compound |
|---|---|
| 79 | 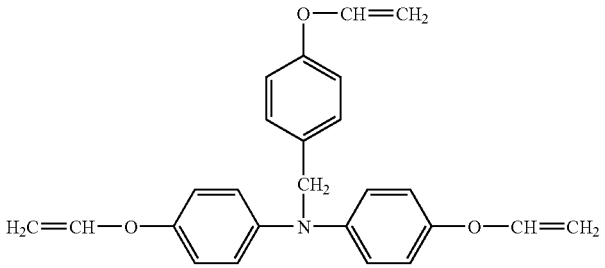 |
| 80 | 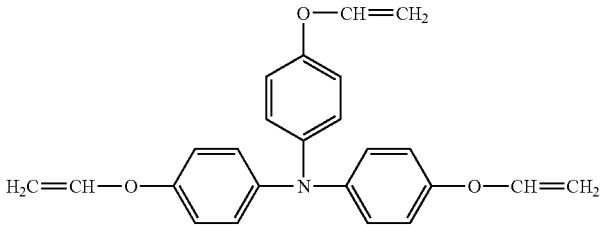 |
| 81 | 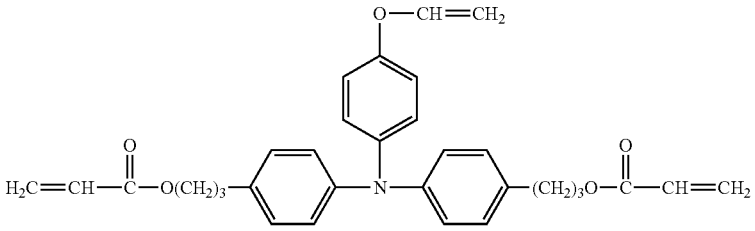 |
| 82 | 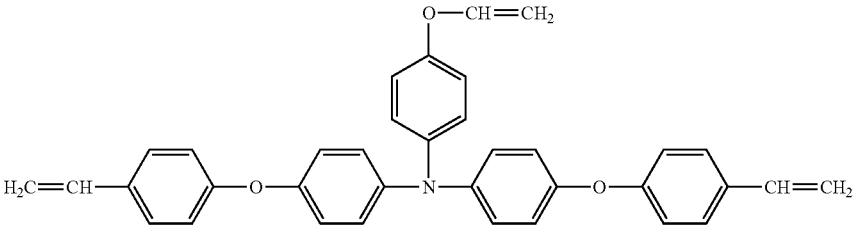 |
| 83 | 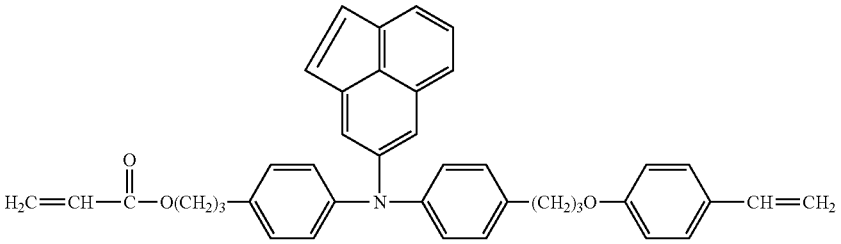 |
| 84 | 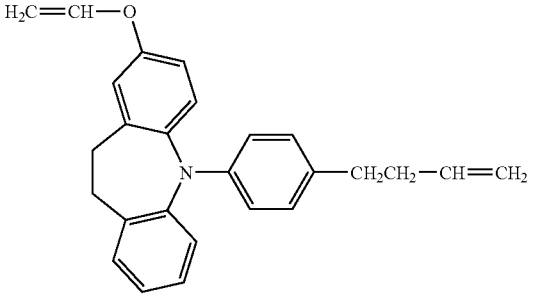 |

-continued
| No. | Examples of compound |
|---|---|
| 85 | 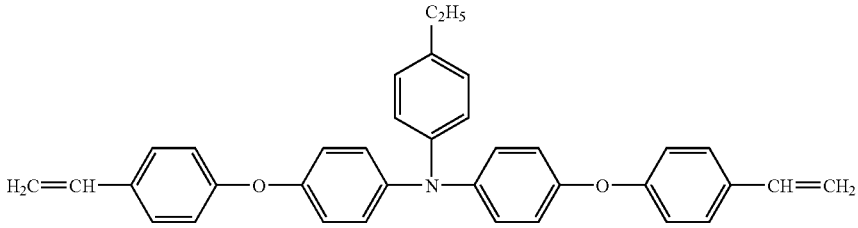 |
| 86 | 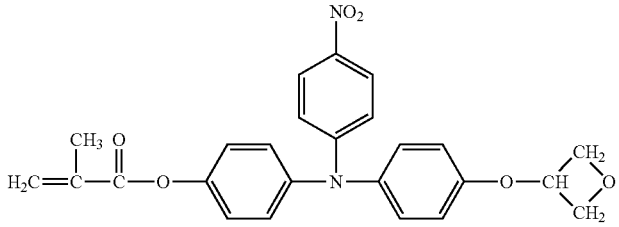 |
| 87 | 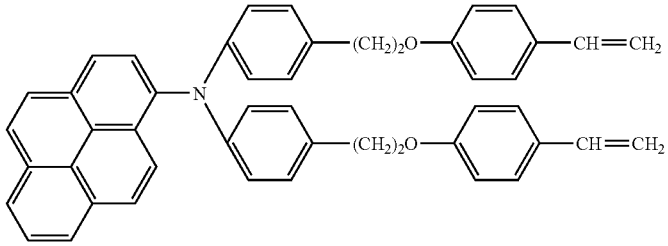 |
| 88 | 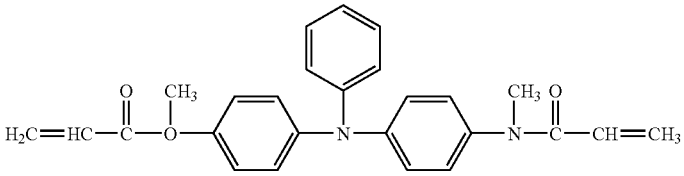 |
| 89 | 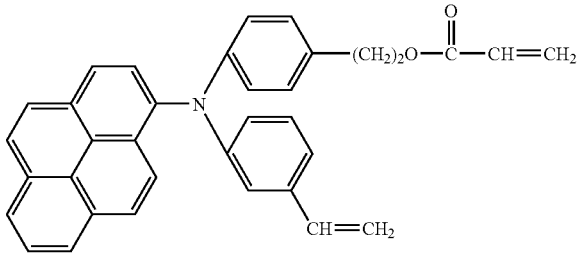 |
| 90 | 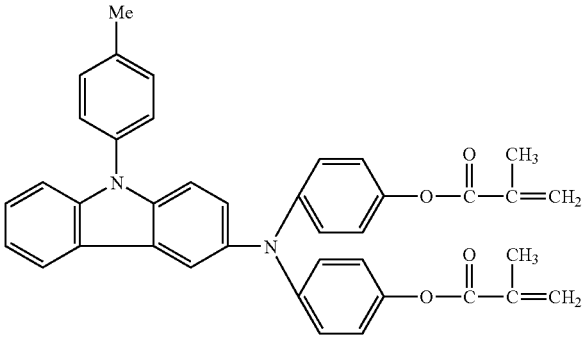 |

-continued
| No. | Examples of compound |
|---|---|
| 91 | 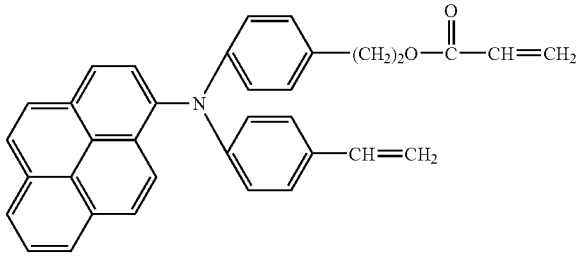 |
| 92 | 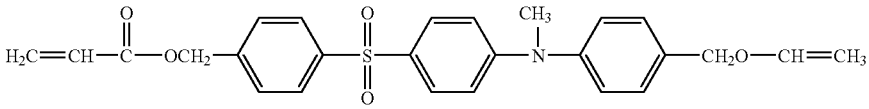 |
| 93 | 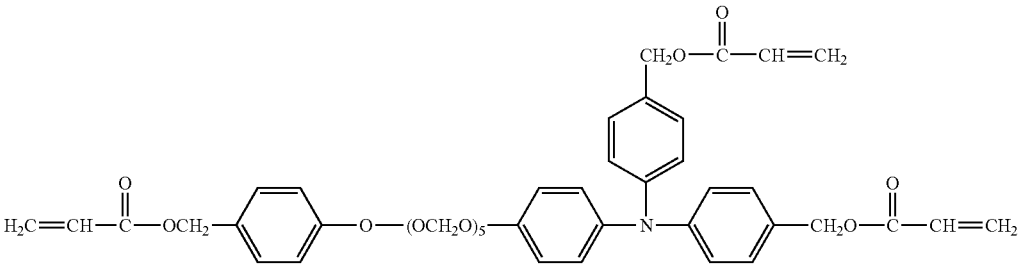 |
| 94 | 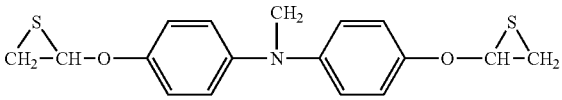 |
| 95 | 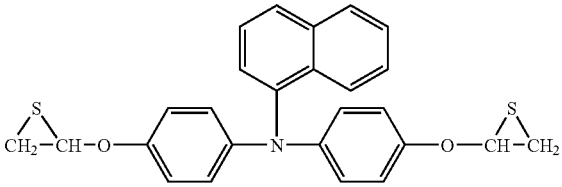 |
| 96 | 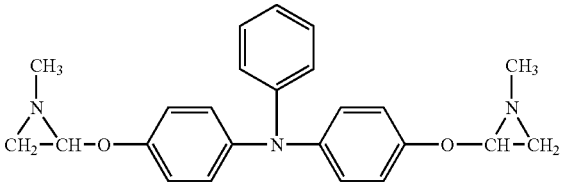 |
| 97 | 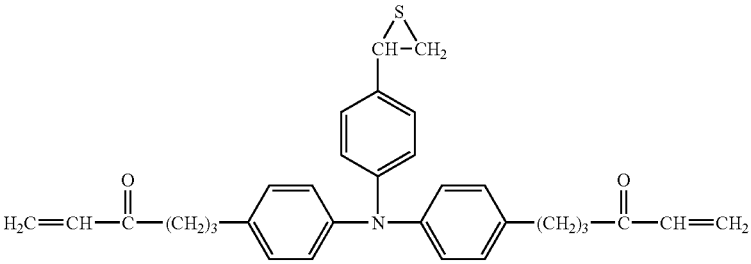 |

-continued
| No. | Examples of compound |
|---|---|
| 98 | 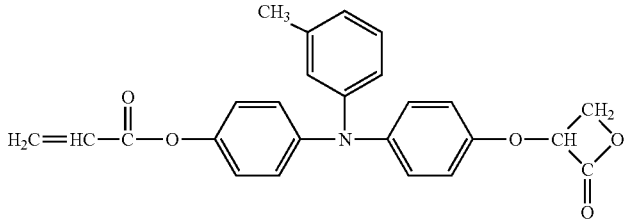 |
| 99 | 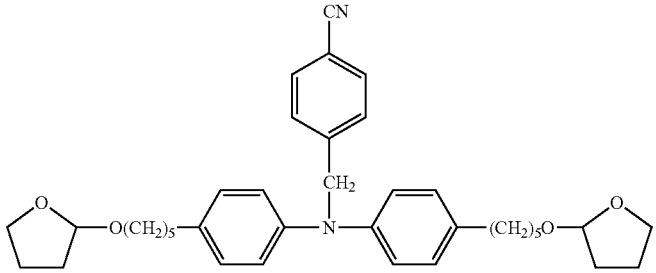 |
| 100 | 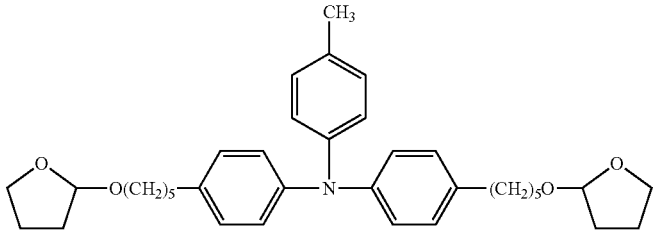 |
| 101 | 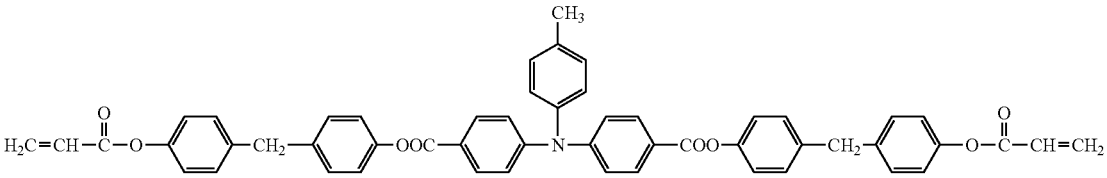 |
| 102 | 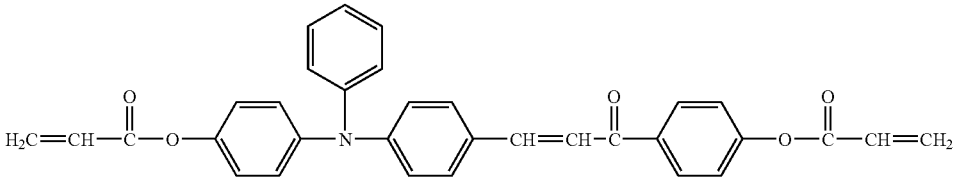 |
| 103 | 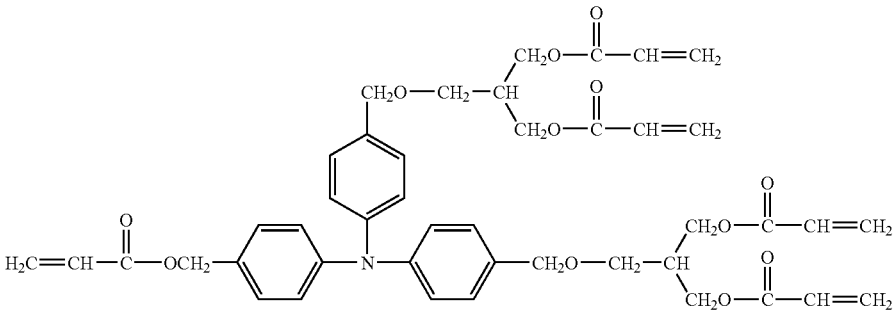 |

-continued
| No. | Examples of compound |
|---|---|
| 104 | 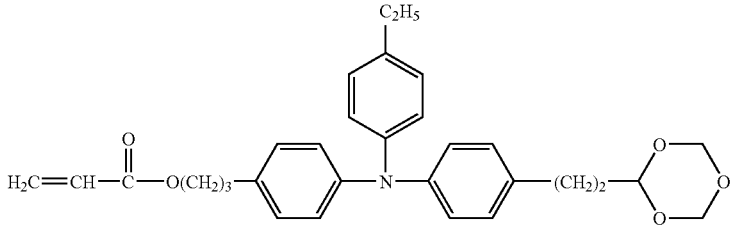 |
| 105 | 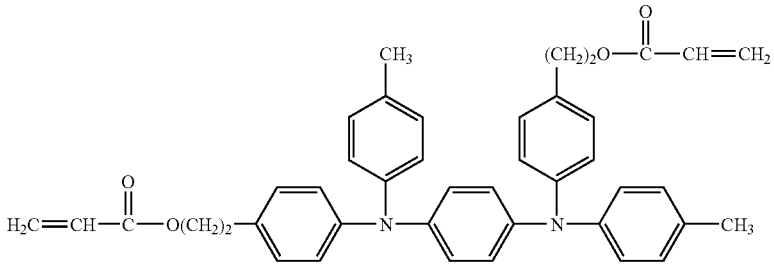 |
| 106 | 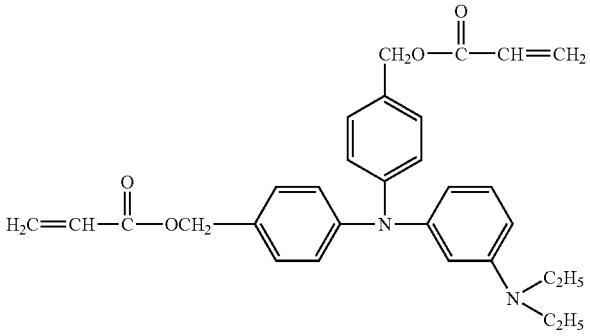 |
| 107 | 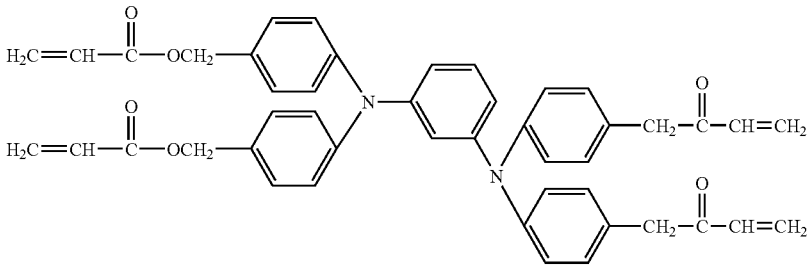 |
| 108 | 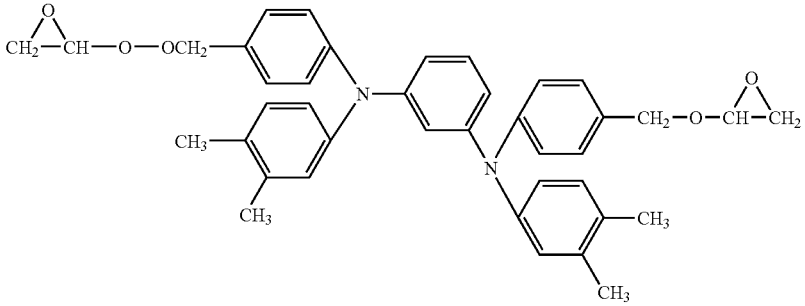 |

-continued
| No. | Examples of compound |
|---|---|
| 109 | 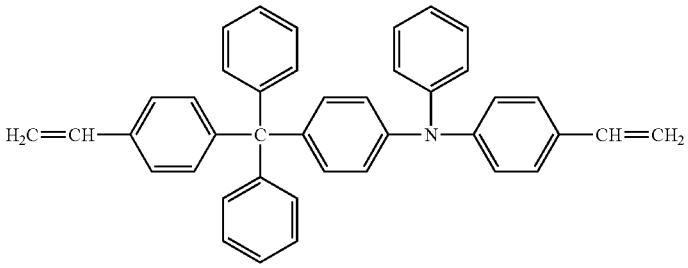 |
| 110 | 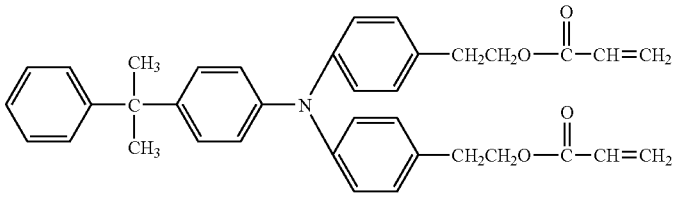 |
| 111 | 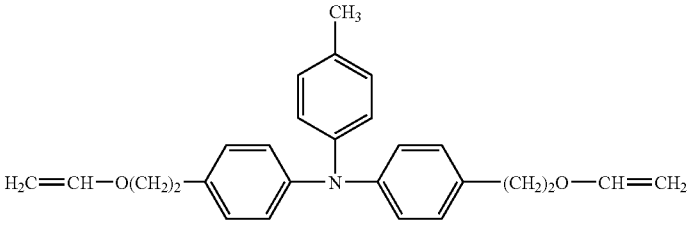 |
| 112 | 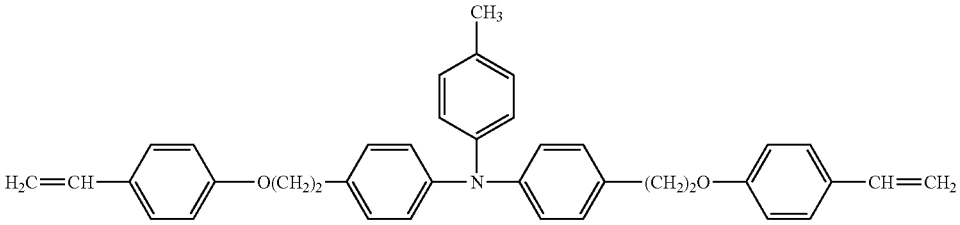 |
| 113 | 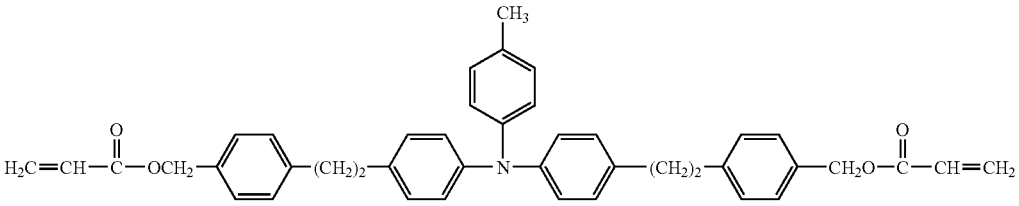 |
| 114 | 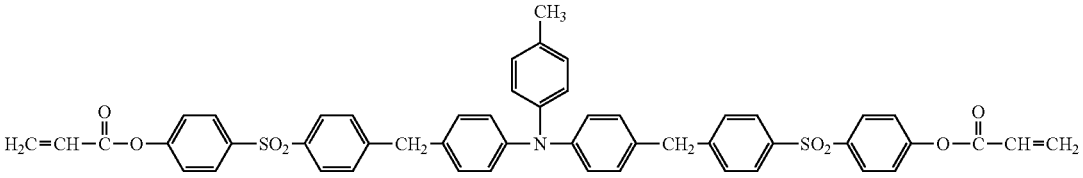 |
| 115 | 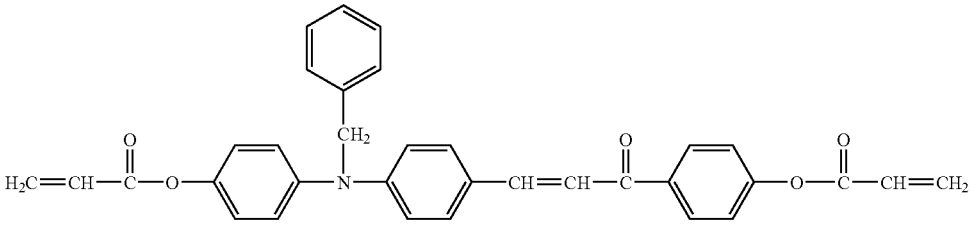 |

-continued

| No. | Examples of compound |
|---|---|
| 116 | 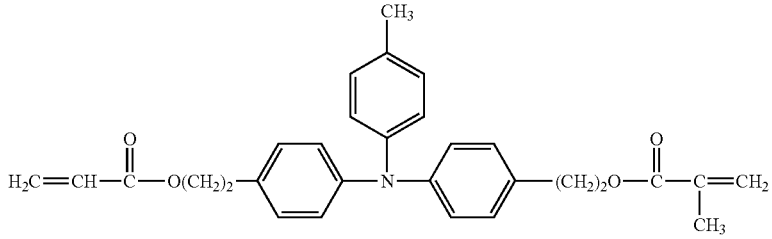 |
| 117 | 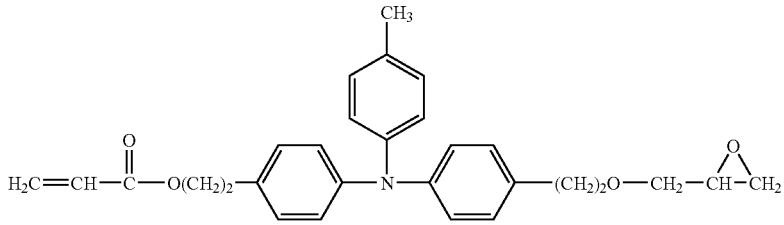 |
| 118 | 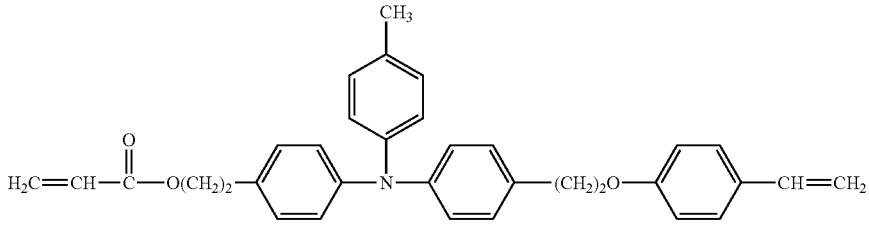 |
| 119 | 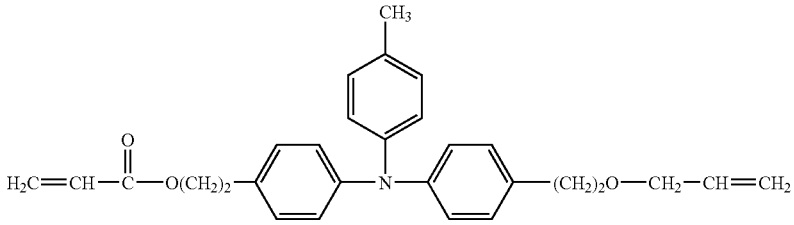 |

The electrophotographic photosensitive member of the present invention will now be described further in detail including layers other than the surface layer.

As described above, the electrophotographic photosensitive member of the present invention is a cylindrical electrophotographic photosensitive member having a support (cylindrical support) and an organic photosensitive layer (hereinafter referred to simply as "photosensitive layer provided on the support (cylindrical support).

The photosensitive layer may be a single-layer type photosensitive layer containing a charge transport material and a charge generation material in the same layer, or may be a multi-layer type (function-separated type) photosensitive layer separated into a charge generation layer containing a charge generation material and a charge transport layer containing a charge transport material, but the multi-layer type photosensitive layer is preferable in terms of electrophotographic characteristics. The multi-layer type photosensitive layer includes a regular-layer type photosensitive layer having a charge generation layer and a charge transport layer formed in this order from the support side, and a reverse-layer type photosensitive layer having a charge transport layer and a charge generation layer formed in this order from the support side, but the regular-layer type photosensitive layer is preferable in terms of electrophotographic characteristics. Further, the charge generation layer may be made to have a multi-layer structure, or the charge transport layer may be made to have a multi-layer structure.

The layer structure of the electrophotographic photosensitive member of the present invention is shown in FIGS. 4A to 4I.

Figure 4A:
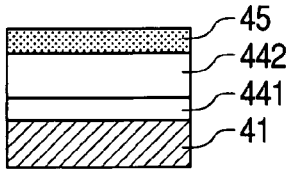
FIGS. 4A, 4B, 4C, 4D, 4E, 4F, 4G, 4H and 4I each show an example of a layer structure of an electrophotographic photosensitive member of the present invention.

The electrophotographic photosensitive member having the layer structure shown in FIG. 4A is provided on a support 41 with a layer (charge generation layer) 441 containing a charge generation material and a layer (first charge transport layer) 442 containing a charge transport material in this order, and further provided thereon as a surface layer with a layer (second charge transport layer) 45 formed by polymerizing a positive hole transporting compound having a chain polymerizable functional group.

Figure 4B:
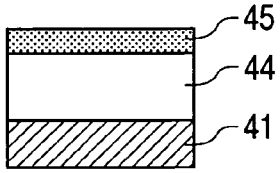

The electrophotographic photosensitive member having the layer structure shown in FIG. 4B is provided on the support 41 with a layer 44 containing a charge generation material and a charge transport material, and further provided thereon as a surface layer with a layer 45 formed by polymerizing a positive hole transporting compound having a chain polymerizable functional group.

Figure 4C:
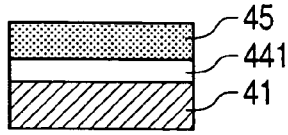

The electrophotographic photosensitive member having the layer structure shown in FIG. 4C is provided on the support 41 with a layer (charge generation layer) 441 containing a charge generation material, and further provided thereon as a surface layer the layer 45 formed by polymerizing a positive hole transporting compound having a chain polymerizable functional group.

As shown in FIGS. 4D to 4I, an intermediate layer (referred to also as "undercoat layer") 43 having a barrier function and an adhesion function, and a conductive layer 42 intended for prevention of interference bands and the like may be provided between the support 41 and the layer (charge generation layer) 441 containing a charge generation material or the layer 44 containing a charge generation material and a charge transport material.

Figure 4D:
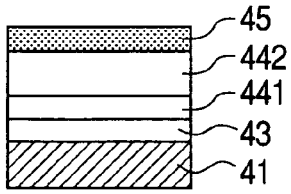
Figure 4E:
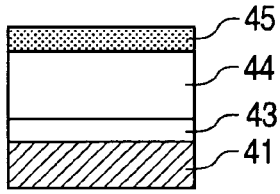
Figure 4F:
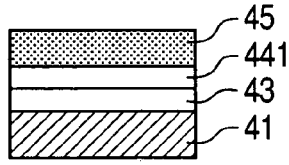
Figure 4G:
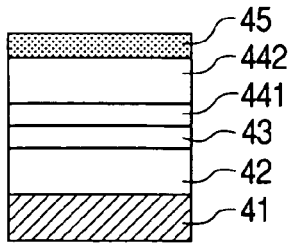
Figure 4H:
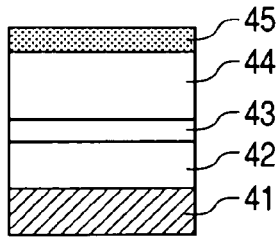
Figure 4I:
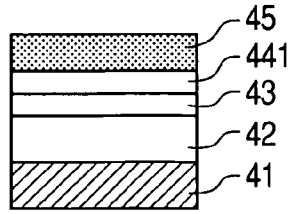

Any other layer structure may be adopted (for example, the layer formed by polymerizing a positive hole transporting compound having a chain polymerizable functional group may be omitted), but if the layer formed by polymerizing a positive hole transporting compound having a chain polymerizable functional group is used as the surface layer of the electrophotographic photosensitive member, the layer structures shown in FIGS. 4A, 4D and 4G are preferable among the layer structures shown in FIGS. 4A to 4I.

For the support, any material having conductivity (conductive support) is acceptable and for example, metal supports such as iron, copper, gold, silver, aluminum, zinc, titanium, lead, nickel, tin, antimony and indium may be used. The metal support or a plastic support, having a layer formed by coating aluminum, an aluminum alloy, indium oxide-tin oxide alloy or the like by vapor deposition may also be used. A support having a paper or a plastic impregnated with conductive particles such as carbon black, tin oxide particles, titanium oxide particles or silver particles together with an appropriate binder resin, or a plastic support having a conductive binder resin may also be used.

The surface of the support may be subjected to a cutting process, surface roughening process, alumite process or the like for the purpose of preventing interference fringes resulting from scattering of laser light and the like.

As described above, a conductive layer intended for preventing interference fringes resulting from scattering of laser light and covering scratches of the support may be provided between the support and the photosensitive layer (charge generation layer, charge transport layer) or an intermediate layer described later.

The conductive layer can be formed by dispersing conductive particles such as carbon black, metal particles or metal oxide particles in a binder resin.

The thickness of the conductive layer is preferably 1 to 40 μm, more preferably 2 to 20 μm.

As described above, an intermediate layer having a barrier function and an adhesion function may be provided between the support or conductive layer and the photosensitive layer (charge generation layer, charge transport layer). The intermediate layer is formed for the purpose of improving adhesion properties of the photosensitive layer, improving coating characteristics, improving charge injectability from the support, and protecting the photosensitive layer against electric breakdown.

The intermediate layer can be formed by using a binder resin such as, mainly, a polyester resin, polyurethane resin, polyacrylate resin, polyethylene resin, polystyrene resin, polybutadiene resin, polycarbonate resin, polyamide resin, polypropylene resin, polyimide resin, phenol resin, acryl resin, silicone resin, epoxy resin, urea resin, allyl resin, alkyd resin, polyamide-imide resin, nylon resin, polysulfone resin, polyallyl ether resin, polyacetal resin or butyral resin. A metal, alloy or oxides or salts thereof and surfactants and the like may be incorporated in the intermediate layer.

The thickness of the intermediate layer is preferably 0.05 to 7 μm, more preferably 0.1 to 2 μm.

Charge generation materials for use in the electrophotographic photosensitive member of the present invention include, for example, selenium-tellurium, pyrylium and thiapyrylium dyes, phthalocyanine pigments having various kinds of core metals and various kinds of crystal systems (α, β, γ, ϵ, X types, etc.), anthoanthrone pigments, dibenzpyrenequinone pigments, pyranthrone pigments, azo pigments such as monoazo, disazo and trisazo pigments, indigo pigments, quinacridone pigments, asymmetrical quinocyanine pigments, quinocyanine pigments and amorphous silicon. Only one type of these charge generation materials may be used, or two or more types thereof may be used.

Charge transport materials for use in the electrophotographic photosensitive member of the present invention include, besides the above described positive hole transporting compound having a chain polymerizable functional group, for example, pyrene compounds, N-alkylcarbazole compounds, hydrazone compounds, N,N-dialkylaniline compounds, diphenylamine compounds, triphenylamine compounds, triphenylmethane compounds, pyrazoline compounds, styryl compounds and stilbene compounds.

If the photosensitive layer is functionally separated into the charge generation layer and the charge transport layer, the charge generation layer can be formed by coating a coating solution for a charge generation layer obtained by dispersing the charge generation material together with a binder resin and a solvent, and drying the coating. Dispersion methods include methods using a homogenizer, an ultrasonic dispersing apparatus, a ball mill, a vibrating ball mill, a sand mill, a roll mill, attritor and a liquid colliding high speed dispersing apparatus. The ratio of the charge generation material in the charge generation layer is preferably 0.1 to 100% by weight, more preferably 10 to 80% by weight based on the total weight of the binding resin and the charge generation material. The ratio is preferably 10 to 100% by weight, more preferably 50 to 100% by weight based on the total weight of the charge generation layer. The charge generation material can be coated alone by vapor deposition or the like to form the charge generation layer.

The thickness of the charge generation layer is preferably 0.001 to 6 μm, more preferably 0.01 to 2 μm.

If the photosensitive layer is functionally separated into the charge generation layer and the charge transport layer, the charge transport layer, particularly the charge transport layer which is not the surface layer of the electrophotographic photosensitive member can be formed by coating a coating solution for a charge transport layer obtained by dissolving the charge transfer material and the binder resin in a solvent, and drying the coating. For those of the above charge transport materials which are capable of forming a film by itself, the charge transport material can be coated alone without using the binder resin to form the charge transport layer. The ratio of the charge transport material in the charge transport layer is preferably 0.1 to 100% by weight, preferably 10 to 80% by weight based on the total weight of the binder resin and the charge transport material. The ratio is preferably 20 to 100% by weight, more preferably 30 to 90% by weight based on the total weight of the charge transport layer.

The charge transport layer, particularly the charge transport layer which is not the surface layer of the electrophotographic photosensitive member is preferably 5 to 70 μm, more preferably 10 to 30 μm. If the thickness of the charge transport layer is too small, a charging capability is hard to be retained, and if the thickness is too large, a residual potential tends to be increased.

If the charge transport material and the charge generation material are incorporated in the same layer, the layer can be formed by coating a coating solution for the layer obtained by dispersing the charge generation material and the charge transport material together with binder resin and a solvent, and drying the coating. The thickness of the layer is preferably 8 to 40 μm, more preferably 12 to 30 μm. The ratio of a photoconductive material (charge generation material and charge transport material) in the layer is preferably 20 to 100% by weight, more preferably 30 to 90% by weight based on the total weight of the layer.

Binder resins for use in the photosensitive layer (charge transport layer, charge generation layer) include, for example, an acryl resin, an allyl resin, an alkyd resin, an epoxy resin, a silicone resin, a phenol resin, a butyral resin, a benzale resin, a polyacrylate resin, a polyacetal resin, a polyamide-imide resin, a polyamide resin, a polyallyl ether resin, a polyallylate resin, a polyimide resin, a polyurethane resin, a polyester resin, a polyethylene resin, a polycarbonate resin, a polysulfone resin, a polystyrene resin, a polybutadiene resin and a urea resin. They may be used alone or as a mixture or copolymer in one type or two or more types.

A protective layer may be provided on the photosensitive layer for the purpose of protecting the photosensitive layer. The thickness of the protective layer is preferably 0.01 to 10 μm, more preferably 0.1 to 7 μm. For the protective layer, a curable resin cure polymerizing by heating or irradiation with radiations, or the like is preferably used. A resin monomer for the curable resin includes preferably resin monomers having a chain polymerizable functional group. Conductive materials such as metals and oxides, nitrides, salts and alloys thereof, and carbon black may be incorporated in the protective layer. Metals include iron, copper, gold, silver, lead, zinc, nickel, tin, aluminum, titanium, antimony and indium. More specifically, ITO, $TiO_2$, ZnO, $SnO_2$, $Al_2O_3$ and the like may be used. The conductive material is preferably dispersed and incorporated in the protective layer in a form of particles, and the particle size is preferably 0.001 to 5 μm, more preferably 0.01 to 1 μm. The ratio of the conductive material in the protective layer is preferably 1 to 70% by weight, more preferably 5 to 50% by weight based on the total weight of the protective layer. Titanium coupling agents, silane coupling agents, and various kinds of surfactants may also be used as a dispersant for the conductive material.

An antioxidant, an anti-light degradation agent and the like may be added to each layer constituting the electrophotographic photosensitive member. Various kinds of fluorine compounds, silane compounds, metal oxides and the like may be added to the surface layer of the electrophotographic photosensitive member for the purpose of improving lubricating property and water repellency of the peripheral surface of the electrophotographic photosensitive member. They may be dispersed and incorporated in the protective layer in a form of particles. Surfactants and the like may be used as the dispersant for the compounds. The ratio of the above additives in the surface layer of the electrophotographic photosensitive member is 1 to 70% by weight, more preferably 5 to 50% by weight based on the total weight of the surface layer.

For the method for formation of the layers of the electrophotographic photosensitive member of the present invention, various kinds of methods such as vapor deposition and coating methods may be employed but among them, the coating method is most preferable. The coating method allows formation of layers of various compositions including thin layers and thick layers. Specifically, the coating methods include coating methods using a bar coater, a knife coater, a roll coater and attritor, a dip coating method, a spray coating method, a beam coating method, an electrostatic coating method and a powder coating method.

Figure 5:
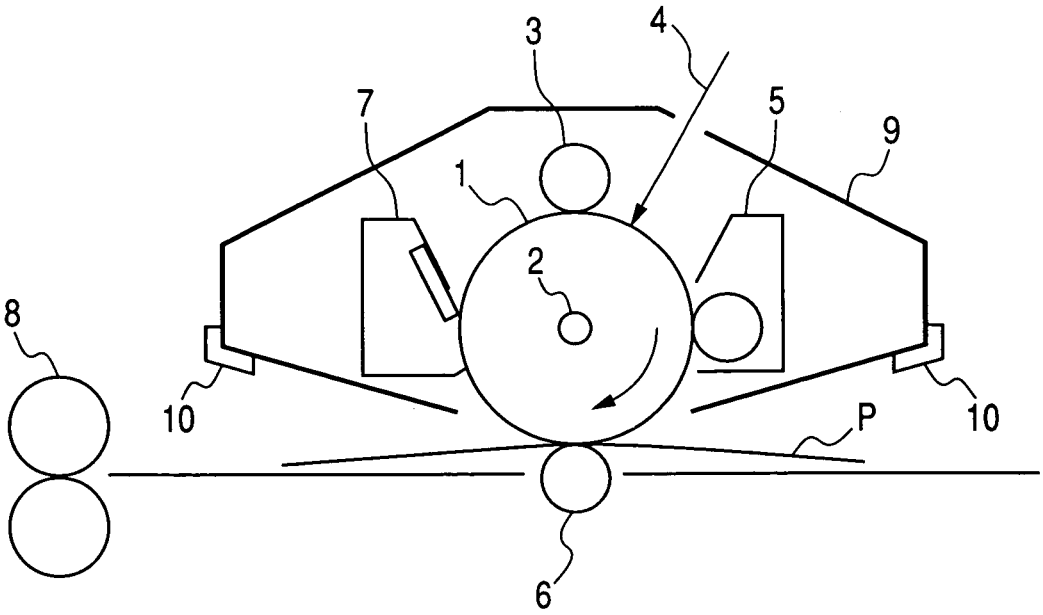
FIG. 5 shows one example of an outlined configuration of an electrophotographic apparatus comprising a process cartridge having the electrophotographic photosensitive member of the present invention.

One example of the outlined configuration of an electrophotographic apparatus comprising a process cartridge having the electrophotographic photosensitive member of the present invention is shown in FIG. 5.

In FIG. 5, reference numeral 1 denotes a cylindrical electrophotographic photosensitive member, which is rotationally driven at a predetermined peripheral speed around an axis 2 in the direction shown by the arrow.

The peripheral surface of the electrophotographic photosensitive member 1 which is rotationally driven is uniformly charged to a positive or negative predetermined potential by charging means (primary charging means: charging roller or the like) 3, and then receives exposure light (image exposure light) 4 output from exposure means (not shown) such as slit exposure or laser beam exposure. In this way, electrostatic latent images consistent with desired images are sequentially formed on the peripheral surface of the electrophotographic photosensitive member 1.

The electrostatic latent image formed on the peripheral surface of the electrophotographic photosensitive member 1 is developed into a toner image by a toner contained in a developer of development means 5. Then, the toner image formed and borne on the peripheral surface of the electrophotographic photosensitive member 1 is sequentially transferred onto a transfer material (paper, etc.) taken out and fed from transfer material feeding means (not shown) to a portion (abutment portion) between the electrophotographic photosensitive member 1 and transfer means 6 in synchronization with rotation of the electrophotographic photosensitive member 1, by a transfer bias from the transfer means (transfer roller, etc.) 6.

The transfer material P having the toner image transferred thereto is separated from the peripheral surface of the electrophotographic photosensitive member 1 and introduced into fixing means 8 to have the image fixed thereon, and thereupon the transfer material P is printed out to outside the apparatus as an image-formed material (print, copy).

The peripheral surface of the electrophotographic photosensitive member 1 after transfer of the toner image is cleaned with a transfer residual developer (toner) removed by cleaning means (cleaning blade, etc.) 7, further subjected to a static elimination process by pre-exposure light (not shown) from pre-exposure means (not shown), and thereafter used for formation of images again. As shown in FIG. 5, pre-exposure is not necessarily required if the charging means 3 is contact charging means using a charging roller or the like.

Two or more of components such as the above electrophotographic photosensitive member 1, charging means 3, development means 5, transfer means 6, cleaning means 7 and the like may be contained in a container and integrally coupled as a process cartridge, and this process cartridge may be constituted to be detachably attachable to an electrophotographic apparatus main body of a copier, laser beam printer or the like. In FIG. 5, the electrophotographic photosensitive member 1, the charging means 3, the development means 5 and the cleaning means 7 are integrally supported to form into a cartridge, and the cartridge is a process cartridge 9 which can be attached and detached by using guide means 10 such as a rail of the electrophotographic apparatus main body.

If the cleaning means is means for cleaning a transfer residual toner on the peripheral surface of the electrophotographic photosensitive member using the cleaning blade, the abutment pressure (line pressure) of the cleaning blade on the peripheral surface of electrophotographic photosensitive member is preferably in the range of 10 to 45 g/cm, and the abutment angle of the cleaning blade is preferably in the range of 20 to 30° in terms of cleaning characteristics.

Figure 6:
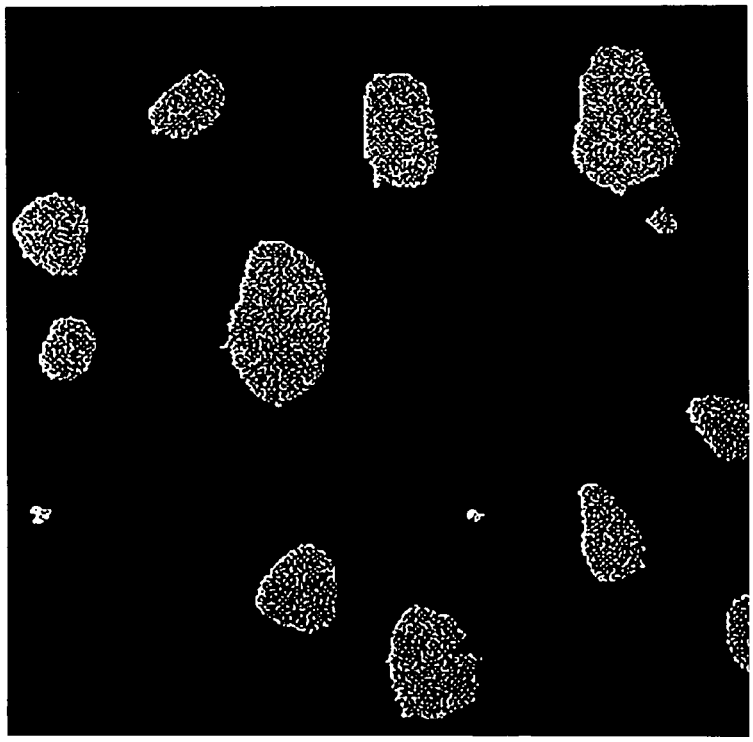
FIG. 6 is an enlarged view (one example) of the peripheral surface of the electrophotographic photosensitive member of the present invention.

FIG. 6 shows one example of an image obtained by processing an image of a dimple-shaped concave obtained by observing the peripheral surface of the electrophotographic photosensitive member of the present invention in a visual field of 100 μm×100 μm (10,000 $\mu m^2$) using a surface shape measurement system: Surface Explorer SX-520DR manufactured by Ryoka System Inc. so that only a contour portion of the concave having a maximum diameter 1 μm or greater and a depth of 0.1 μm or greater is seen.

EXAMPLES

The present invention will now be explained in more detail using examples. However, the present invention is not to be limited to these examples. It should be noted that in the examples the term "parts" means "parts by weight".

Example 1

The electrophotographic photosensitive member to be used in Example 1 was prepared in the following manner.

First, a JIS A3003 aluminum alloy was machined into an aluminum cylinder having a length of 370 mm, external diameter of 84 mm and wall thickness of 3 mm.

The 10-point average roughness Rzjis as measured by sweeping along the generating line of the surface (peripheral surface) of the prepared aluminum cylinder was 0.08 μm.

This aluminum cylinder was subjected to ultrasonic cleaning in a cleaning solution which contained a cleanser (Tradename: Kemicouru Conn.; manufactured by Tokiwa Chemical Co., Ltd.) in pure water. After rinsing off the cleaning solution, the aluminum cylinder was further subjected to ultrasonic cleaning in pure water and degreased to serve as a support (cylindrical support).

Next, a solution consisting of 60 parts of titanium oxide particles (Trade name: Kronos ECT-62; manufactured by Titan Kogyo Kabushiki Kaisha) having a coating film of antimony-doped tin oxide, 60 parts of titanium oxide particles (Trade name: titone SR-1T; manufactured by Sakai Chemical Industries Co., Ltd), 70 parts of a resol-type phenolic resin (Trade name: Phenolite J-325; manufactured by Dainippon Ink and Chemicals Incorporated; solid content 70%), 50 parts of 2-methoxy-1-propanol and 50 parts of methanol was dispersed for 20 hours using a ball mill, to thereby prepare a coating solution for a conductive layer. The average particle diameter of the particles contained in the coating solution for a conductive layer was 0.25 μm.

This coating solution for a conductive layer was applied onto the support by dipping coating, and then dried and cured for 48 minutes in a hot-air dryer set to 150° C., to thereby form a 15 μm-thick conductive layer.

Next, a coating solution for an intermediate layer was prepared by dissolving 10 parts of a copolymer nylon resin (Trade name: Amilan CM-8000; manufactured by Toray Industries, Inc.) and 30 parts of a methoxymethylated nylon resin (Trade name: Toresin EF-30T; manufactured by Teikoku Chemical Industries Co., Ltd.) in a mixed solvent of 500 parts of methanol and 250 parts of butanol.

This coating solution for an intermediate layer was applied onto the conductive layer by dipping coating, and dried for 22 minutes in a hot-air dryer set to 100° C. to form a 0.45 μm-thick intermediate layer.

Next, a solution consisting of 4 parts of hydroxygallium phthalocyanine (charge generation substance), which showed strong peaks at Bragg angles (2θ±0.2°) of 7.4° and 28.2° under CuKα-characteristic X-ray diffraction, 2 parts of polyvinyl butyral resin (Trade name: S-LEC BX-1; manufactured by Sekisui Kagaku Kogyo K. K.) and 90 parts of cyclohexanone was dispersed for 1.0 hours in a sand mill using 1 mm diameter glass beads, and the resulting dispersion was then added with 110 parts of ethyl acetate, to thereby form a coating solution for a charge generation layer.

This coating solution for a charge generation layer was applied onto the intermediate layer by dipping, and dried for 22 minutes in a hot-air dryer set to 80° C., to thereby form a 0.17 μm-thick charge, generation layer.

Then, 35 parts of a compound (charge transport substance) having the structure represented by the following formula (11):

(11)

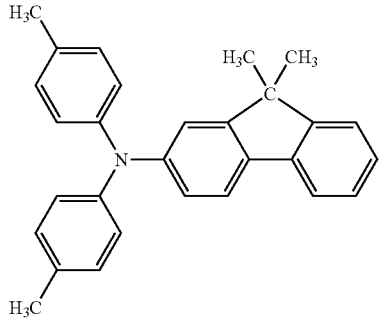

and 50 parts of a bisphenol Z type polycarbonate resin (Trade name: IUPILON Z400; manufactured by Mitsubishi Engineering-Plastics Corporation) were dissolved in a mixed solvent of 320 parts of monochlorobenzene and 50 parts of dimethoxymethane, to thereby prepare a coating solution for a first charge transport layer.

This coating solution for a first charge transport layer was applied onto the charge generation layer by dipping, and dried for 40 minutes in a hot-air drier set to 100° C., to thereby form a 20 μm-thick first charge transport layer.

Next, 30 parts of a compound (polymerizable functional group-containing positive hole transport compound) having the structure represented by the below formula (12):

(12)

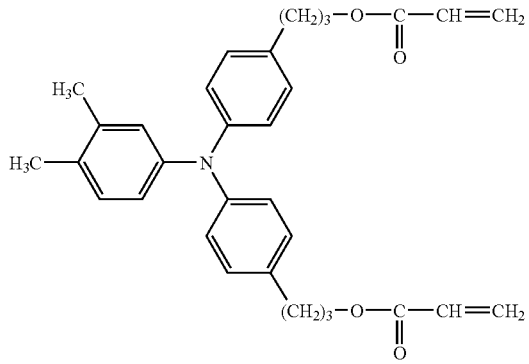

were dissolved in a mixed solvent consisting of 35 parts of 1-propanol and 35 parts of 1,1,2,2,3,3,4-heptafluorocyclopentane (Trade name: Zeorora-H; manufactured by Nippon Zeon Corporation), and the resulting solution was then filtered under pressure using a 0.5 μm membrane filter made of polytetrafluoroethylene (PTFE), to thereby form a coating solution for a second charge transport layer.

This coating solution for a second charge transport layer was applied onto the first charge transport layer by dipping, then held for 5 minutes at 100° C. to dry off the solvent in air.

The resulting product was irradiated with an electron beam in a nitrogen atmosphere (oxygen concentration 10 ppm) under the conditions of an accelerating voltage of 150 kV and a dosage of 15 kGy (1.5 Mrad), then heated in the same atmosphere for 90 seconds until the electrophotographic photosensitive member (i.e. the object being irradiated by the electron beam) temperature reached 120° C. The object was further heated for 20 minutes in air using a hot-air drier set to 100° C., to thereby form a 5 μm-thick cured second charge transport layer.

Next, in summary, a dry blaster (manufactured by Fuji Seiki Corporation) having the structure illustrated in FIG. 1 was employed under the below-described conditions to dry blast the surface of the second charge transport layer to form a plurality of dimple-shaped concave portions on the second charge transport layer surface.

Dry Blasting Conditions:

Particles (polishing particles): Spherical glass beads having an average particle diameter of 30 μm (Trade name: UB-01L; manufactured by Union Co., Ltd.)

Air (compressed air) blasting pressure: 0.343 MPa (3.5 kgf/cm$^2$)

Injection nozzle travel speed: 430 mm/s

Work piece rotating velocity: 288 rpm

Distance between the discharge opening of the injection nozzle and the work piece: 100 mm Particle (polishing particle) discharge angle: 90°

Particle (polishing particle) feed amount: 200 g/min.

Blast frequency: 2×one-way

After dry-blasting, particles (polishing particles) which remained adhering to the peripheral surface of the work piece were removed by blasting with compressed air.

The cylindrical electrophotographic photosensitive member thus prepared was provided on its support with a conductive layer, an intermediate layer, a charge generation layer, a first charge transport layer and a second charge transport layer (cured layer), wherein the second charge transport layer served as the surface layer, and wherein a plurality of dimple-shaped concave portions were formed on its peripheral surface.

Determination of the shape of the prepared electrophotographic photosensitive member peripheral surface gave the values shown in Tables 1 and 2.

The surface texture of the electrophotographic photosensitive member peripheral surfaces, as described above, was determined using a Surfcorder SE 3500 profilometer manufactured by Kosaka Laboratory Ltd.

Measurement of Rzjis (A) and RSm (C) was carried out using a circumferential roughness measuring unit accessory to the above profilometer. The measurement was conducted at a measuring length of 0.4 mm and a measuring rate of 0.1 mm/s. The baseline level for noise reduction was set at 10% (level setting) when measuring RSm (C) and (D).

Further, Rzjis (A) and (B), RSm (C) and (D), Rv (E), Rp (F), the number of dimple-shaped concave portions per 10,000 μm$^2$ (100 μm×100 μm), the surface area ratio of dimple-shaped concave portions, and the average aspect ratio of the dimple-shaped concave portions were measured at 3 portions consisting of a portion 5 cm from one end, the middle, and a portion 5 cm from the other end, of at least two generating lines of the cylindrical electrophotographic photosensitive member, in order to determine the average value of those multiple measured values, respectively.

In the same manner as that described above, an electrophotographic photosensitive member was prepared for measuring the universal hardness (HU) and elastic deformation ratio. Measurement of the universal hardness (HU) and elastic deformation ratio of the surface layer (in the present example, the second charge transport layer) before and after the above-described dry blasting treatment gave the values as shown in Table 3. It is noted that universal hardness (HU) and elastic deformation ratio were measured after leaving the formed surface layer (in the present example, the second charge transport layer) in a 23° C./50% RH environment for 24 hours, and then measured again after the dry blasting treatment.

The prepared electrophotographic photosensitive member was mounted onto a modified electrophotographic copier iR C6800 (modified to a negative electric charge type) manufactured by Canon Inc., which was equipped with a cleaning blade made from polyurethane rubber, and evaluated in the following manner.

First, in a 23° C./50% RH environment, the electric potential conditions were set so that electrophotographic photosensitive member dark-part electric potential (Vd) was −700 V and light-part electric potential (Vl) was −200 V, thereby adjusting the initial electric potential of the electrophotographic photosensitive member.

Cleaning characteristics were evaluated for when the abutting pressure setting of the cleaning blade against the peripheral surface of the electrophotographic photosensitive member was set to the two cases of a high-pressure scenario and a low-pressure scenario. The high-pressure setting abutting pressure (line pressure) of the cleaning blade against the peripheral surface of the electrophotographic photosensitive member was set at 40 g/cm (hereinafter sometimes referred to as "high-pressure blade setting), while the low-pressure setting abutting pressure (line pressure) of the cleaning blade against the peripheral surface of the electrophotographic photosensitive member was set at 16 g/cm (hereinafter sometimes referred to as "low-pressure blade setting). The cleaning blade abutting angle was set to be 24°.

The electrophotographic photosensitive members were evaluated in a 23° C./50% RH atmosphere, wherein their durability was tested by simulated printing of 5,000 A4-size sheets of paper in full-color in an intermittent way provided that two runs were made continuous. After the durability test, defects in the outputted image were observed by outputting a halftone image or similar test image.

Rotational torque of the electrophotographic photosensitive member during the durability test at a high-pressure blade setting was monitored from the motor current value, and noise resulting from cleaning blade chatter and the state of cleaning blade wear-out were evaluated.

Furthermore, the abutting pressure (line pressure) of the cleaning blade against the peripheral surface of the electrophotographic photosensitive member was set at 24 g/cm, wherein the initial drive current value "A" of a rotary motor for the electrophotographic photosensitive member and the drive current value "B" after the 5,000-sheet durability test were used to obtain the value B/A. This value was taken as the relative torque increase ratio.

The state of cleaning defects due to toner leakage from the cleaning blade during the durability test under a low-pressure blade setting was evaluated.

The electrophotographic photosensitive member according to the present example exhibited good cleaning under both conditions, wherein even under a high-pressure blade setting, there was hardly any rise in torque during electrophotographic photosensitive member rotation, and hardly any occurrence of cleaning blade noise or wear-out. In addition, even under a low-pressure blade setting, there was no occurrence of image defects stemming from the leakage of the toner.

The durability evaluation was progressed to completion by simulated printing of 50,000 A4-size sheets of paper on a horizontal sheet in full-color in an intermittent way provided that two runs were made continuous and then their cleaning characteristics were evaluated.

In addition, an electrophotographic photosensitive member for image evaluation in a high-temperature and high-humidity environment was prepared in the same manner as that described above, and evaluated for image deletion.

The above-described electrophotographic copier was placed in a 30° C./80% RH environment, onto which was mounted an electrophotographic photosensitive member for image evaluation in a high-temperature and high-humidity environment. The abutting pressure (line pressure) of the cleaning blade against the peripheral surface of the electrophotographic photosensitive member was set at 24 g/cm, wherein after 10,000 sheets of a copy of an image pattern had been outputted under conditions of A4-size width-size full-color 2-sheet intermission, a halftone image or similar sample image was outputted for evaluation of the occurrence of image deletion.

The electrophotographic photosensitive member according to the present example achieved extremely good results with respect to the occurrence of image deletion.

Furthermore, an electrophotographic photosensitive member was prepared in the same manner as that described above for rubbing memory evaluation, whereby rubbing memory was evaluated.

In a 23° C./50% RH environment, an electrophotographic photosensitive member for rubbing memory evaluation was mounted onto the above-described electrophotographic copier, wherein preexposure in a dark place was switched off, charging (primary charging) was turned off, the developing device and the primary transfer means were separated apart, and the cleaning blade and the cleaning brush were made to rub against the peripheral surface of the electrophotographic photosensitive member while idling for 15 minutes in a state in which the cleaning blade and the cleaning brush were abutting the peripheral surface of the electrophotographic photosensitive member. After 15 minutes had passed, the idling was stopped, and the machine was left to stand for 60 minutes. The difference between the initial electric potential and the accumulated electric potential was measured, compared and taken as the rubbing memory value.

The electrophotographic photosensitive member according to the present example had little peripheral surface rubbing resistance, so that even when rubbing against members surrounding the electrophotographic photosensitive member, negative effects due to rubbing were less likely to occur.

Results of the above evaluation are shown in Tables 4, 6 and 8.

Example 2

A conductive layer, an intermediate layer, a charge generation layer, and a first charge transport layer were formed on a support in the same manner as that in Example 1.

Next, 0.15 parts of a fluorine atom-containing resin (Trade name: GF-300; manufactured by Toagosei Co., Ltd.) as a dispersant were dissolved in a mixed solvent consisting of 35 parts of 1,1,2,2,3,3,4-heptafluorocyclopentane (Trade name: Zeorora-H; manufactured by Nippon Zeon Corporation) and 35 parts of 1-propanol. The resulting solution was then added with 3 parts of tetrafluoroethylene resin particles (Trade name: LUBRON L-2; manufactured by Daikin Industries Ltd.) as a lubricant, then using a high-pressure disperser (Trade name: Microfluidizer M-110EH; manufactured by Microfluidics Corporation, U.S.A), subjected to dispersion treatment 3 times under a pressure of 5,880 N/cm$^2$ (600 kgf/cm$^2$), to thereby make the resulting solution uniformly dispersed.

The resulting solution was then filtered under pressure using a 10 μm membrane filter made from PTFE.

To this filtrate was added 27 parts of a compound (polymerizable functional group-containing positive hole transport compound) having a structure represented by the above formula (12), and the resulting solution was then filtered under pressure using a 10 μm membrane filter made from PTFE, to thereby prepare a coating solution for a second charge transport layer.

This coating solution for a second charge transport layer was applied onto the first charge transport layer by dipping coating, then held for 5 minutes at 100° C. to dry off the solvent in air.

The resulting product was irradiated with an electron beam in a nitrogen atmosphere (oxygen concentration 10 ppm) under the conditions of an accelerating voltage of 150 kV and a dosage of 15 kGy (1.5 Mrad), then heated in the same atmosphere for 90 seconds until the electrophotographic photosensitive member (i.e. the object being irradiated by the electron beam) temperature reached 120° C. The object was further heated for 20 minutes in air using a hot-air drier set to 100° C., to thereby form a 5 μm-thick cured second charge transport layer.

Next, a plurality of dimple-shaped concave portions were formed on the surface of the second charge transport layer by dry blasting under the same conditions as those of Example 1.

The cylindrical electrophotographic photosensitive member thus prepared was provided on its support with a conductive layer, an intermediate layer, a charge generation layer, a first charge transport layer and a second charge transport layer (cured layer), wherein the second charge transport layer served as the surface layer, and wherein a plurality of dimple-shaped concave portions were formed on its peripheral surface.

Prepared in the same manner were an electrophotographic photosensitive member for universal hardness (HU) and elastic deformation ratio measurement, an electrophotographic photosensitive member for image evaluation in a high-temperature high-humidity environment, and an electrophotographic photosensitive member for rubbing memory evaluation.

Electrophotographic photosensitive member peripheral surface shape, universal hardness (HU) and elastic deformation ratio measurement and electrophotographic photosensitive member evaluation were carried out in the same manner as in Example 1. The results of measurement for the electrophotographic photosensitive member peripheral surface shape and the universal hardness (HU) and elastic deformation ratio are shown in Tables 1 to 3, and the results of evaluation for the electrophotographic photosensitive member evaluation results are shown in Tables 4, 6 and 8.

Example 3

A conductive layer, an intermediate layer, a charge generation layer, a first charge transport layer, and second charge transport layer were formed on a support in the same manner as that in Example 2.

Next, a plurality of dimple-shaped concave portions were formed on the surface of a second charge transport layer by dry blasting under the same conditions as those of Example 2, except that the air (compressed air) blasting pressure was changed from 0.343 MPa (3.5 kgf/cm$^2$) to 0.196 MPa (2.0 kgf/cm$^2$).

The cylindrical electrophotographic photosensitive member thus prepared was provided on its support with a conductive layer, an intermediate layer, a charge generation layer, a first charge transport layer and a second charge transport layer (cured layer), wherein the second charge transport layer served as the surface layer, and wherein a plurality of dimple-shaped concave portions were formed on its peripheral surface.

Prepared in the same manner were an electrophotographic photosensitive member for universal hardness (HU) and elastic deformation ratio measurement, an electrophotographic photosensitive member for image evaluation in a high-temperature high-humidity environment, and an electrophotographic photosensitive member for rubbing memory evaluation.

Electrophotographic photosensitive member peripheral surface shape, universal hardness (HU) and elastic deformation ratio measurement and electrophotographic photosensitive member evaluation were carried out in the same manner as in Example 1. The results of measurement for the electrophotographic photosensitive member peripheral surface shape and the universal hardness (HU) and elastic deformation ratio are shown in Tables 1 to 3, and the results of evaluation of the electrophotographic photosensitive member are shown in Table 2.

Example 4

A conductive layer, an intermediate layer, a charge generation layer, and a first charge transport layer were formed on a support in the same manner as that in Example 1.

Next, 0.45 parts of a fluorine atom-containing resin (Trade name: GF-300; manufactured by Toagosei Co., Ltd.) as a dispersant were dissolved in a mixed solvent consisting of 35 parts of 1,1,2,2,3,3,4-heptafluorocyclopentane (Trade name: Zeorora-H; manufactured by Zeon Corporation) and 35 parts of 1-propanol. The resulting solution was added with 9 parts of tetrafluoroethylene resin particles (Trade name: LUBRON L-2; manufactured by Daikin Industries Ltd.) as a lubricant, then using a high pressure disperser (Trade name: Microfluidizer M-110EH; manufactured by Microfluidics Corporation, U.S.A), the resulting solution was subjected to dispersion treatment 3 times under a pressure of 5,880 N/cm$^2$ (600 kgf/cm$^2$) to thereby make the resulting solution uniformly dispersed.

The resulting solution was then filtered under pressure using a 10 μm membrane filter made from PTFE.

To this filtrate was added 21 parts of a compound (polymerizable functional group-containing hole transport compound) having a structure represented by the above formula (12), and the resulting solution was then filtered under pressure using a 5 μm membrane filter made from PTFE, to thereby prepare a coating solution for a second charge transport layer.

This coating solution for a second charge transport layer was applied onto the first charge transport layer by dipping coating, then held for 5 minutes at 100° C. to dry off the solvent in air.

The resulting product was irradiated with an electron beam in a nitrogen atmosphere (oxygen concentration 10 ppm) under the conditions of an accelerating voltage of 150 kV and a dosage of 15 kGy (1.5 Mrad), then heated in the same atmosphere for 90 seconds until the electrophotographic photosensitive member (i.e. the object being irradiated by the electron beam) temperature reached 120° C. The object was further heated for 20 minutes in air using a hot-air drier set to 100° C., to thereby form a 5 μm-thick cured second charge transport layer.

Next, a plurality of dimple-shaped concave portions were formed on the surface of the second charge transport layer by dry blasting under the same conditions as those of Example 1.

The cylindrical electrophotographic photosensitive member thus prepared was provided on its support with a conductive layer, an intermediate layer, a charge generation layer, a first charge transport layer and a second charge transport layer (cured layer), wherein the second charge transport layer served as the surface layer, and wherein a plurality of dimple-shaped concave portions were formed on its peripheral surface.

Prepared in the same manner were an electrophotographic photosensitive member for universal hardness (HU) and elastic deformation ratio measurement, an electrophotographic photosensitive member for image evaluation in a high-temperature high-humidity environment, and an electrophotographic photosensitive member for rubbing memory evaluation.

Electrophotographic photosensitive member peripheral surface shape, universal hardness (HU) and elastic deformation ratio measurement and electrophotographic photosensitive member evaluation were carried out in the same manner as in Example 1. The results of measurement for the electrophotographic photosensitive member peripheral surface shape and the universal hardness (HU) and elastic deformation ratio are shown in Tables 1 to 3, and the results of evaluation for the electrophotographic photosensitive member are shown in Tables 4, 6 and 8.

Example 5

A conductive layer, an intermediate layer, a charge generation layer, and a first charge transport layer were formed on a support in the same manner as that in Example 2.

Next, a coating solution for a second charge transport layer was prepared in the same manner as that in Example 2, except that the 27 parts of the compound having a structure represented by the above formula (12) were changed to 27 parts of a compound having a structure represented by the below formula (13):

(13)

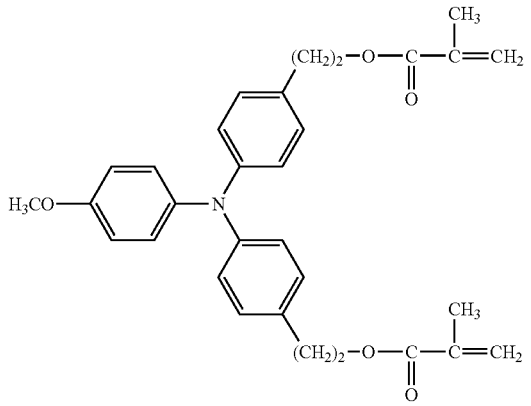

This coating solution for a second charge transport layer was applied onto the first charge transport layer by dipping, then held for 5 minutes at 100° C. to dry off the solvent in air.

The resulting product was irradiated with an electron beam in a nitrogen atmosphere (oxygen concentration 10 ppm) under the conditions of an accelerating voltage of 150 kV and a dosage of 15 kGy (1.5 Mrad), then heated in the same atmosphere for 90 seconds until the electrophotographic photosensitive member (i.e. the object being irradiated by the electron beam) temperature reached 120° C. The object was further heated for 20 minutes in air using a hot-air drier set to 100° C., to thereby form a 5 μm-thick cured second charge transport layer.

Next, a plurality of dimple-shaped concave portions were formed on the surface of the second charge transport layer by dry blasting under the same conditions as those of Example 2.

The cylindrical electrophotographic photosensitive member thus prepared was provided on its support with a conductive layer, an intermediate layer, a charge generation layer, a first charge transport layer and a second charge transport layer (cured layer), wherein the second charge transport layer served as the surface layer, and wherein a plurality of dimple-shaped concave portions were formed on its peripheral surface.

Prepared in the same manner were an electrophotographic photosensitive member for universal hardness (HU) and elastic deformation ratio measurement, an electrophotographic photosensitive member for image evaluation in a high-temperature high-humidity environment, and an electrophotographic photosensitive member for rubbing memory evaluation.

Electrophotographic photosensitive member peripheral surface shape, universal hardness (HU) and elastic deformation ratio measurement and electrophotographic photosensitive member evaluation were carried out in the same manner as in Example 1. The results of measurement for the electrophotographic photosensitive member peripheral surface shape and the universal hardness (HU) and elastic deformation ratio are shown in Tables 1 to 3, and the results of evaluation for the electrophotographic photosensitive member are shown in Tables 4, 6 and 8.

Example 6

A conductive layer, an intermediate layer, a charge generation layer, and a first charge transport layer were formed on a support in the same manner as that in Example 2.

Next, a coating solution for a second charge transport layer was prepared in the same manner as that in Example 2, except that the 27 parts of the compound having a structure represented by the above formula (12) were changed to 27, parts of a compound having the structure represented by the below formula (14):

(14)

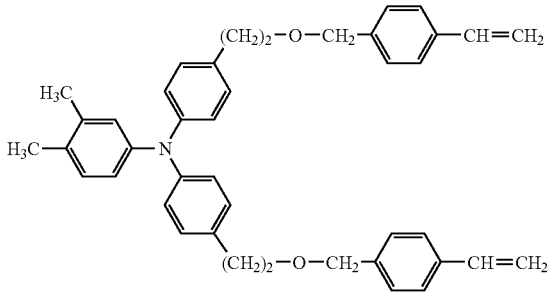

This coating solution for a second charge transport layer was applied onto the first charge transport layer by dipping, then held for 5 minutes at 100° C. to dry off the solvent in air.

The resulting product was irradiated with an electron beam in a nitrogen atmosphere (oxygen concentration 10 ppm) under the conditions of an accelerating voltage of 150 kV and a dosage of 15 kGy (1.5 Mrad), then heated in the same atmosphere for 90 seconds until the electrophotographic photosensitive member (i.e. the object being irradiated by the electron beam) temperature reached 120° C. The object was further heated for 20 minutes in air using a hot-air drier set to 100° C., to thereby form a 5 μm-thick cured second charge transport layer.

Next, a plurality of dimple-shaped concave portions were formed on the surface of the second charge transport layer by dry blasting under the same conditions as those of Example 2.

The cylindrical electrophotographic photosensitive member thus formed was provided on its support with a conductive layer, an intermediate layer, a charge generation layer, a first charge transport layer and a second charge transport layer (cured layer), wherein the second charge transport layer served as the surface layer, and wherein a plurality of dimple-shaped concave portions were formed on its peripheral surface.

Prepared in the same manner were an electrophotographic photosensitive member for universal hardness (HU) and elastic deformation ratio measurement, an electrophotographic photosensitive member for image evaluation under a high-temperature high-humidity environment, and an electrophotographic photosensitive member for rubbing memory evaluation.

Electrophotographic photosensitive member peripheral surface shape, universal hardness (HU) and elastic deformation ratio measurement and electrophotographic photosensitive member evaluation were carried out in the same manner as in Example 1. The results of measurement for the electrophotographic photosensitive member peripheral surface shape and the universal hardness (HU) and elastic deformation ratio are shown in Tables 1 to 3, and the results of evaluation for the electrophotographic photosensitive member are shown in Tables 4, 6 and 8.

Example 7

A conductive layer, an intermediate layer, a charge generation layer, and a first charge transport layer were formed on a support in the same manner as that in Example 2.

Next, a coating solution for a second charge transport layer was prepared in the same manner as that in Example 2, except that the 27 parts of the compound having a structure represented by the above formula (12) were changed to 27 parts of a compound having the structure represented by the below formula (15):

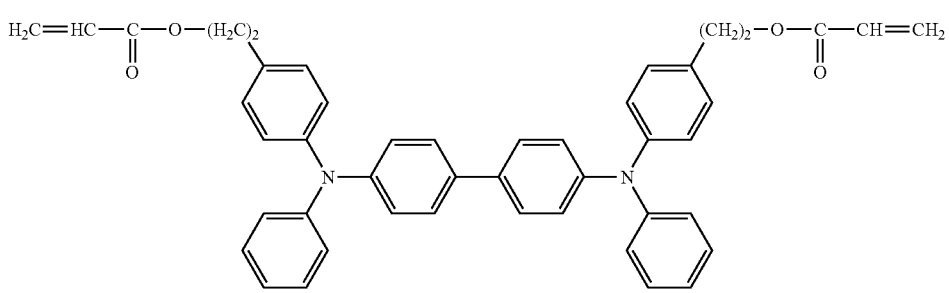

(15)

This coating solution for a second charge transport layer was applied onto the first charge transport layer by dipping coating, then held for 5 minutes at 100° C. to dry off the solvent in air.

The resulting product was irradiated with an electron beam in a nitrogen atmosphere (oxygen concentration 10 ppm) under the conditions of an accelerating voltage of 150 kV and a dosage of 15 kGy (1.5 Mrad), then heated in the same atmosphere for 90 seconds until the electrophotographic photosensitive member (i.e. the object being irradiated by the electron beam) temperature reached 120° C. The object was further heated for 20 minutes in air using a hot-air drier set to 100° C., to thereby form a 5 μm-thick cured second charge transport layer.

Next, a plurality of dimple-shaped concave portions were formed on the surface of the second charge transport layer by dry blasting under the same conditions as those in Example 2.

The cylindrical electrophotographic photosensitive member thus formed was provided on its support with a conductive layer, an intermediate layer, a charge generation layer, a first charge transport layer and a second charge transport layer (cured layer), wherein the second charge transport layer served as the surface layer, and wherein a plurality of dimple-shaped concave portions were formed on its peripheral surface.

Prepared in the same manner were an electrophotographic photosensitive member for universal hardness (HU) and elastic deformation ratio measurement, an electrophotographic photosensitive member for image evaluation under a high-temperature high-humidity environment, and an electrophotographic photosensitive member for rubbing memory evaluation.

Electrophotographic photosensitive member peripheral surface shape, universal hardness (HU) and elastic deformation ratio measurement and electrophotographic photosensitive member evaluation were carried out in the same manner as in Example 1. The results of measurement for the electrophotographic photosensitive member peripheral surface shape and the universal hardness (HU) and elastic deformation ratio are shown in Tables 1 to 3, and the results of evaluation for the electrophotographic photosensitive member are shown in Tables 4, 6 and 8.

Example 8

A conductive layer, an intermediate layer, a charge generation layer, and a first charge transport layer were formed on a support in the same manner as that in Example 2.

Next, the same solution as the Example 2 coating solution for a second charge transport layer was further added with 3 parts of a compound (photopolymerization initiator) having the structure represented by the below formula (16):

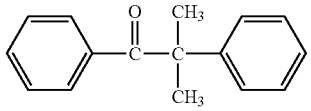

(16)

which resulting solution was used as a coating solution for a second charge transport layer.

This coating solution for a second charge transport layer was applied onto the first charge transport layer by dipping coating, and then cured by irradiating with light having an intensity of 500 mW/cm$^2$ for 60 seconds from a metal halide lamp. The cured layer was heated for 60 minutes in a hot-air drier set to 120° C., to thereby form a 5 μm-thick cured second charge transport layer.

Next, a plurality of dimple-shaped concave portions were formed on the surface of the second charge transport layer by dry blasting under the same conditions as those in Example 2.

The cylindrical electrophotographic photosensitive member thus formed was provided on its support with a conductive layer, an intermediate layer, a charge generation layer, a first charge transport layer and a second charge transport layer (cured layer), wherein the second charge transport layer served as the surface layer, and wherein a plurality of dimple-shaped concave portions were formed on its peripheral surface.

Prepared in the same manner were an electrophotographic photosensitive member for universal hardness (HU) and elastic deformation ratio measurement, an electrophotographic photosensitive member for image evaluation under a high-temperature high-humidity environment, and an electrophotographic photosensitive member for rubbing memory evaluation.

Electrophotographic photosensitive member peripheral surface shape, universal hardness (HU) and elastic deformation ratio measurement and electrophotographic photosensitive member evaluation were carried out in the same manner as in Example 1. The results of measurement for the electrophotographic photosensitive member peripheral surface shape and the universal hardness (HU) and elastic deformation ratio are shown in Tables 1 to 3, and the results of evaluation for the electrophotographic photosensitive member are shown in Tables 4, 6 and 8.

Example 9

A conductive layer, an intermediate layer, a charge generation layer, and a first charge transport layer were formed on a support in the same manner as that in Example 8.

Next, a coating solution for a second charge transport layer was prepared in the same manner as that in Example 8, except that the 27 parts of the compound having a structure represented by the above formula (12) were changed to 27 parts of a compound having a structure represented by the above formula (15).

This coating solution for a second charge transport layer was applied onto the first charge transport layer by dipping coating, which was then cured by irradiating with light having an intensity of 500 mW/cm$^2$ for 60 seconds from a metal halide lamp. The cured layer was heated for 60 minutes in a hot-air drier set to 120° C., to thereby form a 5 μm-thick cured second charge transport layer.

Next, a plurality of dimple-shaped concave portions were formed on the surface of the second charge transport layer by dry blasting under the same conditions as those in Example 8.

The cylindrical electrophotographic photosensitive member thus formed was provided on its support with a conductive layer, an intermediate layer, a charge generation layer, a first charge transport layer and a second charge transport layer (cured layer), wherein the second charge transport layer served as the surface layer, and wherein a plurality of dimple-shaped concave portions were formed on its peripheral surface.

Prepared in the same manner were an electrophotographic photosensitive member for universal hardness (HU) and elastic deformation ratio measurement, an electrophotographic photosensitive member for image evaluation under a high-temperature high-humidity environment, and an electrophotographic photosensitive member for rubbing memory evaluation.

Electrophotographic photosensitive member peripheral surface shape, universal hardness (HU) and elastic deformation ratio measurement and electrophotographic photosensitive member evaluation were carried out in the same manner as in Example 1. The results of measurement for the electrophotographic photosensitive member peripheral surface shape and the universal hardness (HU) and elastic deformation ratio are shown in Tables 1 to 3, and the results of evaluation for the electrophotographic photosensitive member are shown in Tables 4, 6 and 8.

Example 10

A conductive layer, an intermediate layer, and a charge generation layer were formed on a support in the same manner as that in Example 1.

Next, 70 parts of a compound having the structure represented by the above formula 12 were dissolved in a mixed solvent consisting of 15 parts of 1,1,2,2,3,3,4-heptafluorocyclopentane and 15 parts of 1-propanol. The resulting solution was then filtered under pressure using a 0.5 μm membrane filter made from PTFE, to thereby prepare a coating solution for a charge transport layer.

This coating solution for a charge transport layer was applied onto the charge generation layer by dipping, then held for 5 minutes at 100° C. to dry off the solvent in air.

The resulting product was irradiated with an electron beam in a nitrogen atmosphere (oxygen concentration 10 ppm) under the conditions of an accelerating voltage of 150 kV and a dosage of 50 kGy (5 Mrad), then heated in the same atmosphere for 90 seconds until the electrophotographic photosensitive member (i.e. the object being irradiated by the electron beam) temperature reached 120° C. The object was further heated for 20 minutes in air using a hot-air drier set to 100° C., to thereby form a 10 μm-thick cured charge transport layer.

Next, a plurality of dimple-shaped concave portions were formed on the surface of the charge transport layer by dry blasting under the same conditions as those used for the dry blasting of the surface of the second charge transport layer in Example 1, except that the air (compressed air) blasting pressure was changed from 0.343 MPa (3.5 kgf/cm$^2$) to 0.441 MPa (4.5 kgf/cm$^2$).

The cylindrical electrophotographic photosensitive member thus formed was provided on its support with a conductive layer, an intermediate layer, a charge generation layer, and a charge transport layer (cured layer), wherein the charge transport layer served as the surface layer, and wherein a plurality of dimple-shaped concave portions were formed on its peripheral surface.

Prepared in the same manner were an electrophotographic photosensitive member for universal hardness (HU) and elastic deformation ratio measurement, an electrophotographic photosensitive member for image evaluation under a high-temperature high-humidity environment, and an electrophotographic photosensitive member for rubbing memory evaluation.

Electrophotographic photosensitive member peripheral surface shape, universal hardness (HU) and elastic deformation ratio measurement and electrophotographic photosensitive member evaluation were carried out in the same manner as in Example 1. The results of measurement for the electrophotographic photosensitive member peripheral surface shape and the universal hardness (HU) and elastic deformation ratio are shown in Tables 1 to 3, and the results of evaluation for the electrophotographic photosensitive member are shown in Tables 4, 6 and 8.

Example 11

A conductive layer, an intermediate layer, and a charge generation layer were formed on a support in the same manner as that in Example 1.

Next, 0.35 parts of a fluorine atom-containing resin (Trade name: GF-300; manufactured by Toagosei Co., Ltd.) as a dispersant were dissolved in a mixed solvent consisting of 15 parts of 1,1,2,2,3,3,4-heptafluorocyclopentane (Trade name: Zeorora-H; manufactured by Nippon Zeon Corporation) and 15 parts of 1-propanol. The resulting solution was added with 7 parts of tetrafluoroethylene resin particles (Trade name: LUBRON L-2; manufactured by Daikin Industries Ltd.) as a lubricant, then using a high pressure disperser (Trade name: Microfluidizer M-110EH; manufactured by Microfluidics Corporation), and subjected to dispersion treatment 3 times under a pressure of 5,880 N/cm$^2$ (0.600 kgf/cm$^2$), to thereby make the resulting solution uniformly dispersed.

The resulting solution was then filtered under pressure using a 10 μm membrane filter made from PTFE.

This filtrate was added with 63 parts of a compound (polymerizable functional group-containing positive hole transport compound) having a structure represented by the above formula (12), and the resulting solution was then filtered under pressure using a 10 μm membrane filter made from PTFE, to thereby prepare a coating solution for a charge transport layer.

This coating solution for a charge transport layer was applied onto the charge generation layer by dipping, then held for 5 minutes at 100° C. to dry off the solvent in air.

The resulting product was irradiated with an electron beam in a nitrogen atmosphere (oxygen concentration 10 ppm) under the conditions of an accelerating voltage of 150 kV and a dosage of 50 kGy (5 Mrad), then heated in the same atmosphere for 90 seconds until the electrophotographic photosensitive member (i.e. the object being irradiated by the electron beam) temperature reached 120° C. The object was further heated for 20 minutes in air using a hot-air drier set to 100° C., to thereby form a 10 μm-thick cured charge transport layer.

Next, a plurality of dimple-shaped concave portions were formed on the surface of the charge transport layer by dry blasting under the same conditions as those used in Example 10.

The cylindrical electrophotographic photosensitive member thus formed was provided on its support with a conductive layer, an intermediate layer, a charge generation layer and a charge transport layer (cured layer), wherein the charge transport layer served as the surface layer, and wherein a plurality of dimple-shaped concave portions were formed on its peripheral surface.

Prepared in the same manner were an electrophotographic photosensitive member for universal hardness (HU) and elastic deformation ratio measurement, an electrophotographic photosensitive member for image evaluation under a high-temperature high-humidity environment, and an electrophotographic photosensitive member for rubbing memory evaluation.

Electrophotographic photosensitive member peripheral surface shape, universal hardness (HU) and elastic deformation ratio measurement and electrophotographic photosensitive member evaluation were carried out in the same manner as in Example 1. The results of measurement for the electrophotographic photosensitive member peripheral surface shape and the universal hardness (HU) and elastic deformation ratio are shown in Tables 1 to 3, and the results of evaluation for the electrophotographic photosensitive member are shown in Tables 4, 6 and 8.

Example 12

A conductive layer, an intermediate layer, a charge generation layer, and a first charge transport layer were formed on a support in the same manner as that in Example 1.

Next, 30 parts of a hydroxymethyl group-containing phenol compound having a heat-curable positive hole transporting structure represented by the below formula (17):

(17)

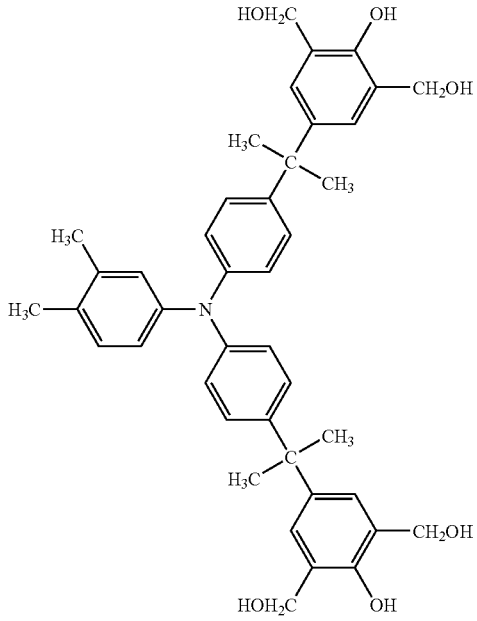

were dissolved in a mixed solvent consisting of 35 parts of methanol and 35 parts of ethanol. The resulting solution was then filtered under pressure using a 0.2 μm membrane filter made from PTFE, to thereby prepare a coating solution for a second charge transport layer.

This coating solution for a second charge transport layer was applied onto the first charge transport layer by dipping and then heat-cured for 1 hour in a hot-air drier set to 145° C., to thereby form a 5 μm-thick second charge transport layer.

Next, a plurality of dimple-shaped concave portions were formed on the surface of the second charge transport layer by dry blasting under the same conditions as those of Example 1.

The cylindrical electrophotographic photosensitive member thus formed was provided on its support with a conductive layer, an intermediate layer, a charge generation layer, a first charge transport layer and a second charge transport layer (cured layer), wherein the second charge transport layer served as the surface layer, and wherein a plurality of dimple-shaped concave portions were formed on its peripheral surface.

Prepared in the same manner were an electrophotographic photosensitive member for universal hardness (HU) and elastic deformation ratio measurement, an electrophotographic photosensitive member for image evaluation under a high-temperature high-humidity environment, and an electrophotographic photosensitive member for rubbing memory evaluation.

Electrophotographic photosensitive member peripheral surface shape, universal hardness (HU) and elastic deformation ratio measurement and electrophotographic photosensitive member evaluation were carried out in the same manner as in Example 1. The results of measurement for the electrophotographic photosensitive member peripheral surface shape and the universal hardness (HU) and elastic deformation ratio are shown in Tables 1 to 3, and the results of evaluation for the electrophotographic photosensitive member are shown in Tables 4, 6 and 8.

Example 13

A conductive layer, an intermediate layer, a charge generation layer and a first charge transport layer were formed on a support in the same manner as that in Example 1.

Next, 0.34 parts of a fluorine atom-containing resin (Trade name: Surflon S-381; manufactured by Seimi Chemical Co., Ltd.) as a dispersant were dissolved in a mixed solvent consisting of 35 parts of methanol and 35 parts of ethanol. The resulting solution was added with 3 parts of tetrafluoroethylene resin particles (Trade name: LUBRON L-2; manufactured by Daikin Industries Ltd.) as a lubricant, then using a high pressure disperser (Trade name: Microfluidizer M-110EH; manufactured by Microfluidics Corporation, U.S.A), subjected to dispersion treatment 3 times under a pressure of 5,880 N/cm$^2$ (600 kgf/cm$^2$), to thereby make the resulting solution uniformly dispersed.

The resulting solution was then filtered under pressure using a 10 μm membrane filter made from PTFE. This filtrate was dissolved with 27 parts of a hydroxymethyl group-containing phenol compound having the heat-curable positive hole transporting structure represented by the above formula (17), and the resulting solution was then filtered under pressure using a 0.5 μm membrane filter made from PTFE to prepare a coating solution for a second charge transport layer.

This coating solution for a second charge transport layer was applied onto the first charge transport layer by dipping, and then heat-cured for 1 hour in a hot-air drier set to 145° C., to thereby form a 5 μm-thick second charge transport layer.

Next, a plurality of dimple-shaped concave portions were formed on the surface of the second charge transport layer by dry blasting under the same conditions as those of Example 1.

The cylindrical electrophotographic photosensitive member thus formed was provided on its support with a conductive layer, an intermediate layer, a charge generation layer, a first charge transport layer and a second charge transport layer (cured layer), wherein the second charge transport layer served as the surface layer, and wherein a plurality of dimple-shaped concave portions were formed on its peripheral surface.

Prepared in the same manner were an electrophotographic photosensitive member for universal hardness (HU) and elastic deformation ratio measurement, an electrophotographic photosensitive member for image evaluation under a high-temperature high-humidity environment, and an electrophotographic photosensitive member for rubbing memory evaluation.

Electrophotographic photosensitive member peripheral surface shape, universal hardness (HU) and elastic deformation ratio measurement and electrophotographic photosensitive member evaluation were carried out in the same manner as in Example 1. The results of measurement for the electrophotographic photosensitive member peripheral surface shape and the universal hardness (HU) and elastic deformation ratio are shown in Tables 1 to 3, and the results of evaluation for the electrophotographic photosensitive member are shown in Tables 4, 6 and 8.

Example 14

A conductive layer, an intermediate layer, a charge generation layer and a first charge transport layer were formed on a support in the same manner as that in Example 1.

Next, 0.34 parts of a fluorine atom-containing resin (Trade name: Surflon S-381; manufactured by Seimi Chemical Co., Ltd.) as a dispersant were dissolved in a mixed solvent consisting of 35 parts of methanol and 35 parts of ethanol. The resulting solution was added with 3 parts of tetrafluoroethylene resin particles (Trade name: LUBRON L-2; manufactured by Daikin Industries Ltd.) as a lubricant, then using a high pressure disperser (Trade name: Microfluidizer M-110EH; manufactured by Microfluidics Corporation), subjected to dispersion treatment 3 times under a pressure of 5,880 N/cm$^2$ (600 kgf/cm$^2$), to thereby make the resulting solution uniformly dispersed.

The resulting solution was then filtered under pressure using a 10 μm membrane filter made from PTFE.

Into this filtrate were dissolved 21.2 parts of a resol-type phenolic resin varnish (Trade name: PL-4852; manufactured by Gunei Chemical Industry Co., Ltd.; non-volatile component: 75%) and 11.1 parts of a compound (charge transport substance) having the structure represented by the below formula (18):

(18)

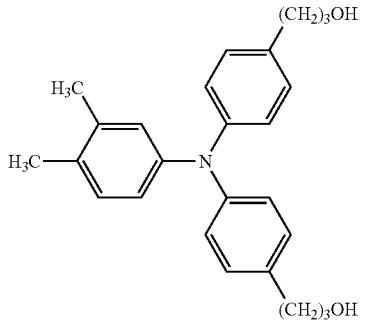

and the resulting solution was then filtered under pressure using a 5 μm membrane filter made from PTFE to thereby prepare a coating solution for a second charge transport layer.

This coating solution for a second charge transport layer was applied onto the first charge transport layer by dipping, and then heat-cured for 1 hour in a hot-air drier set to 145° C., to thereby form a 5 μm-thick second charge transport layer.

Next, a plurality of dimple-shaped concave portions were formed on the surface of the second charge transport layer by dry blasting under the same conditions as those of Example 1.

The cylindrical electrophotographic photosensitive member thus formed was provided on its support with a conductive layer, an intermediate layer, a charge generation layer, a first charge transport layer and a second charge transport layer (cured layer), wherein the second charge transport layer served as the surface layer, and wherein a plurality of dimple-shaped concave portions were formed on its peripheral surface.

Prepared in the same manner were an electrophotographic photosensitive member for universal hardness (HU) and elastic deformation ratio measurement, an electrophotographic photosensitive member for image evaluation under a high-temperature high-humidity environment, and an electrophotographic photosensitive member for rubbing memory evaluation.

Electrophotographic photosensitive member peripheral surface shape, universal hardness (HU) and elastic deformation ratio measurement and electrophotographic photosensitive member evaluation were carried out in the same manner as in Example 1. The results of measurement for the electrophotographic photosensitive member peripheral surface shape and the universal hardness (HU) and elastic deformation ratio are shown in Tables 1 to 3, and the results of evaluation for the electrophotographic photosensitive member are shown in Tables 4, 6 and 8.

Example 15

A conductive layer, an intermediate layer and a charge generation layer were formed on a support in the same manner as that in Example 1. A layer the same as that of the first charge transport layer of Example 1 was formed on the charge generation layer as a charge transport layer.

Next, 100 parts of antimony-doped tin oxide particles (Trade name: T-1; manufactured by Mitsubishi Material Corporation; average particle diameter: 0.02 μm) were surface treated with 7 parts of a fluorine atom-containing compound (Trade name: LS-1090; manufactured by Shin-Etsu Chemical Co., Ltd.) having a structure represented by the below formula (19) (hereinafter referred to as "surface treatment amount 7%").

(19)

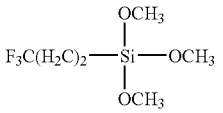

Next, 50 parts of the surface-treated antimony-doped tin oxide particles and 150 parts of ethanol were dispersed using a sand mill for 60 hours. This dispersion was added with 20 parts of tetrafluoroethylene resin particles (Trade name: LUBRON L-2; manufactured by Daikin Industries Ltd.), and again dispersed using a sand mill for 8 hours.

The resulting dispersion was then dissolved with 30 parts of a resol-type phenolic resin varnish (Trade name: PL-4804; manufactured by Gunei Chemical Industry Co., Ltd.), to thereby prepare a coating solution for a protective layer.

This coating solution for a protective layer was applied onto the charge transport layer by dipping, and then heat-cured for 1 hour in a hot-air drier set to 145° C., to thereby form a 5 μm-thick protective layer.

Next, a plurality of dimple-shaped concave portions were formed on the surface of the protective layer by dry blasting under the same conditions as those for the dry blasting of the surface of the second charge transport layer in Example 1.

The cylindrical electrophotographic photosensitive member thus formed was provided with on a support a conductive layer, an intermediate layer, a charge generation layer, a charge transport layer and a protective layer (cured layer), wherein the protective layer served as the surface layer, and wherein a plurality of dimple-shaped concave portions were formed on its peripheral surface.

Prepared in the same manner were an electrophotographic photosensitive member for universal hardness (HU) and elastic deformation ratio measurement, an electrophotographic photosensitive member for image evaluation under a high-temperature high-humidity environment, and an electrophotographic photosensitive member for rubbing memory evaluation.

Electrophotographic photosensitive member peripheral surface shape, universal hardness (HU) and elastic deformation ratio measurement and electrophotographic photosensitive member evaluation were carried out in the same manner as in Example 1. The results of measurement for the electrophotographic photosensitive member peripheral surface shape and the universal hardness (HU) and elastic deformation ratio are shown in Tables 1 to 3, and the results of evaluation for the electrophotographic photosensitive member are shown in Tables 4, 6 and 8.

Example 16

A conductive layer, an intermediate layer and a charge generation layer were formed on a support in the same manner as that in Example 1. A layer the same as that of the first charge transport layer of Example 1 was formed on the charge generation layer as a charge transport layer.

Next, 45 parts of surface-treated antimony-doped tin oxide particles, which were the same as the surface-treated antimony-doped tin oxide particles of Example 15, 18 parts of a acrylic resin monomer having a structure represented by the below formula (20):

(20)

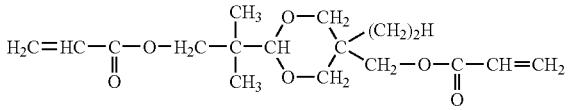

6.8 parts of 2-methylthioxanthone (photopolymerization initiator), 14 parts of tetrafluoroethylene resin particles (LUBRON L-2) and 150 parts of ethanol were dispersed using a sand mill for 90 hours, to thereby prepare a protective layer coating solution.

This coating solution for a protective layer was applied onto the charge transport layer by dipping, dried and then cured by irradiating for 60 seconds with UV-rays having an intensity of 250 W/cm$^2$ using a high-pressure mercury lamp. The cured layer was then dried in 120° C. hot-air for 2 hours, to thereby form a 5 μm-thick cured protective layer.

Next, a plurality of dimple-shaped concave portions were formed on the surface of the protective layer by dry blasting under the same conditions as those for the dry blasting of the surface of the second charge transport layer in Example 1.

The cylindrical electrophotographic photosensitive member thus formed was provided on its support with a conductive layer, an intermediate layer, a charge generation layer, a charge transport layer and a protective layer (cured layer), wherein the protective layer served as the surface layer, and wherein a plurality of dimple-shaped concave portions were formed on its peripheral surface.

Prepared in the same manner were an electrophotographic photosensitive member for universal hardness (HU) and elastic deformation ratio measurement, an electrophotographic photosensitive member for image evaluation under a high-temperature high-humidity environment, and an electrophotographic photosensitive member for rubbing memory evaluation.

Electrophotographic photosensitive member peripheral surface shape, universal hardness (HU) and elastic deformation ratio measurement and electrophotographic photosensitive member evaluation were carried out in the same manner as in Example 1. The results of measurement for the electrophotographic photosensitive member peripheral surface shape and the universal hardness (HU) and elastic deformation ratio are shown in Tables 1 to 3, and the results of evaluation for the electrophotographic photosensitive member are shown in Tables 4, 6 and 8.

Example 17

A conductive layer, an intermediate layer and a charge generation layer were formed on a support in the same manner as that in Example 1. A layer the same as that of the first charge transport layer of Example 1 was also formed on the charge generation layer as a charge transport layer.

Next, 10 parts of surface-treated antimony-doped tin oxide particles, which were the same as the surface-treated antimony-doped tin oxide particles of Example 15, 200 parts of a methylethylketone and 200 parts of 1,4-dioxane were dispersed using a sand mill for 66 hours.

This dispersion was added with 6 parts of a heat-curable epoxy resin monomer having the structure represented by the below formula (21):

(21)

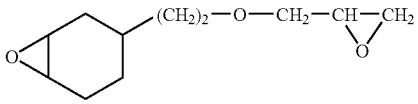

and 1.4 parts of an acid anhydride (curing catalyst) having the structure represented by the below formula (22):

(22)

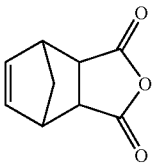

to thereby prepare a coating solution for a protective layer.

This coating solution for a protective layer was spray coated onto the charge transport layer, heated for 30 minutes at 80° C., then again heated for 2 hours at 130° C. The resulting product was then subjected to heat-curing, to thereby form a 5 μm-thick protective layer.

Next, a plurality of dimple-shaped concave portions were formed on the surface of the protective layer by dry blasting under the same conditions as those for the dry blasting of the surface of the second charge transport layer in Example 1.

The cylindrical electrophotographic photosensitive member thus formed was provided on its support with a conductive layer, an intermediate layer, a charge generation layer, a charge transport layer and a protective layer (cured layer), wherein the protective layer served as the surface layer, and wherein a plurality of dimple-shaped concave portions were formed on its peripheral surface.

Prepared in the same manner were an electrophotographic photosensitive member for universal hardness (HU) and elastic deformation ratio measurement, an electrophotographic photosensitive member for image evaluation under a high-temperature high-humidity environment, and an electrophotographic photosensitive member for rubbing memory evaluation.

Electrophotographic photosensitive member peripheral surface shape, universal hardness (HU) and elastic deformation ratio measurement and electrophotographic photosensitive member evaluation were carried out in the same manner as in Example 1. The results of measurement for the electrophotographic photosensitive member peripheral surface shape and the universal hardness (HU) and elastic deformation ratio are shown in Tables 1 to 3, and the results of evaluation for the electrophotographic photosensitive member are shown in Tables 4, 6 and 8.

Example 18

A conductive layer, an intermediate layer, a charge generation layer and a first charge transport layer were formed on a support in the same manner as that in Example 1.

Next, 10 parts of a compound (charge transport substance) having the structure represented by the above formula (18) and 20 parts of a solution of a biuret modified compound (solid content 67% by weight) having the structure represented by the below formula (23):

(23)

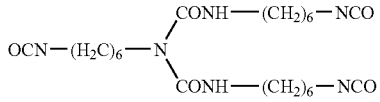

were dissolved in a mixed solvent of 350 parts of tetrahydrofuran and 150 parts of cyclohexanone, to thereby prepare a coating solution for a second charge transport layer.

This coating solution for a second charge transport layer was spray coated onto the first charge transport layer, left for 30 minutes at room temperature, then cured in 145° C. hot-air for 1 hour, to thereby form a 5 μm-thick second charge transport layer.

Next, a plurality of dimple-shaped concave portions were formed on the surface of the second charge transport layer by dry blasting under the same conditions as those in Example 1.

The cylindrical electrophotographic photosensitive member thus formed was provided on its support with a conductive layer, an intermediate layer, a charge generation layer, a first charge transport layer and a second charge transport layer (cured layer), wherein the second charge transport layer served as the surface layer, and wherein a plurality of dimple-shaped concave portions were formed on its peripheral surface.

Prepared in the same manner were an electrophotographic photosensitive member for universal hardness (HU) and elastic deformation ratio measurement, an electrophotographic photosensitive member for image evaluation under a high-temperature high-humidity environment, and an electrophotographic photosensitive member for rubbing memory evaluation.

Electrophotographic photosensitive member peripheral surface shape, universal hardness (HU) and elastic deformation ratio measurement and electrophotographic photosensitive member evaluation were carried out in the same manner as in Example 1. The results of measurement for the electrophotographic photosensitive member peripheral surface shape and the universal hardness (HU) and elastic deformation ratio are shown in Tables 1 to 3, and the results of evaluation for the electrophotographic photosensitive member are shown in Tables 4, 6 and 8.

Example 19

A conductive layer, an intermediate layer, a charge generation layer and a first charge transport layer were formed on a support in the same manner as that in Example 1.

Next, 10 parts of a compound (charge transport substance) having the structure represented by the above formula (18) were added with a heat-curable silicone resin (Tosguard 510; manufactured by GE Toshiba Silicones Co., Ltd.), having a hydrolysis-condensation product of trialkoxysilane and tetraalkoxysilane as a main component, in an amount which made the non-volatile component of the binder resin equal 13 parts. The resulting mixture was added with 2-propanol so that the solid content reached 30% by weight, to thereby prepare a coating solution for a second charge transport layer.

This coating solution for a second charge transport layer was applied onto the first charge transport layer by dipping, heated for 60 minutes at 130° C. The resulting product was then subjected to heat-curing, to thereby form a 5 μm-thick second charge transport layer.

Next, a plurality of dimple-shaped concave portions were formed on the surface of the second charge transport layer by dry blasting under the same conditions as those in Example 1.

The cylindrical electrophotographic photosensitive member thus formed was provided on its support with a conductive layer, an intermediate layer, a charge generation layer, a first charge transport layer and a second charge transport layer (cured layer), wherein the second charge transport layer served as the surface layer, and wherein a plurality of dimple-shaped concave portions were formed on its peripheral surface.

Prepared in the same manner were an electrophotographic photosensitive member for universal hardness (HU) and elastic deformation ratio measurement, an electrophotographic photosensitive member for image evaluation under a high-temperature high-humidity environment, and an electrophotographic photosensitive member for rubbing memory evaluation.

Electrophotographic photosensitive member peripheral surface shape, universal hardness (HU) and elastic deformation ratio measurement and electrophotographic photosensitive member evaluation were carried out in the same manner as in Example 1.

The results of measurement for the electrophotographic photosensitive member peripheral surface shape and the universal hardness (HU) and elastic deformation ratio are shown in Tables 1 to 3, and the results of evaluation for the electrophotographic photosensitive member are shown in Tables 4, 6 and 8.

Example 20

A conductive layer, an intermediate layer and a charge generation layer were formed on a support in the same manner as that in Example 1.

Next, 36 parts of a compound (charge transport substance) having the structure represented by the above formula (11), 4 parts of a compound (charge transport substance) having the structure represented by the below formula (24):

(24)

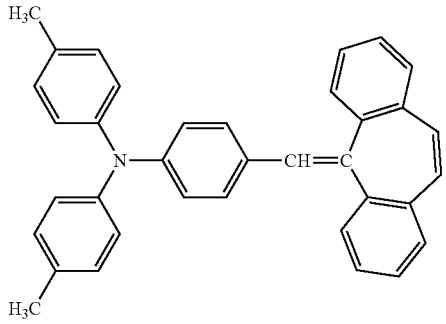

and 50 parts of a binary copolymer polyarylate resin having repeating units as represented by the below formula (25a) and repeating units as represented by the below formula (25b) (copolymer ratio of (25a):(25b) being 7:3; weight average molecular weight of 130,000; phthalic acid skeletons of (25a) and (25b) both having a tere:iso mole ratio of 1:1):

(25a)

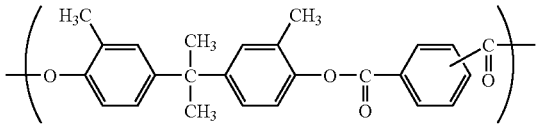

(25b)

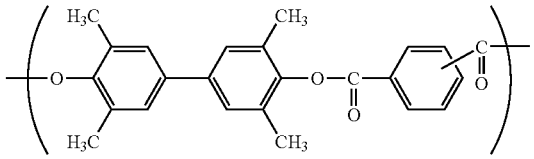

were dissolved in a mixed solvent of 350 parts of monochlorobenzene and 50 parts of dimethoxymethane, to thereby prepare a coating solution for a charge transport layer.

This coating solution for a charge transport layer was applied onto the charge generation layer by dipping, and dried for 60 minutes in a hot-air drier set to 110° C., to thereby form a 20 μm-thick charge transport layer.

Next, a plurality of dimple-shaped concave portions were formed on the surface of the charge transport layer by dry blasting under the same conditions as those used for the dry blasting of the surface of the second charge transport layer in Example 1, except that the air (compressed air) blasting pressure was changed from 0.343 MPa (3.5 kgf/cm$^2$) to 0.098 MPa (1.0 kgf/cm$^2$).

The cylindrical electrophotographic photosensitive member thus formed was provided on its support with a conductive layer, an intermediate layer, a charge generation layer and a charge transport layer, wherein the charge transport layer served as the surface layer, and wherein a plurality of dimple-shaped concave portions were formed on its peripheral surface.

Prepared in the same manner were an electrophotographic photosensitive member for universal hardness (HU) and elastic deformation ratio measurement, an electrophotographic photosensitive member for image evaluation under a high-temperature high-humidity environment, and an electrophotographic photosensitive member for rubbing memory evaluation.

Electrophotographic photosensitive member peripheral surface shape, universal hardness (HU) and elastic deformation ratio measurement and electrophotographic photosensitive member evaluation were carried out in the same manner as in Example 1. The results of measurement for the electrophotographic photosensitive member peripheral surface shape and the universal hardness (HU) and elastic deformation ratio are shown in Tables 1 to 3, and the results of evaluation for the electrophotographic photosensitive member are shown in Tables 4, 6 and 8.

In addition, at the 34,000 sheet output mark, the electrophotographic photosensitive member according to the present embodiment became charge-defective due to a reduction in the surface layer film thickness caused by abrasion, whereby the durability test could not be continued. Therefore, data for the results of 50,000-sheet durability test could not be obtained.

Example 21

A conductive layer, an intermediate layer and a charge generation layer were formed on a support in the same manner as that in Example 1. A layer the same as that of the first charge transport layer of Example 1 was also formed on the charge generation layer as a charge transport layer.

Next, a plurality of dimple-shaped concave portions were formed on the surface of the charge transport layer by dry blasting under the same conditions as those used for the dry blasting of the surface of the second charge transport layer in Example 1, except that the air (compressed air) blasting pressure was changed from 0.343 MPa (3.5 kgf/cm$^2$) to 0.0784 MPa (0.8 kgf/cm$^2$).

The cylindrical electrophotographic photosensitive member thus formed was provided on its support with a conductive layer, an intermediate layer, a charge generation layer and a charge transport layer, wherein the charge transport layer served as the surface layer, and wherein a plurality of dimple-shaped concave portions were formed on its peripheral surface.

Prepared in the same manner were an electrophotographic photosensitive member for universal hardness (HU) and elastic deformation ratio measurement, an electrophotographic photosensitive member for image evaluation under a high-temperature high-humidity environment, and an electrophotographic photosensitive member for rubbing memory evaluation.

Electrophotographic photosensitive member peripheral surface shape, universal hardness (HU) and elastic deformation ratio measurement and electrophotographic photosensitive member evaluation were carried out in the same manner as in Example 1. The results of measurement for the electrophotographic photosensitive member peripheral surface shape and the universal hardness (HU) and elastic deformation ratio are shown in Tables 1 to 3, and the results of evaluation for the electrophotographic photosensitive member are shown in Tables 4, 6 and 8.

In addition, at the 28,000 sheet output mark, the electrophotographic photosensitive member according to the present embodiment became charge-defective due to a reduction in the surface layer film thickness caused by abrasion, whereby the durability test could not be continued. Therefore, data for the results of 50,000-sheet durability test could not be obtained.

Comparative Example 1

An electrophotographic photosensitive member was prepared in the same manner as that in Example 2, except that the dry-blasting of the second charge transport layer surface in Example 2 was not carried out.

Prepared in the same manner were an electrophotographic photosensitive member for universal hardness (HU) and elastic deformation ratio measurement, an electrophotographic photosensitive member for image evaluation under a high-temperature high-humidity environment, and an electrophotographic photosensitive member for rubbing memory evaluation.

Electrophotographic photosensitive member peripheral surface shape, universal hardness (HU) and elastic deformation ratio measurement and electrophotographic photosensitive member evaluation were carried out in the same manner as in Example 1. The results of measurement for the electrophotographic photosensitive member peripheral surface shape and the universal hardness (HU) and elastic deformation ratio are shown in Tables 1 to 3, and the results of evaluation for the electrophotographic photosensitive member are shown in Tables 5, 7 and 9. The measurement of the universal hardness (HU) and elastic deformation ratio was carried out after leaving the formed surface layer (in the present comparative example, the second charge transport layer) for 24 hours in a 23° C./50% RH environment.

Comparative Example 2

An electrophotographic photosensitive member was prepared in the same manner as that in Example 7, except that the dry-blasting of the second charge transport layer surface in Example 7 was not carried out.

Prepared in the same manner were an electrophotographic photosensitive member for universal hardness (HU) and elastic deformation ratio measurement, an electrophotographic photosensitive member for image evaluation under a high-temperature high-humidity environment, and an electrophotographic photosensitive member for rubbing memory evaluation.

Electrophotographic photosensitive member peripheral surface shape, universal hardness (HU) and elastic deformation ratio measurement and electrophotographic photosensitive member evaluation were carried out in the same manner as in Comparative Example 1. The results of measurement for the electrophotographic photosensitive member peripheral surface shape and the universal hardness (HU) and elastic deformation ratio are shown in Tables 1 to 3, and the results of evaluation for the electrophotographic photosensitive member are shown in Tables 5, 7 and 9.

Comparative Example 3

An electrophotographic photosensitive member was prepared in the same manner as that in Example 11, except that the dry-blasting of the charge transport layer surface in Example 11 was not carried out.

Prepared in the same manner were an electrophotographic photosensitive member for universal hardness (HU) and elastic deformation ratio measurement, an electrophotographic photosensitive member for image evaluation under a high-temperature high-humidity environment, and an electrophotographic photosensitive member for rubbing memory evaluation.

Electrophotographic photosensitive member peripheral surface shape, universal hardness (HU) and elastic deformation ratio measurement and electrophotographic photosensitive member evaluation were carried out in the same manner as in Comparative Example 1. The results of measurement for the electrophotographic photosensitive member peripheral surface shape and the universal hardness (HU) and elastic deformation ratio are shown in Tables 1 to 3, and the results of evaluation for the electrophotographic photosensitive member are shown in Tables 5, 7 and 9.

Comparative Example 4

An electrophotographic photosensitive member was prepared in the same manner as that in Example 14, except that the dry-blasting of the second charge transport layer surface in Example 14 was not carried out.

Prepared in the same manner were an electrophotographic photosensitive member for universal hardness (HU) and elastic deformation ratio measurement, an electrophotographic photosensitive member for image evaluation under a high-temperature high-humidity environment, and an electrophotographic photosensitive member for rubbing memory evaluation.

Electrophotographic photosensitive member peripheral surface shape, universal hardness (HU) and elastic deformation ratio measurement and electrophotographic photosensitive member evaluation were carried out in the same manner as in Comparative Example 1. The results of measurement for the electrophotographic photosensitive member peripheral surface shape and the universal hardness (HU) and elastic deformation ratio are shown in Tables 1 to 3, and the results of evaluation for the electrophotographic photosensitive member are shown in Tables 5, 7 and 9.

Comparative Example 5

An electrophotographic photosensitive member was prepared in the same manner as that in Example 17, except that the dry-blasting of the protective layer surface in Example 17 was not carried out.

Prepared in the same manner were an electrophotographic photosensitive member for universal hardness (HU) and elastic deformation ratio measurement, an electrophotographic photosensitive member for image evaluation under a high-temperature high-humidity environment, and an electrophotographic photosensitive member for rubbing memory evaluation.

Electrophotographic photosensitive member peripheral surface shape, universal hardness (HU) and elastic deformation ratio measurement and electrophotographic photosensitive member evaluation were carried out in the same manner as in Comparative Example 1. The results of measurement for the electrophotographic photosensitive member peripheral surface shape and the universal hardness (HU) and elastic deformation ratio are shown in Tables 1 to 3, and the results of evaluation for the electrophotographic photosensitive member are shown in Tables 5, 7 and 9.

Comparative Example 6

An electrophotographic photosensitive member was prepared in the same manner as that in Example 18, except that the dry-blasting of the second charge transport layer surface in Example 18 was not carried out.

Prepared in the same manner were an electrophotographic photosensitive member for universal hardness (HU) and elastic deformation ratio measurement, an electrophotographic photosensitive member for image evaluation under a high-temperature high-humidity environment, and an electrophotographic photosensitive member for rubbing memory evaluation.

Electrophotographic photosensitive member peripheral surface shape, universal hardness (HU) and elastic deformation ratio measurement and electrophotographic photosensitive member evaluation were carried out in the same manner as in Comparative Example 1. The results of measurement for the electrophotographic photosensitive member peripheral surface shape and the universal hardness (HU) and elastic deformation ratio are shown in Tables 1 to 3, and the results of evaluation for the electrophotographic photosensitive member are shown in Tables 5, 7 and 9.

Comparative Example 7

An electrophotographic photosensitive member was prepared in the same manner as that in Example 2, except that the dry-blasting of the second charge transport layer surface in Example 2 was changed to the below surface treatment.

That is, to begin with, an electrophotographic photosensitive member yet to undergo second charge transport layer surface treatment (object formed up until the second charge transport layer, hereinafter sometimes referred to as "object to be treated") was mounted on a rotary polisher.

Next, an abrasive-containing brush (Model name: TX #320-C-W; manufactured by State Industry Co., Ltd.) was abutted onto the peripheral surface of the object to be treated mounted on the rotary polisher in a length of brash penetration of 0.5 mm. Then, the object to be treated was rotated at 50 rpm, and the abrasive-containing brush was rotated in a direction opposite to that of the object to be treated at 2,500 rpm for 90 seconds, to thereby polish the peripheral surface of the object to be treated in a circumferential direction.

Prepared in the same manner were an electrophotographic photosensitive member for universal hardness (HU) and elastic deformation ratio measurement, an electrophotographic photosensitive member for image evaluation under a high-temperature high-humidity environment, and an electrophotographic photosensitive member for rubbing memory evaluation.

Electrophotographic photosensitive member peripheral surface shape, universal hardness (HU) and elastic deformation ratio measurement and electrophotographic photosensitive member evaluation were carried out in the same manner as in Example 1. The results of measurement for the electrophotographic photosensitive member peripheral surface shape and the universal hardness (HU) and elastic deformation ratio are shown in Tables 1 to 3, and the results of evaluation for the electrophotographic photosensitive member are shown in Tables 5, 7 and 9. Universal hardness (HU) and elastic deformation ratio were measured after leaving the formed surface layer (in the present comparative example, the second charge transport layer) for 24 hours in a 23° C./50% RH environment, and then measured again after carrying out the above-described surface treatment.

Comparative Example 8

An electrophotographic photosensitive member was prepared in the same manner as that in Example 7, except that the dry-blasting of the second charge transport layer surface in Example 7 was changed to same surface treatment as that in Comparative Example 7.

Prepared in the same manner were an electrophotographic photosensitive member for universal hardness (HU) and elastic deformation ratio measurement, an electrophotographic photosensitive member for image evaluation under a high-temperature high-humidity environment, and an electrophotographic photosensitive member for rubbing memory evaluation.

Electrophotographic photosensitive member peripheral surface shape, universal hardness (HU) and elastic deformation ratio measurement and electrophotographic photosensitive member evaluation were carried out in the same manner as in Comparative Example 7. The results of measurement for the electrophotographic photosensitive member peripheral surface shape and the universal hardness (HU) and elastic deformation ratio are shown in Tables 1 to 3, and the results of evaluation for the electrophotographic photosensitive member are shown in Tables 5, 7 and 9.

Comparative Example 9

An electrophotographic photosensitive member was prepared in the same manner as that in Example 11, except that dry-blasting of the charge transport layer surface was conducted according to the surface treatment of the second charge transport layer surface in Comparative Example 7.

Prepared in the same manner were an electrophotographic photosensitive member for universal hardness (HU) and elastic deformation ratio measurement, an electrophotographic photosensitive member for image evaluation under a high-temperature high-humidity environment, and an electrophotographic photosensitive member for rubbing memory evaluation.

Electrophotographic photosensitive member peripheral surface shape, universal hardness (HU) and elastic deformation ratio measurement and electrophotographic photosensitive member evaluation were carried out in the same manner as in Comparative Example 7. The results of measurement for the electrophotographic photosensitive member peripheral surface shape and the universal hardness (HU) and elastic deformation ratio are shown in Tables 1 to 3, and the results of evaluation for the electrophotographic photosensitive member are shown in Tables 5, 7 and 9.

Comparative Example 10

An electrophotographic photosensitive member was prepared in the same manner as that in Example 14, except that the dry-blasting of the second charge transport layer surface in Example 14 was changed to same surface treatment as that in Comparative Example 7.

Prepared in the same manner were an electrophotographic photosensitive member for universal hardness (HU) and elastic deformation ratio measurement, an electrophotographic photosensitive member for image evaluation under a high-temperature high-humidity environment, and an electrophotographic photosensitive member for rubbing memory evaluation.

Electrophotographic photosensitive member peripheral surface shape, universal hardness (HU) and elastic deformation ratio measurement and electrophotographic photosensitive member evaluation were carried out in the same manner as in Comparative Example 1. The results of measurement for the electrophotographic photosensitive member peripheral surface shape and the universal hardness (HU) and elastic deformation ratio are shown in Tables 1 to 3, and the results of evaluation for the electrophotographic photosensitive member are shown in Tables 5, 7 and 9.

Comparative Example 11

An electrophotographic photosensitive member was prepared in the same manner as that in Example 17, except that dry-blasting of the protective layer surface was conducted according to the surface treatment of the second charge transport layer surface in Comparative Example 7.

Prepared in the same manner were an electrophotographic photosensitive member for universal hardness (HU) and elastic deformation ratio measurement, an electrophotographic photosensitive member for image evaluation under a high-temperature high-humidity environment, and an electrophotographic photosensitive member for rubbing memory evaluation.

Electrophotographic photosensitive member peripheral surface shape, universal hardness (HU) and elastic deformation ratio measurement and electrophotographic photosensitive member evaluation were carried out in the same manner as in Comparative Example 1. The results of measurement for the electrophotographic photosensitive member peripheral surface shape and the universal hardness (HU) and elastic deformation ratio are shown in Tables 1 to 3, and the results of evaluation for the electrophotographic photosensitive member are shown in Tables 5, 7 and 9.

Comparative Example 12

An electrophotographic photosensitive member was prepared in the same manner as that in Example 18, except that the dry-blasting of the second charge transport layer surface in Example 18 was changed to same surface treatment as that in Comparative Example 7.

Prepared in the same manner were an electrophotographic photosensitive member for universal hardness (HU) and elastic deformation ratio measurement, an electrophotographic photosensitive member for image evaluation under a high-temperature high-humidity environment, and an electrophotographic photosensitive member for rubbing memory evaluation.

Electrophotographic photosensitive member peripheral surface shape, universal hardness (HU) and elastic deformation ratio measurement and electrophotographic photosensitive member evaluation were carried out in the same manner as in Comparative Example 1. The results of measurement for the electrophotographic photosensitive member peripheral surface shape and the universal hardness (HU) and elastic deformation ratio are shown in Tables 1 to 3, and the results of evaluation for the electrophotographic photosensitive member are shown in Tables 5, 7 and 9.

TABLE 1

| | Rzjis (A) [μm] | Rzjis (B) [μm] | RSm (C) [μm] | RSm (D) [μm] | RSm(D)/ RSm(C) | Rp(F) [μm] | Rv(E)/ Rp(F) |
|---|---|---|---|---|---|---|---|
| Ex. 1 | 0.56 | 0.59 | 43 | 41 | 0.95 | 0.20 | 2.21 |
| Ex. 2 | 0.68 | 0.64 | 45 | 46 | 1.02 | 0.20 | 2.70 |
| Ex. 3 | 0.43 | 0.42 | 67 | 74 | 1.10 | 0.11 | 3.31 |
| Ex. 4 | 0.72 | 0.72 | 49 | 47 | 0.96 | 0.22 | 3.55 |
| Ex. 5 | 0.71 | 0.68 | 44 | 48 | 1.09 | 0.23 | 3.65 |
| Ex. 6 | 0.68 | 0.67 | 43 | 48 | 1.12 | 0.22 | 3.20 |
| Ex. 7 | 0.70 | 0.75 | 44 | 48 | 1.09 | 0.26 | 2.96 |
| Ex. 8 | 0.71 | 0.69 | 46 | 46 | 1.00 | 0.25 | 3.11 |
| Ex. 9 | 0.83 | 0.87 | 53 | 59 | 1.11 | 0.32 | 3.87 |
| Ex. 10 | 0.42 | 0.45 | 74 | 72 | 0.97 | 0.18 | 1.63 |
| Ex. 11 | 0.46 | 0.48 | 62 | 54 | 0.87 | 0.19 | 1.58 |
| Ex. 12 | 0.75 | 0.78 | 45 | 48 | 1.07 | 0.28 | 2.54 |
| Ex. 13 | 0.79 | 0.81 | 53 | 50 | 0.94 | 0.34 | 2.41 |
| Ex. 14 | 0.76 | 0.76 | 51 | 59 | 1.16 | 0.30 | 2.05 |
| Ex. 15 | 1.16 | 1.20 | 61 | 53 | 0.87 | 0.36 | 2.88 |
| Ex. 16 | 1.27 | 1.31 | 74 | 72 | 0.97 | 0.35 | 3.36 |
| Ex. 17 | 1.44 | 1.49 | 79 | 76 | 0.96 | 0.48 | 2.00 |
| Ex. 18 | 1.41 | 1.43 | 72 | 77 | 1.07 | 0.46 | 2.12 |
| Ex. 19 | 0.92 | 0.96 | 47 | 50 | 1.06 | 0.48 | 1.95 |
| Ex. 20 | 1.23 | 1.19 | 96 | 86 | 0.89 | 0.51 | 1.35 |
| Ex. 21 | 1.32 | 1.37 | 107 | 110 | 1.03 | 0.59 | 1.27 |
| Com. Ex. 1 | 0.04 | 0.05 | — | — | — | 0.02 | 1.09 |
| Com. Ex. 2 | 0.05 | 0.05 | — | — | — | 0.02 | 1.1 |
| Com. Ex. 3 | 0.09 | 0.08 | — | — | — | 0.04 | 0.88 |
| Com. Ex. 4 | 0.05 | 0.06 | — | — | — | 0.03 | 1.06 |
| Com. Ex. 5 | 0.06 | 0.05 | — | — | — | 0.03 | 0.96 |
| Com. Ex. 6 | 0.18 | 0.19 | — | — | — | 0.1 | 0.92 |
| Com. Ex. 7 | 1.02 | 0.95 | 26 | 85 | 3.27 | 0.84 | 1.11 |
| Com. Ex. 8 | 1.49 | 1.37 | 28 | 81 | 2.89 | 0.82 | 1.24 |
| Com. Ex. 9 | 0.94 | 0.67 | 32 | 98 | 3.06 | 0.74 | 0.97 |
| Com. Ex. 10 | 1.30 | 1.10 | 27 | 109 | 4.04 | 0.88 | 1.2 |
| Com. Ex. 11 | 1.64 | 1.29 | 30 | 96 | 3.20 | 0.96 | 1.08 |
| Com. Ex. 12 | 1.58 | 1.48 | 30 | 126 | 4.20 | 0.97 | 0.93 |

TABLE 2

| | Number of dimple-shaped concave portions per 10,000 μm$^2$ | Surface area ratio of the dimple-shaped concave portions | Average aspect ratio of the dimple-shaped concave portions |
|---|---|---|---|
| Ex. 1 | 14 | 12.2 | 0.67 |
| Ex. 2 | 16 | 13.6 | 0.70 |
| Ex. 3 | 4 | 2.7 | 0.72 |
| Ex. 4 | 18 | 16.9 | 0.74 |
| Ex. 5 | 13 | 12.3 | 0.69 |
| Ex. 6 | 15 | 13.3 | 0.62 |
| Ex. 7 | 14 | 14.1 | 0.71 |
| Ex. 8 | 14 | 13.5 | 0.70 |
| Ex. 9 | 21 | 17.5 | 0.73 |
| Ex. 10 | 7 | 5.0 | 0.66 |
| Ex. 11 | 9 | 7.6 | 0.65 |
| Ex. 12 | 18 | 16.3 | 0.69 |
| Ex. 13 | 17 | 15.8 | 0.67 |
| Ex. 14 | 19 | 15.6 | 0.72 |
| Ex. 15 | 21 | 18.6 | 0.73 |
| Ex. 16 | 22 | 19.0 | 0.69 |
| Ex. 17 | 26 | 22.1 | 0.60 |
| Ex. 18 | 28 | 24.5 | 0.64 |
| Ex. 19 | 17 | 15.8 | 0.76 |
| Ex. 20 | 30 | 32.1 | 0.58 |
| Ex. 21 | 37 | 35.6 | 0.53 |
| Com. Ex. 1 | — | — | — |
| Com. Ex. 2 | — | — | — |
| Com. Ex. 3 | — | — | — |
| Com. Ex. 4 | — | — | — |
| Com. Ex. 5 | — | — | — |
| Com. Ex. 6 | — | — | — |
| Com. Ex. 7 | — | 22.6 | 0.32 |
| Com. Ex. 8 | — | 23.1 | 0.37 |
| Com. Ex. 9 | — | 14.2 | 0.46 |
| Com. Ex. 10 | — | 21.6 | 0.40 |
| Com. Ex. 11 | — | 38.9 | 0.34 |
| Com. Ex. 12 | — | 36.4 | 0.38 |

TABLE 3

| | Before dry-blasting | | After dry-blasting | |
|---|---|---|---|---|
| | Elastic deformation ratio [%] | Universal hardness value [N/mm$^2$] | Elastic deformation ratio [%] | Universal hardness value [N/mm$^2$] |
| Ex. 1 | 58 | 205 | 59 | 202 |
| Ex. 2 | 54 | 198 | 56 | 198 |
| Ex. 3 | 54 | 198 | 54 | 196 |
| Ex. 4 | 50 | 191 | 51 | 189 |
| Ex. 5 | 52 | 194 | 54 | 190 |
| Ex. 6 | 50 | 190 | 51 | 192 |
| Ex. 7 | 52 | 188 | 52 | 192 |
| Ex. 8 | 53 | 183 | 53 | 187 |
| Ex. 9 | 48 | 178 | 50 | 177 |
| Ex. 10 | 63 | 216 | 64 | 218 |
| Ex. 11 | 61 | 209 | 62 | 204 |
| Ex. 12 | 51 | 200 | 53 | 201 |
| Ex. 13 | 49 | 197 | 51 | 195 |
| Ex. 14 | 52 | 197 | 51 | 198 |
| Ex. 15 | 48 | 205 | 48 | 200 |
| Ex. 16 | 47 | 202 | 48 | 199 |
| Ex. 17 | 45 | 172 | 45 | 176 |
| Ex. 18 | 46 | 185 | 45 | 185 |
| Ex. 19 | 57 | 207 | 55 | 203 |
| Ex. 20 | 44 | 214 | 44 | 208 |
| Ex. 21 | 41 | 216 | 42 | 210 |
| Com. Ex. 1 | 54 | 198 | — | — |
| Com. Ex. 2 | 52 | 188 | — | — |
| Com. Ex. 3 | 61 | 209 | — | — |
| Com. Ex. 4 | 52 | 197 | — | — |
| Com. Ex. 5 | 45 | 172 | — | — |
| Com. Ex. 6 | 46 | 185 | — | — |

TABLE 3-continued

| | Before dry-blasting | | After dry-blasting | |
|---|---|---|---|---|
| | Elastic deformation ratio [%] | Universal hardness value [N/mm$^2$] | Elastic deformation ratio [%] | Universal hardness value [N/mm$^2$] |
| Com. Ex. 7 | 54 | 198 | 51 | 187 |
| Com. Ex. 8 | 52 | 188 | 49 | 180 |
| Com. Ex. 9 | 61 | 209 | 57 | 195 |
| Com. Ex. 10 | 52 | 197 | 48 | 186 |
| Com. Ex. 11 | 45 | 172 | 43 | 154 |
| Com. Ex. 12 | 46 | 185 | 43 | 180 |

In Table 3, for Comparative Examples 7 to 12 the values for "Before dry-blasting" are the values for "Before surface treatment in place of dry-blasting", and the values for "After dry-blasting" are the values for "After surface treatment in place of dry-blasting".

TABLE 4

| | Results of 5,000-sheet durability test | | |
|---|---|---|---|
| | Cleaning characteristics for a high-pressure blade setting | Cleaning characteristics for a low-pressure blade setting | Rate of increase in rotational torque of the electrophotographic photosensitive member |
| Ex. 1 | Good cleaning | Good cleaning | 1.5 |
| Ex. 2 | Good cleaning | Good cleaning | 1.4 |
| Ex. 3 | Good cleaning | Good cleaning | 1.8 |
| Ex. 4 | Good cleaning | Good cleaning | 1.1 |
| Ex. 5 | Good cleaning | Good cleaning | 1.3 |
| Ex. 6 | Good cleaning | Good cleaning | 1.3 |
| Ex. 7 | Good cleaning | Good cleaning | 1.2 |
| Ex. 8 | Good cleaning | Good cleaning | 1.2 |
| Ex. 9 | Good cleaning | Good cleaning | 1.2 |
| Ex. 10 | Good cleaning | Good cleaning | 1.8 |
| Ex. 11 | Good cleaning | Good cleaning | 1.6 |
| Ex. 12 | Good cleaning | Good cleaning | 1.3 |
| Ex. 13 | Good cleaning | Good cleaning | 1.3 |
| Ex. 14 | Good cleaning | Good cleaning | 1.7 |
| Ex. 15 | Good cleaning | Good cleaning | 1.6 |
| Ex. 16 | Good cleaning | Good cleaning | 1.7 |
| Ex. 17 | Good cleaning | Good cleaning | 1.8 |
| Ex. 18 | Good cleaning | Good cleaning | 1.6 |
| Ex. 19 | Good cleaning | Good cleaning | 1.6 |
| Ex. 20 | Good cleaning | Good cleaning | 1.1 |
| Ex. 21 | Good cleaning | Good cleaning | 1.1 |

TABLE 5

| | Results of 5,000-sheet durability test | | |
|---|---|---|---|
| | Cleaning characteristics for a high-pressure blade setting | Cleaning characteristics for a low-pressure blade setting | Rate of increase in rotational torque of the electrophotographic photosensitive member |
| Com. Ex. 1 | Blade noised | Blade noised modestly | 3.5 |
| Com. Ex. 2 | Blade noised | Blade noised modestly | 3.4 |
| Com. Ex. 3 | Toner passed due to blade chatter | Blade noised modestly | 3.7 |
| Com. Ex. 4 | Blade noised | Blade noised modestly | 3.6 |
| Com. Ex. 5 | Toner passed due to blade chatter | Blade noised | 3.4 |

TABLE 5-continued

| | Results of 5,000-sheet durability test | | |
|---|---|---|---|
| | Cleaning characteristics for a high-pressure blade setting | Cleaning characteristics for a low-pressure blade setting | Rate of increase in rotational torque of the electrophotographic photosensitive member |
| Com. Ex. 6 | Toner passed due to blade chatter | Blade noised | 3.3 |
| Com. Ex. 7 | Good cleaning | Toner leaked linearly from the blade | 2.5 |
| Com. Ex. 8 | Good cleaning | Toner leaked linearly from the blade | 2.3 |
| Com. Ex. 9 | Good cleaning | Toner leaked linearly from the blade | 3.1 |
| Com. Ex. 10 | Toner leaked linearly from the blade | Toner leaked linearly from the blade | 2.9 |
| Com. Ex. 11 | Good cleaning | Toner leaked linearly from the blade | 2.8 |
| Com. Ex. 12 | Toner leaked linearly from the blade | Toner leaked linearly from the blade | 2.4 |

TABLE 6

| | Results of 50,000-sheet durability test | | |
|---|---|---|---|
| | Cleaning characteristics for a high-pressure blade setting | Cleaning characteristics for a low-pressure blade setting | Rate of increase in rotational torque of the electrophotographic photosensitive member |
| Ex. 1 | Good cleaning | Good cleaning | 1.7 |
| Ex. 2 | Good cleaning | Good cleaning | 1.6 |
| Ex. 3 | Blade noised modestly on finishing approximately 45,000 sheets | Good cleaning | 2.2 |
| Ex. 4 | Good cleaning | Good cleaning | 1.5 |
| Ex. 5 | Good cleaning | Good cleaning | 1.6 |
| Ex. 6 | Good cleaning | Good cleaning | 1.5 |
| Ex. 7 | Good cleaning | Good cleaning | 1.4 |
| Ex. 8 | Good cleaning | Good cleaning | 1.4 |
| Ex. 9 | Good cleaning | Good cleaning | 1.5 |
| Ex. 10 | Good cleaning | Good cleaning | 2.0 |
| Ex. 11 | Good cleaning | Good cleaning | 1.9 |
| Ex. 12 | Good cleaning | Good cleaning | 1.5 |
| Ex. 13 | Good cleaning | Good cleaning | 1.4 |
| Ex. 14 | Good cleaning | Good cleaning | 1.8 |
| Ex. 15 | Good cleaning | Good cleaning | 1.8 |
| Ex. 16 | Good cleaning | Good cleaning | 1.8 |
| Ex. 17 | Good cleaning | Good cleaning | 1.9 |
| Ex. 18 | Good cleaning | Minor cleaning defective on finishing approximately 45,000 sheets | 1.8 |
| Ex. 19 | Good cleaning | Good cleaning | 2.1 |
| Ex. 20 | — | — | — |
| Ex. 21 | — | — | — |

TABLE 7

| | Results of 50,000-sheet durability test | | |
|---|---|---|---|
| | Cleaning characteristics for a high-pressure blade setting | Cleaning characteristics for a low-pressure blade setting | Rate of increase in rotational torque of the electro-photographic photosensitive member |
| Com. Ex. 1 | Toner passed due to blade chatter | Cleaning defective on finishing approximately 50,000 sheets | 6.2 |
| Com. Ex. 2 | Toner passed due to blade chatter | Cleaning defective on finishing approximately 50,000 sheets | 6.0 |
| Com. Ex. 3 | Cleaning defective and blade wore-out on finishing approximately 50,000 sheets | Cleaning defective on finishing approximately 45,000 sheets | 6.8 |
| Com. Ex. 4 | Cleaning defective | Cleaning defective on finishing approximately 45,000 sheets | 6.1 |
| Com. Ex. 5 | Cleaning defective and blade wore-out on finishing approximately 45,000 sheets | Cleaning defective on finishing approximately 40,000 sheets | 5.9 |
| Com. Ex. 6 | Cleaning defective and blade wore-out on finishing approximately 45,000 sheets | Cleaning defective on finishing approximately 40,000 sheets | 5.7 |
| Com. Ex. 7 | Cleaning defective due to blade chipping on finishing approximately 30,000 sheets | Line-shaped image defects on finishing approximately 35,000 sheets | 4.8 |
| Com. Ex. 8 | Cleaning defective due to blade chipping on finishing approximately 30,000 sheets | Line-shaped image defects on finishing approximately 35,000 sheets | 5.0 |
| Com. Ex. 9 | Cleaning defective due to blade chipping on finishing approximately 25,000 sheets | Line-shaped image defects on finishing approximately 30,000 sheets | 5.5 |
| Com. Ex. 10 | Cleaning defective due to blade chipping on finishing approximately 30,000 sheets | Line-shaped image defects on finishing approximately 30,000 sheets | 4.6 |
| Com. Ex. 11 | Cleaning defective due to blade chipping on finishing approximately 20,000 sheets | Line-shaped image defects on finishing approximately 25,000 sheets | 5.1 |
| Com. Ex. 12 | Cleaning defective due to blade chipping on finishing approximately 20,000 sheets | Line-shaped image defects on finishing approximately 25,000 sheets | 4.3 |

TABLE 8

| | Image evaluation under a high-temperature high-humidity environment | Rubbing memory evaluation [V] |
|---|---|---|
| Ex. 1 | Good image | 2 |
| Ex. 2 | Good image | 1 |
| Ex. 3 | Voids due to minor toner fusion on finishing approximately 9,000 sheets | 12 |
| Ex. 4 | Good image | 0 |
| Ex. 5 | Good image | 3 |
| Ex. 6 | Good image | 0 |
| Ex. 7 | Good image | 3 |
| Ex. 8 | Good image | 4 |
| Ex. 9 | Good image | 5 |
| Ex. 10 | Good image | 3 |
| Ex. 11 | Good image | 6 |
| Ex. 12 | Good image | 1 |
| Ex. 13 | Good image | 0 |
| Ex. 14 | Good image | 2 |
| Ex. 15 | Good image | 3 |
| Ex. 16 | Good image | 3 |
| Ex. 17 | Minor image deletion on finishing approximately 8,000 sheets | 6 |
| Ex. 18 | Good image | 5 |
| Ex. 19 | Good image | 8 |
| Ex. 20 | Good image | 8 |
| Ex. 21 | Good image | 9 |

TABLE 9

| | Image evaluation under a high-temperature high-humidity environment | Rubbing memory evaluation [V] |
|---|---|---|
| Com. Ex. 1 | Voids due to toner fusion on finishing approximately 5,000 sheets | 35 |
| Com. Ex. 2 | Voids due to toner fusion on finishing approximately 5,000 sheets | 38 |
| Com. Ex. 3 | Voids due to toner fusion on finishing approximately 4,000 sheets | 41 |
| Com. Ex. 4 | Voids due to toner fusion on finishing approximately 4,000 sheets | 36 |
| Com. Ex. 5 | Voids due to toner fusion on finishing approximately 3,000 sheets and occurrence of image defects due to a flaw in the peripheral surface of electrophotographic photosensitive member on finishing approximately 8,000 sheets | 40 |
| Com. Ex. 6 | Voids due to toner fusion on finishing approximately 5,000 sheets | 36 |
| Com. Ex. 7 | Line-shaped image deletion on finishing approximately 7,000 sheets | 25 |
| Com. Ex. 8 | Line-shaped image deletion on finishing approximately 7,000 sheets | 25 |
| Com. Ex. 9 | Line-shaped image deletion on finishing approximately 6,000 sheets | 27 |
| Com. Ex. 10 | Line-shaped image deletion on finishing approximately 6,000 sheets | 24 |
| Com. Ex. 11 | Line-shaped image deletion on finishing approximately 4,000 sheets | 30 |
| Com. Ex. 12 | Line-shaped image deletion on finishing approximately 5,000 sheets | 29 |

The electrophotographic photosensitive member according to the present invention was less susceptible to cleaning defects even if repeatedly used, and also less susceptible to image defects even if used in a high-temperature and high-humidity environment.

The present application claims priorities from Japanese Patent Application No. 2004-092099 filed on Mar. 26, 2004; Japanese Patent Application No. 2004-131660 filed on Apr. 27, 2004; and Japanese Patent Application No. 2004-308308 filed on Oct. 22, 2004, which are hereby incorporated by reference herein in their entirety.

What is claimed is:

1. A cylindrical electrophotographic photosensitive member comprising: a cylindrical support and an organic photosensitive layer provided on the cylindrical support, wherein a peripheral surface of the electrophotographic photosensitive member has a plurality of dimple-shaped concavities, a 10-point average roughness Rzjis (A) as measured along the circumference of the peripheral surface of the electrophotographic photosensitive member is 0.3 to 2.5 um, a 10-point average roughness Rzjis (B) as measured along the generating line of the peripheral surface of the electrophotographic photosensitive member is 0.3 to 2.5 um, a mean spacing of profile irregularities, RSm (C), as measured along the circumference of the peripheral surface of the electrophotographic photosensitive member is 5 to 120 um, a mean spacing of profile irregularities, RSm (D), as measured along the generating line of the electrophotographic photosensitive member is 5 to 120 um, and the value of a ratio (D/C) of the mean spacing of profile irregularities RSm (D) to the mean spacing of profile irregularities RSm (C) is 0.5 to 1.5, and wherein among said dimple-shaped cancavities, the number of dimple-shaped concavities of which the maximum diameter is in the range of 1 to 50 um and the depth is in the range of 0.1 to 2.5 um is 5 to 50 per 10,000 $um^2$ of peripheral surface of said electrophotographic photosensitive member.

2. The electrophotographic photosensitive member according to claim 1, wherein said 10-point average roughness Rzjis (A) is 0.4 to 2.0 um, said 10-point average roughness Rzjis (B) is 0.4 to 2.0 um, said mean spacing of profile irregularities RSm (C) is 10 to 100 um, said mean spacing of profile irregularities RSm (D) is 10 to 100 um, and the value of the ratio (D/C) of said mean spacing of profile irregularities RSm (D) to said mean spacing of profile irregularities RSm (C) is 0.8 to 1.2.

3. The electrophotographic photosensitive member according to claim 1 or 2, wherein a maximum peak height Rp (F) of the peripheral surface of said electrophotographic photosensitive member is 0.6 um or less, and the value of a ratio (E/F) of a maximum valley depth Rv(E) of the peripheral surface of said electrophotographic photosensitive member to the maximum peak height Rp (F) is 1.2 or greater.

4. The electrophotographic photosensitive member according to claim 3, wherein said maximum peak height Rp (F) is 0.4 um or less, and the value of the ratio (E/F) of said maximum valley depth Rv (E) to said maximum peak height Rp (F) is 1.5 or greater.

5. The electrophotographic photosensitive member according to claim 1, wherein among said dimple-shaped concavities, the total area of dimple-shaped concavities of which the maximum diameter is in the range of range of 1 to 50 um and the depth is in the range of 0.1 to 2.5 um is 3 to 60% based on the entire area of the peripheral surface of said electrophotographic photosensitive member.

6. The electrophotographic photosensitive member according to claim 1, wherein among said dimple-shaped concavities, the average aspect ratio of dimple-shaped concavities of which the maximum diameter is in the range of 1 to 50 um and the depth is in the range of 0.1 to 2.5 um is 0.50 to 0.95.

7. The electrophotographic photosensitive member according to claim 1, wherein the value of universal hardness (HU) of the peripheral surface of said electrophotographic photosensitive member is 150 to 220 $N/mm^2$.

8. The electrophotographic photosensitive member according to claim 1, wherein the elastic deformation ratio of the peripheral surface of said electrophotographic photosensitive member is 40% or greater.

9. The electrophotographic photosensitive member according to claim 8, wherein the elastic deformation ratio of the peripheral surface of said electrophotographic photosensitive member is 45% or greater.

10. The electrophotographic photosensitive member according to claim 9, wherein the elastic deformation ratio of the peripheral surface of said electrophotographic photosensitive member is 50% or greater.

11. The electrophotographic photosensitive member according to claim 10, wherein the elastic deformation ratio of the peripheral surface of said electrophotographic photosensitive member is 65% or less.

12. A method for manufacturing the electrophotographic photosensitive member according to claim 1, comprising:

a surface layer forming step of forming a surface layer of the electrophotographic photosensitive member; and a concavity forming step of forming dimple-shaped concavities on the surface of the surface layer by subjecting the surface of the surface layer to a dry blast process or a wet honing process.

13. A process cartridge which comprises and integrally supports the electrophotographic photosensitive member according to claim 1 or an electrophotographic photosensitive member manufactured by the manufacturing method according to claim 12, and at least one selected from the group consisting of charging means, development means and cleaning means, and is detachably affixed to an electrophotographic apparatus main body.

14. An electrophotographic apparatus comprising the electrophotographic photosensitive member according to claim 1, or an electrophotographic photosensitive member manufactured by the manufacturing method according to claim 12, charging means, exposure means, development means, transfer means and cleaning means.

* * * * *